US007124547B2

(12) United States Patent
Bravinski

(10) Patent No.: US 7,124,547 B2
(45) Date of Patent: Oct. 24, 2006

(54) 3-D CONSTRUCTION MODULES

(76) Inventor: Leonid G. Bravinski, 5418 Yonge Street, Unit 2606, Toronto, Ontario (CA) M2N 6X4

( * ) Notice: Subject to any disclaimer, the term of this patent is extended or adjusted under 35 U.S.C. 154(b) by 149 days.

(21) Appl. No.: 10/228,169

(22) Filed: Aug. 26, 2002

(65) Prior Publication Data

US 2004/0035073 A1 Feb. 26, 2004

(51) Int. Cl.
*E04B 2/00* (2006.01)

(52) U.S. Cl. ..... 52/426; 52/562; 52/564; 52/699; 52/701; 52/309.12; 249/41; 249/43; 249/191; 249/214

(58) Field of Classification Search ..... 52/426, 52/699, 701, 564, 309.12; 249/40, 41, 43, 249/45, 191, 192, 214
See application file for complete search history.

(56) References Cited

U.S. PATENT DOCUMENTS 3,145,505 A 8/1964 Cornelius
3,625,470 A * 12/1971 Shoemaker ..... 249/214
3,734,453 A * 5/1973 Bailey ..... 249/213
4,234,156 A * 11/1980 Wepf ..... 249/40
4,432,289 A * 2/1984 Norman et al. ..... 110/336
4,545,163 A 10/1985 Asselin
4,552,600 A 11/1985 Laiewski et al.
4,805,366 A * 2/1989 Long ..... 52/309.11
4,864,792 A 9/1989 Andre et al.
4,901,494 A 2/1990 Miller et al.
4,972,646 A 11/1990 Miller et al.
4,999,965 A 3/1991 Schmidgall et al.
5,107,648 A * 4/1992 Roby ..... 52/309.12
5,140,794 A 8/1992 Miller
5,209,039 A * 5/1993 Boeshart ..... 52/699
5,287,672 A 2/1994 Moore
5,332,189 A * 7/1994 Tseng ..... 249/40
5,350,162 A 9/1994 Cushing
5,497,592 A 3/1996 Boeshart
5,566,525 A 10/1996 Schwarz
5,570,552 A 11/1996 Nehring
5,664,378 A 9/1997 Bettigole et al.
5,761,874 A * 6/1998 Hayakawa ..... 52/701
5,771,648 A 6/1998 Miller et al.
5,809,725 A 9/1998 Cretti
5,832,690 A 11/1998 Kaines
5,861,105 A 1/1999 Martineau
5,887,401 A 3/1999 Moore, Jr.

(Continued)

*Primary Examiner*—Carl D. Friedman
*Assistant Examiner*—Yvonne M. Horton
(74) *Attorney, Agent, or Firm*—Smart & Biggar

(57) ABSTRACT

A 3D construction module comprising at least one vertically upstanding panel with first and second mesh layers oriented generally transversely and longitudinally. The first and second mesh layers have at least one rod member mounted to said panel and are vertically spaced from each other. The rod members form a first horizontally projected retention cell to restrict translation of a bar held in said retention cell between said first and second mesh layers. A third mesh can also be provided to form a second retention cell between said second and third mesh layers. The first and second retention cells restrict translation movement longitudinally and transversely of a vertical reinforcement member held in said first and second retention cells, and restrict rotation of the vertical reinforcement member about both a longitudinal axis and a transverse axis of the said 3D construction module. Horizontal reinforcement meshes are features of the invention. Other features of the invention include a trough for holding melted panel material, connectors for connecting rods to panels and associated stopper members. Also included are bracers for joining connectors and other devices related to panel connections.

74 Claims, 33 Drawing Sheets

U.S. PATENT DOCUMENTS 5,895,188 A * 4/1999 Cheng ..... 411/433
6,070,380 A 6/2000 Meilleur
6,138,981 A * 10/2000 Keith et al. ..... 249/41
6,167,671 B1 1/2001 Wilson
6,176,059 B1 1/2001 Cantarano et al.
6,216,412 B1 4/2001 Offersen
6,279,285 B1 8/2001 Kubica
6,308,401 B1 10/2001 Gress
6,321,498 B1 11/2001 Trovato
6,536,180 B1 3/2003 Rosenblat et al.
2001/0020351 A1 9/2001 Alvaro

* cited by examiner

5A

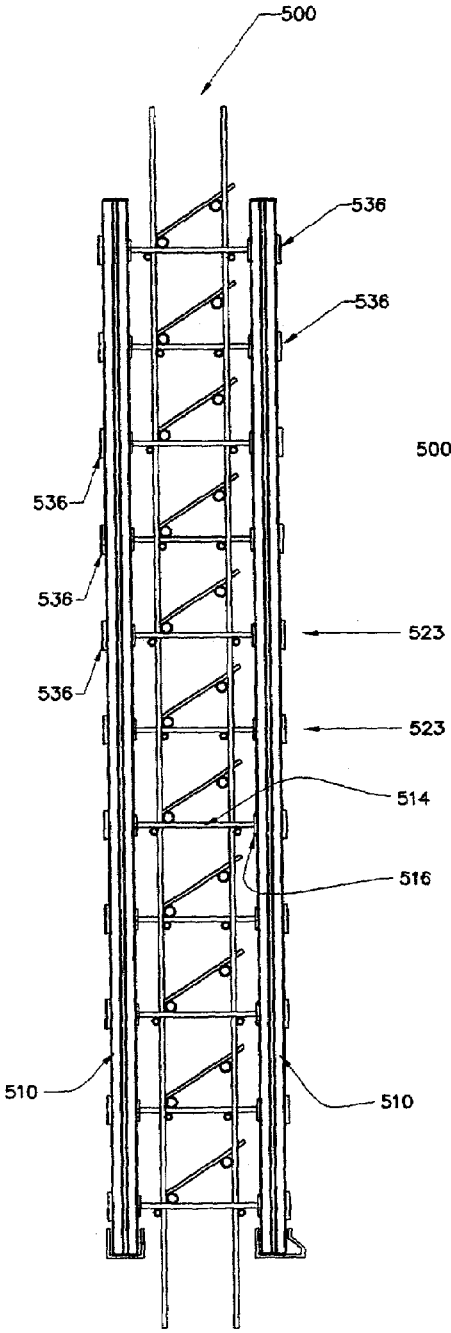
FIG. 7C
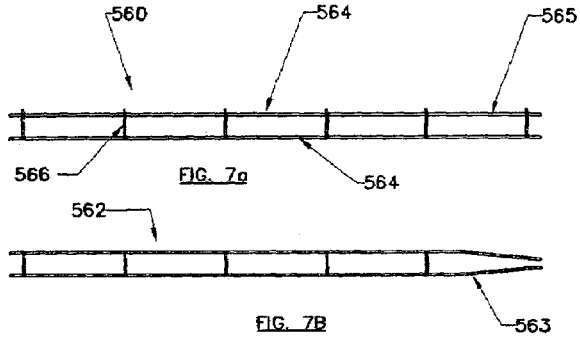
FIG. 7a
FIG. 7B
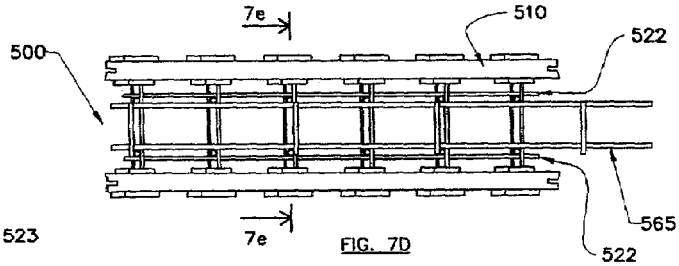
FIG. 7D
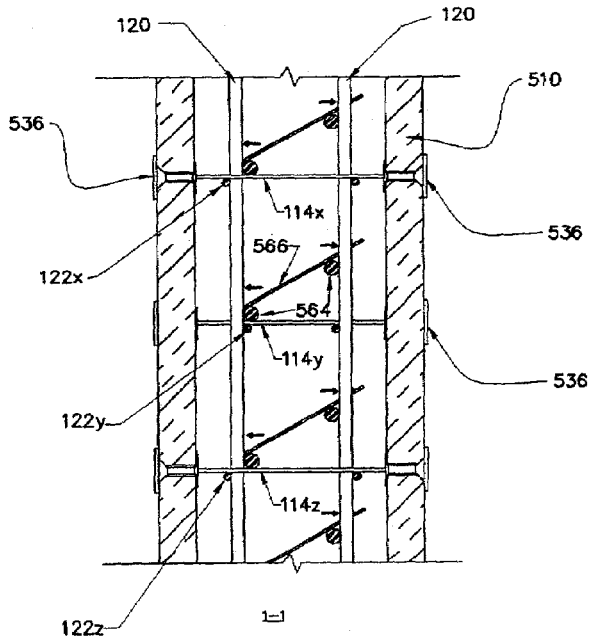
FIG. 7E

3-D CONSTRUCTION MODULES

FIELD OF THE INVENTION

The present invention relates to the field of construction, and in particular to the construction of poured-in-place reinforced concrete walls and other structural elements, and to their construction with 3D form modules. These modules can be prefabricated both prior to transportation to a construction site and directly on the construction site prior to installation into the design position.

BACKGROUND

At the present time, the most advanced method of making reinforced concrete walls and similar structural elements, uses 3D prefabricated construction modules comprising parallel panels spaced from each other. The modules also include transverse elements in the form of grids or meshes preferably horizontally oriented and fixed to the panels, and include connectors joining transverse elements and panels. The transverse elements usually have stopping details, which usually serve as support for panels. These 3D prefabricated construction modules can be made at a location remote from the construction site or directly on the site where they are eventually installed in the location desired for the building of wall or other structural elements.

The 3D prefabricated construction modules can be longitudinally and vertically interconnected to provide a continuous form in the space between a series of interconnected pairs of panels. This form space can be filled with unhardened concrete then allowed to harden to produce a structural element such as a wall. Typically the panels remain in place after the concrete has hardened and the panels provide added qualities for the structure as a whole, including providing sound and heat insulation. The panels may themselves thereafter be covered on their outward facing surfaces with a protective covering layer such as drywall, cement board, plaster, stucco and so on.

It is common for the panels to be made of lightweight materials such as foamed plastics (eg. foamed polystyrene).

There are numerous criteria to be concerned about in the design of such 3D prefabricated construction modules. For example, the 3D prefabricated module usually must be able to support appropriate reinforcement members (eg. rebar), including usually both horizontal and vertical reinforcement members. To date, most of the known designs for reinforcement support are complex and costly to implement.

Also, it should be noted, that there is a high consumption of labor when connecting 3D prefabricated construction modules and reinforcement member (ie. rebar) extensions from concrete structures beneath the modules, such as foundations, in order to provide continuous reinforcement. In most of the building systems using 3D prefabricated construction modules, installation is performed in a way akin to a "shish kebob" rodding.

Another design criterion for such 3D prefabricated modules is the requirement of both panels and the stabilizing or bracing members, to be able to withstand the relatively high hydrostatic pressures that can develop when the form is filled with unhardened concrete. Additionally, it is desirable to minimize the extent of the thermal bridge that can be created between one side of the 3D prefabricated construction module and the other, or between the inner form space and the external side of the 3D prefabricated construction module by such components as the stabilizing members. Furthermore, the technique of concrete placement itself and its further hardening allows the creation of a 3D pattern on the surface of the concreted structures. Thus, it is also desirable to have a module with at least one panel, which would have a negative pattern. After concrete hardening the panels could easily be removed leaving positive 3D pattern on the surface of the concreted structure.

Other design criteria include the desirability of having modules that are relatively easy to: inter-connect to each other; secure to supporting elements such as footings; and be easily transported to a construction site. It is also desirable to have 3D prefabricated construction modules that can be readily put into operation without a large amount of time and cost being expended.

Also, a particular concern regarding fire proofing of a structural element arises when plastic materials are used as materials for the panels and are retained on the structural element after it has been created. It is well known that fire and its associated heat can have a negative impact on structural stability of a concrete wall, and on the ability of the wall or other element to contain the fire. There is a tendency of such panels to melt when subjected to heat on one side of a wall caused by a fire in the vicinity of the wall. The liquid material from the panel then can flow toward the fire source and ignite. This can cause the fire to move along a path directly toward the wall and can create an intense fire situation right at or in the immediate vicinity of the wall. This of course has an extremely detrimental effect, both on the structural stability of the wall, as well as its ability to contain the fire. Accordingly, it is desirable to minimize the potential damage that can be done by the panels, when they are subjected to heat for a fire source.

SUMMARY OF THE INVENTION

In one aspect of the present invention, there is provided a 3D construction module comprising: a) a vertically upstanding panel oriented generally longitudinally; b) first and second mesh layers oriented generally transversely and longitudinally, each of said first and second mesh layers comprising at least one rod member mounted to said panel, said first and second mesh layers being vertically spaced from each other; said at least one rod member of said first mesh layer configured to co-operate with said at least one rod member of said second mesh layer to form a first horizontally projected retention cell to restrict translation of a bar held in said retention cell between said first and second mesh layers; whereby said first retention cell forms a generally vertically oriented opening for receiving a vertical reinforcement member and said retention cell restricts translation movement longitudinally and transversely of a vertical reinforcement member held in said retention cell.

In another aspect of the present invention, there is provided a panel for use in a 3D construction module, said panel comprising: a body with a thickness, said body having a pair of opposed, generally parallel and flat, longitudinal surfaces; a plurality of spaced openings passing through said body, said openings arranged in a first row of openings, said first row of openings being oriented at angle to said longitudinal surfaces.

In another aspect of the present invention, there is provided a panel for use in a 3D construction module, said panel comprising: a body with a thickness, said body having a pair of opposed, generally parallel and flat, longitudinal surfaces; a plurality of spaced transverse openings passing through said body, said openings arranged in a first row of openings and a second row of spaced openings, said second row of openings being vertically spaced on said body from said first set of openings and generally parallel to said first row of openings, and being longitudinally off-set from said first row of openings.

In another aspect of the present invention, there is provided a connector to connect a panel to a rod member, said connector having a cap portion with a first central longitudinal axis and a body portion with a second longitudinal axis being displaced from said first longitudinal axis, said body portion having a cavity adapted to engage a rod member.

In another aspect of the present invention, there is provided a bracer for securing two connectors together, said bracer comprising a generally C-shaped body having a medial portion and first and second spaced leg portions, each of first and second leg portions having an inner face, the inner face of said first leg portion being positioned opposite to the inner face of said second leg portion, each said inner face having a blade forming a tapping tool, wherein when a blade is in contact with a connector, and said connector is rotated, said blade forms a helical indentation in an outer surface of said connector to secure said blade on said connector.

In another aspect of the present invention, there is provided a 3D construction module comprising: first and second vertically upstanding, spaced apart panels oriented generally longitudinally; first and second mesh layers oriented generally transversely and longitudinally, each of said first and second mesh layer comprising at least one rod member mounted to each of said first and second panels, said first and second mesh layers being vertically spaced from each other; said at least one rod member of said first mesh layer configured to co-operate with said at least one rod member of said second mesh layer to form a first horizontally projected retention cell to restrict translation of a vertical reinforcement bar held in said retention cell between said first and second mesh layers; c) a vertical reinforcement bar held in said retention cell; whereby said retention cell forms a generally vertically oriented opening for receiving said vertical reinforcement member, said retention cell restricts translation movement longitudinally and transversely of a vertical reinforcement member held in said retention cell.

In another aspect of the present invention, there is provided a 3D construction module comprising: a) first and second vertically upstanding, spaced apart panels oriented generally longitudinally; b) first and second mesh layers oriented generally transversely and longitudinally, each of said first and second mesh layer comprising at least one rod member mounted to each of said first and second panels, said first and second mesh layers being vertically spaced from each other; said at least one rod member of said first mesh layer configured to co-operate with said at least one rod member of said second mesh layer to form a first horizontally projected retention cell to restrict translation of vertical reinforcement bars held in said retention cells between said first and second mesh layers; c) a first vertical reinforcement bar held, respectively, in said first retention cell; whereby said first and detention cells form first and second generally vertically oriented openings for receiving respectively, said first and second vertical reinforcement members, said first and second retention cells respectively restricting translation movement longitudinally and transversely of said first and second vertical reinforcement members held in said retention cell; d) a horizontal reinforcement mesh comprising first and second reinforcement bars oriented generally longitudinally, said first and second horizontal reinforcement bars being interconnected by at least one transverse connecting rod member, said horizontal reinforcement mesh being received between said first and second panels with said first and second horizontal reinforcement bars being oriented generally longitudinally and said first horizontal reinforcement bar being in abutment said first vertical reinforcement bar so as to tend to push said first vertical reinforcement bar transversely outward toward said first panel.

In another aspect of the present invention, there is provided a combination of a panel and a trough element for use in a 3D construction module, said panel made of a meltable panel material and comprising a body with a thickness, said body having a pair of opposed, generally parallel and flat, longitudinal surfaces and a base; a trough element affixed to said base of said panel, said trough having a reservoir of sufficient size to hold the material of said panel when said panel is subjected to sufficient heat from a heat source, to melt said panel material, said panel material flowing into said reservoir when melted by said heat source.

In another aspect of the present invention, there is provided a construction combination comprising: a) a mesh comprising a first longitudinal rod member and a plurality of transverse rod members connected to said longitudinal rod member; b) a stopper member for each of said plurality of transverse rod members, each stopper member having a leg portion and a first flange portion, and an axial passageway through said leg portion and said first flange portion, said passageway for freely receiving a rod member there through, said stopper member movable axially on said rod member, said first flange portion adapted to be moved into abutment an inner surface of a panel, said leg portion adapted to be moved into abutment with said longitudinal member, whereby said flange member can co-operate with connector connecting said panel with a transverse rod to properly position said connector and can co-operate with said panel to properly position said inner surface of said panel relative to said longitudinal member.

In another aspect of the present invention, there is provided a connector to connect a panel to a rod member, said connector having a cap portion, a first body portion having an outer surface shaped as a truncated cone portion, said first body portion having its outer surface narrow towards a connection with a second body portion, said second body portion having an outer surface that is generally cylindrical, said second body portion having a inner cavity adapted to engage a rod member.

In another aspect of the present invention, there is provided a 3D construction module comprising: first and second mesh layers oriented generally transversely and longitudinally, each of said first and second mesh layers comprising a plurality of transversely oriented, and spaced transverse rod members, each of said transverse rod members having an end adapted for mounting to a panel, said plurality of transverse rod members being interconnected to first and second longitudinally oriented and spaced longitudinal rod members, said first and second mesh layers being vertically spaced from each other; at least one of said transverse rod members and one of said first and second longitudinal rod members of said first mesh layer configured to co-operate with at least one of said transverse rod members and one of said first and second longitudinal rod members of said second mesh layer to form a first horizontally projected retention cell to restrict translation of a bar held in said retention cell between said first and second mesh layers; whereby said first retention cell forms a generally vertically oriented opening for receiving a vertical reinforcement member and said retention cells restrict translation movement longitudinally and transversely of a vertical reinforcement member held in said retention cell.

In another aspect of the present invention, there is provided a stopper member comprising: a cylindrical body portion having a first end and a second end, and having a first axial passageway open from said first end and said second end; a first flange member formed on said body at said first end; a second flange member formed on said body at said second end; a second body portion joined to said first body portion at said second end, said second body portion having a second axial passageway that is narrower than said first axial passageway, said second body portion having a first generally cylindrical portion adjoining said second flange member, and a truncated conical flange portion, said truncated conical flange portion and said second flange member providing a cavity therebetween for holding at least one rod member therebetween.

In another aspect of the present invention, there is provided a system for creating a concrete form comprising said first and second panels arranged such that said first and second panels are in longitudinal, upstanding and abutting alignment, said first panel unit has a leading side face and said second panel having a trailing side face, each of said leading side face and said trailing side face being generally in abutment with each other, each of said leading side face and said trailing side face having a centrally positioned, elongated groove, and said system further comprising a separate elongated plate member, and said leading face has on one side of said groove a side flange portion, and said trailing face as an opposed side flange portion opposite to said side flange portion of said leading face, and wherein when said panels are disconnected, the width of said groove is smaller than the width of said plate and said side flange portions are angled toward each other, and wherein when said plate is inserted into said groove portions to put said first and second panel in abutting alignment, said grooves are widened, to permit said plate to be received therein, and said side flanges are displaced outwards to provide face to face mating alignment of said side flanges.

In another aspect of the present invention, there is provided a method of fabricating a 3D construction module comprising: a) providing a vertically upstanding panel oriented generally longitudinally; b) securing first and second mesh layers to said panel such that they are oriented generally transversely and longitudinally, each of said first and second mesh layers comprising at least one rod member mounted to said panel, and said first and second mesh layers being arranged in vertically spaced relation to each other; c) arranging said at least one rod member of said first mesh layer and said at least one rod member of said second mesh layer to form a first horizontally projected retention cell to restrict translation of a bar held in said retention cell between said first and second mesh layers; whereby said first retention cell forms a generally vertically oriented opening for receiving a vertical reinforcement member and said retention cell restricts translation movement longitudinally and transversely of a vertical reinforcement member held in said retention cell.

In another aspect of the present invention, there is provided a stopper member in combination with a connector: said connector having a leg portion adapted to connect to a rod member; said stopper member comprising: a body portion having a first end and a second end, and having a first axial passageway open from said first end and said second end; a second body portion having a third end and a fourth end, said second body portion joined at said third end to said first body portion at said second end of said first body portion, said second body portion having a second axial passageway extending between said third end and said fourth end, that is narrower than said first axial passageway, said second axial passageway being in communication with said first axial passageway from said third end to said second end; said leg portion of said connector receivable into said first axial passageway of first body portion of said stopper at said first end to engage an end of a rod member receivable in said second axial passageway and extending from said fourth end, past said third end and said second end into said first axial cavity; said connector and said stopper member adapted to hold a panel member and thereby connect said rod member to said panel member.

In another aspect of the present invention, there is provided a connector for securing a rod member to a panel, said connector having a leg portion to be received through said panel to engage said rod member, said leg portion having a blind opening to a cavity for receiving said rod member therein to secure said leg portion to said rod.

In another aspect of the present invention, there is provided A method of forming a construction element such as wall comprising: a) prefabricating first and second construction modules, each of said modules comprising a pair of spaced apart panels oriented longitudinally, said pair of panels being interconnected by at least one mesh layer between said panels; b) installing said first and second construction modules in longitudinal alignment; c) installing vertical reinforcement in said first and second construction modules; d) installing horizontal reinforcement in said first and second construction modules; e) filling said first and second construction modules with unhardened concrete.

BRIEF DESCRIPTION OF THE DRAWINGS

In Figures which illustrate by way of example only embodiments of the invention:

FIGS. 7A and 7B are plan views of additional components that can be implemented with the 3D prefabricated construction module of FIG. 5H and FIG. 6A as horizontal reinforcement;

FIG. 7C is a side elevation view of the 3D prefabricated construction module of FIG. 5H and FIG. 6A, implementing the component of FIG. 7A;

FIG. 7D is a plan view of the 3D prefabricated construction module of FIG. 7C;

FIG. 7E is an enlarged end elevation view fragment at 7E—7E in FIG. 7D;

FIG. 200 is a front view of showing the continuation of the process of reinforced concrete wall erection in FIG. 20M, illustrating installation of vertical and afterwards horizontal reinforcement into joined construction modules mounted on the construction modules forming the first part of reinforced concrete wall of FIG. 20M. Modules are connected both longitudinally and vertically to other modules, to build on the wall of FIG. 20M;

DETAILED DESCRIPTION

Figure 1:
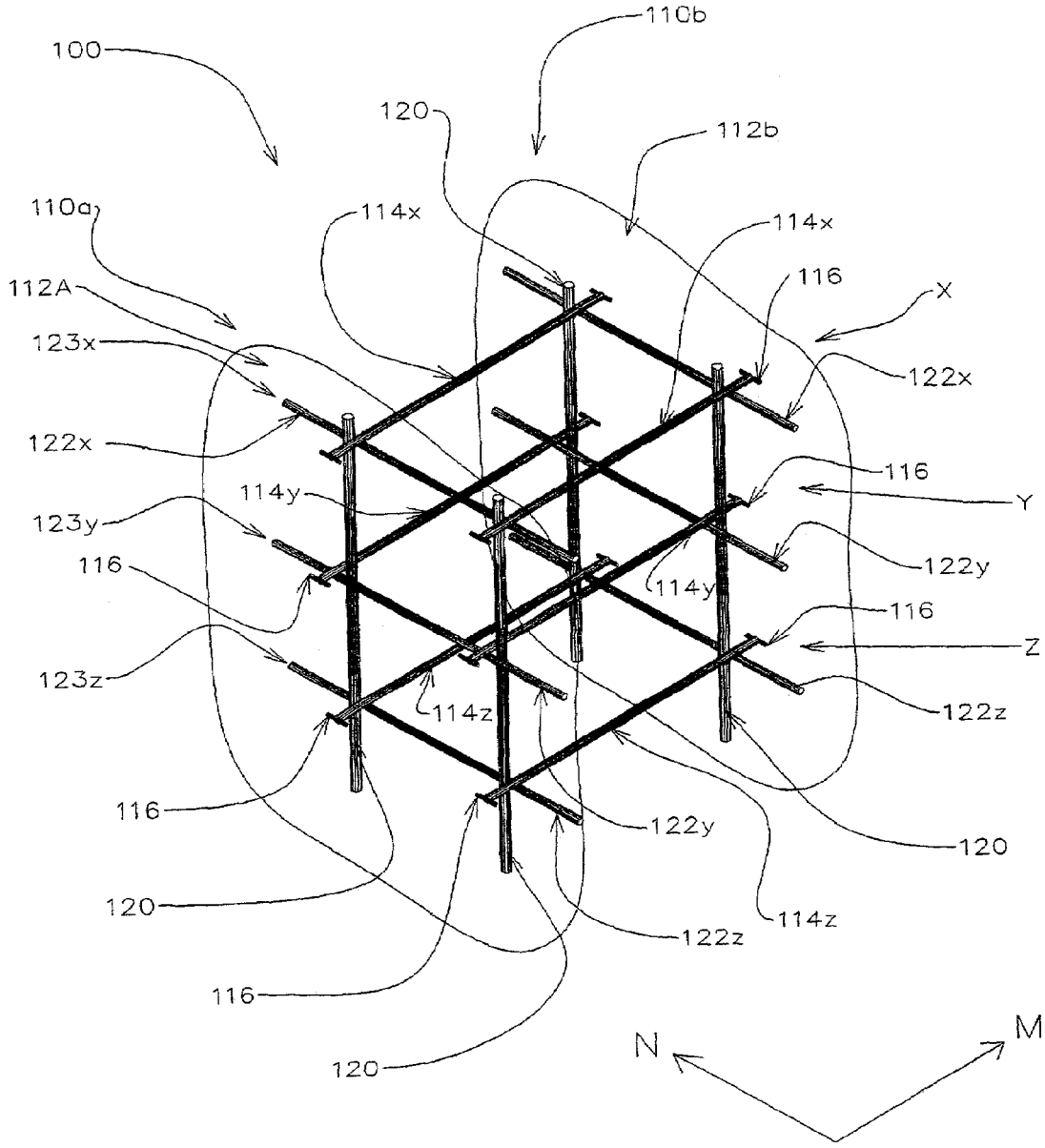
FIG. 1 is a schematic perspective view of an embodiment of the invention.

With reference to FIG. 1, a schematic representation of part of a 3D construction module 100 is shown. Module 100 is preferably pre-fabricated prior to delivery to a construction site or directly on the construction site prior to installation into the design position, and comprises a pair of panels 110*a*, 110*b* (only portions 112*a* and 112*b* being shown in FIG. 1). Panels 110*a*, 110*b* held in spaced apart relation by means of transverse elements in the form of pairs of transverse rod members 114*x*, 114*y* and 114*z* each pair positioned in one of three vertical layers x, y and z.

The transverse rods each have stopper elements 116 mounted perpendicularly to the longitudinal axis of the transverse rods. The transverse rods ends are fixed to the panels 110*a* and 110*b* (although FIG. 1 does not show the attachment mechanism). The end of the transverse rods (referenced collectively as 114) can be attached to the panels 110 as described below, or in other conventional ways.

Stoppers 16 mounted on the transverse rods (shown schematically) can be pressed against the inward surface of each panel or pressed into the body of each panel and abutted with the end of a connector of the attachment mechanism of the transverse rods 114 (connectors are not shown in FIG. 1).

In addition to transverse rods 114*x*, 114*y* and 114*z*, longitudinal rods 122*x*, 122*y* and 122*z* are provided in each mesh layer x, y and z. Rods 114 are rigidly joined to rods 122 at their crossing locations by any conventional method, preferably spot welding. Together longitudinal rods 122 and transverse rods 114 form layers of the transverse and longitudinal elements comprising meshes 123*x*, 123*y*, and 123*z*, each layer being vertically spaced from other layers.

Rods 114 and rods 122 are typically made from any suitable material, such as plastics, composite materials, preferably from steel rods having cross sections with diameters in the range from 2 to 8 mm.

The rods 122 and 114 are arranged to create meshes that take advantage of the basic principle of a three-point force application to be able to resist translations along both the transverse axis M and longitudinal axis N, and rotations about the M and N axes.

Figure 1A:
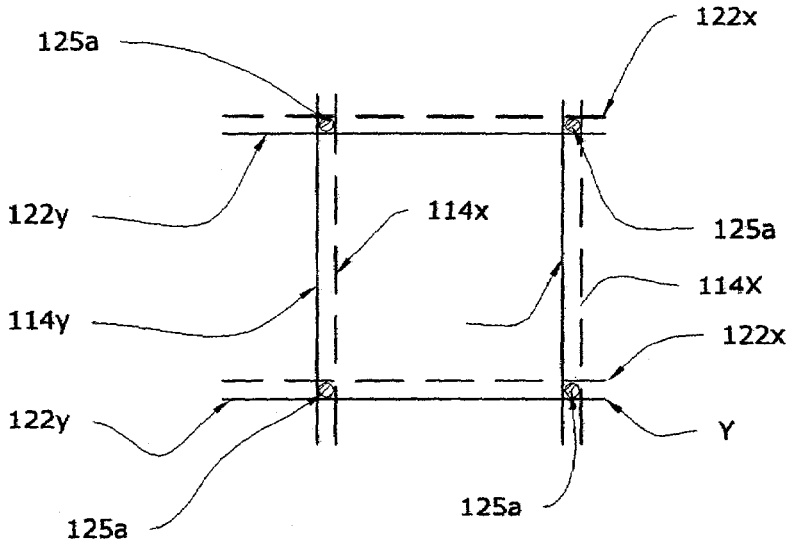
FIG. 1*a* is a horizontal projection of the mesh layers x and y of FIG. 1.

Adjacent horizontal mesh layers 123*x*, 123*y* and 123*z* are installed in such manner, as depicted for example in FIG. 1*a*, so that the crossing of transverse and longitudinal rods of combined adjacent layers (eg. the mesh layers of layers 123*x* and 123*y*) one located above the other, form retaining cells 125. The cells 125 provide a space for the vertical positioning of vertical re-bar members 120. Vertical re-bar members 120 are positioned so as to provide proper reinforcement to the concrete wall or other structural element.

By providing three layers, each pair of adjacent layers (ie. x, y; and y; z) provide for in effect a holding or pinning of each vertical member 120 that resists translation movement in both the N and M directions, as well as rotational movement around the M and N axes.

Although the horizontal projection of transverse and longitudinal members of two adjacent layers (eg. 123*x*, 123*y*) onto a horizontal surface/plane is a rectangle, other geometrical configurations can be employed, such as for instance: a triangle, a trapezium and so on.

Each arrangement of mesh layers, depending on its design specifications, can define the cell for vertical rod positioning from one, two, three and four sides. In FIG. 1A, each mesh layer defines the cell 125*a* only from two sides; the combination of two adjacent layers positioning the rods on the four sides of a rectangle.

Figure 1B:
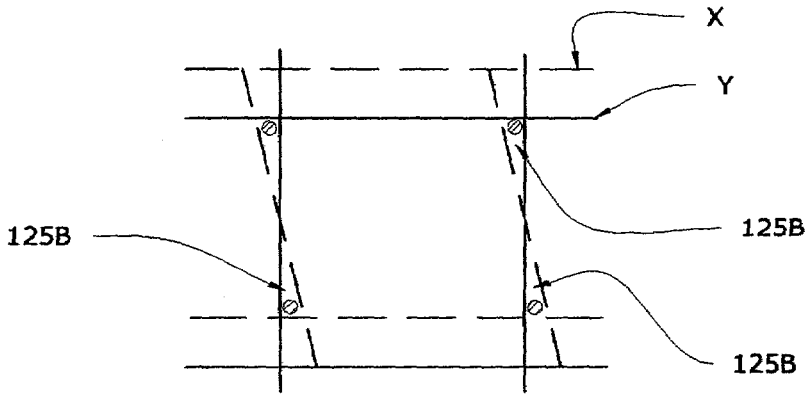
FIG. 1*b* is a horizontal projection of alternate mesh layers x and y, in accordance with another embodiment.

In an embodiment shown in FIG. 1B, the horizontal projection of transverse and longitudinal members of two adjacent mesh layers onto a horizontal surface or plane is a triangle thus creating retention cells 125*b*.

Figure 1C:
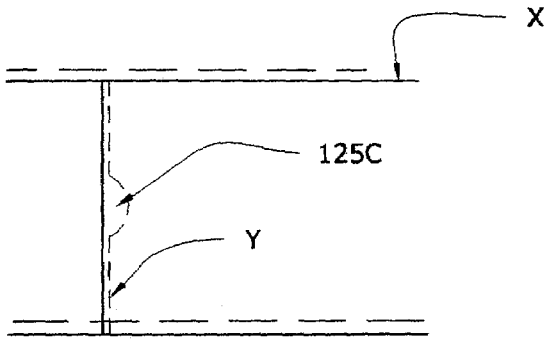
FIG. 1*c* is a horizontal projection of alternate mesh layers x and y, in accordance with another embodiment.

It should be noted that the cells could be created between two adjacent mesh layers using only a single, generally transversely oriented rod if at least one of the rods has portions which have longitudinal extension portions. For example, one of the rods could be a straight rod in one mesh layer X. In the vertically adjacent layer Y, the other could be generally vertically aligned above it, but have a semi-circular portion that creates a cell 125*c* in a horizontal plane projection between the straight rod in the first layer X and the semi circular portion in the second layer Y, as shown in FIG. 1C.

It should be appreciated that the orthogonal reference directions, longitudinal, transverse and vertical are not necessarily orientations relative to flat ground.

With reference now to FIGS. 2A, 2B, 2C, 2D, 2E, a panel 210 that can be used as a component in a 3D prefabricated construction module is illustrated. Panel 210 is perforated with a plurality of openings 211 which are formed in a pre-determined pattern, as detailed hereafter. Preferably the diameter of openings 211 is 8–12 mm (⅓"–½").

Panel 210 is preferably made from expanded or extruded polystyrene with a density of 20–35 kg/m3. Other typical materials from which panel 210 can be made include other expanded plastics, as well as cement bonded particle boards, cement boards, OSB and other materials, the technical characteristics of which allow them to be used as panels to forming monolithic walls or other structural members. Panel 210 will be usually formed of a standard width and height (normally the width is about 4' (1200 mm) and the height is 8' (2400 mm)).

As is evident from FIGS. 2B, 2C, 2D and 2E, vertically extending grooves or channels 213 are formed in side faces 215. Grooves 213 preferably have a depth of about ½"–¾" (12–20 mm). Also, preferably the side faces of end tongues and grooves are deflected from being perpendicular to exterior faces 217 by an angle of between 0–15°.

Figure 2A:
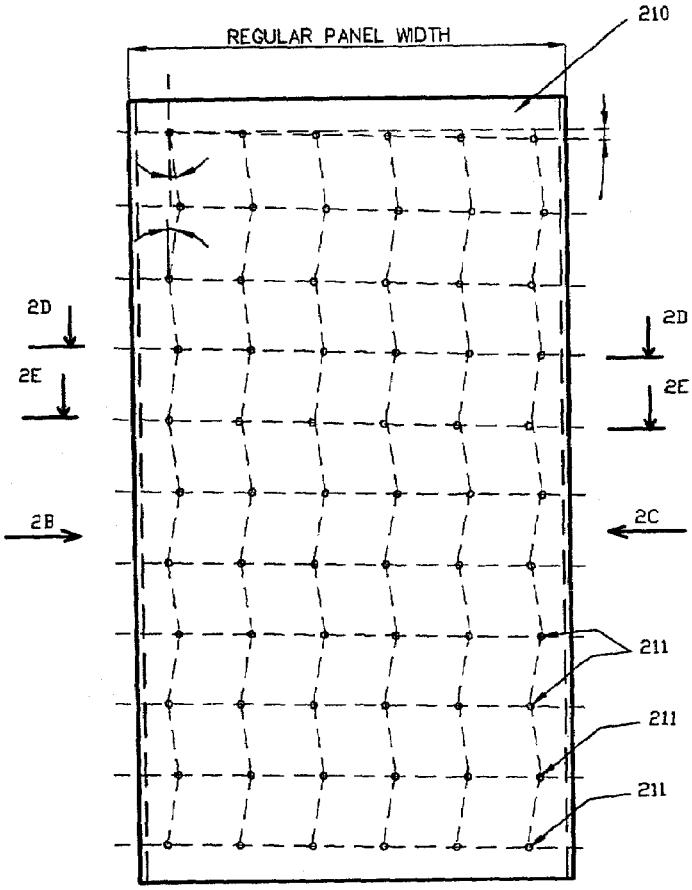
FIG. 2A is a front elevation view of a panel in accordance with another embodiment of the invention.
Figure 2B:
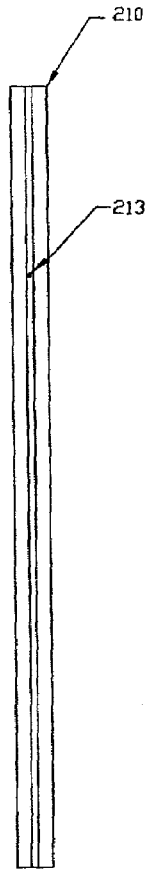
FIGS. 2B and 2C are side elevation views at 2B and 2C respectively, in FIG. 2A.
Figure 2C:
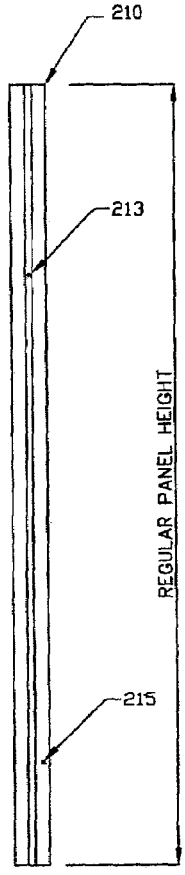
Figure 2D:
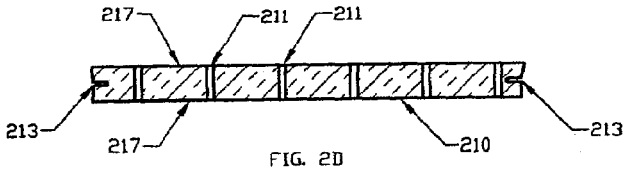
FIGS. 2D and 2E are cross sectional views at 2D—2D and 2E—2E respectively in FIG. 2A.
Figure 2E:
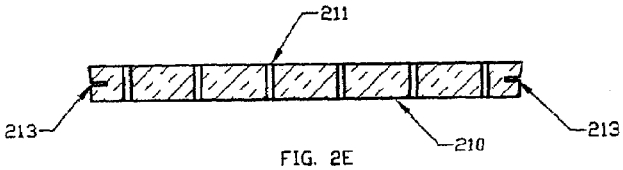

As shown in FIG. 2A, the openings 211 are formed by the crossing locations of the lines formed into parallelograms, which are deflected from the horizontal face to the angle of 0–1°, and from vertical face by an angle of in plus or minus 0–10°. FIGS. 2D and 2E illustrate the panel cross sections on sections through the openings 211. The perforation of the panel 210 o form openings 211 can be performed in numerous known ways and methods such as, for example by drilling, piercing and so on.

Figure 3:
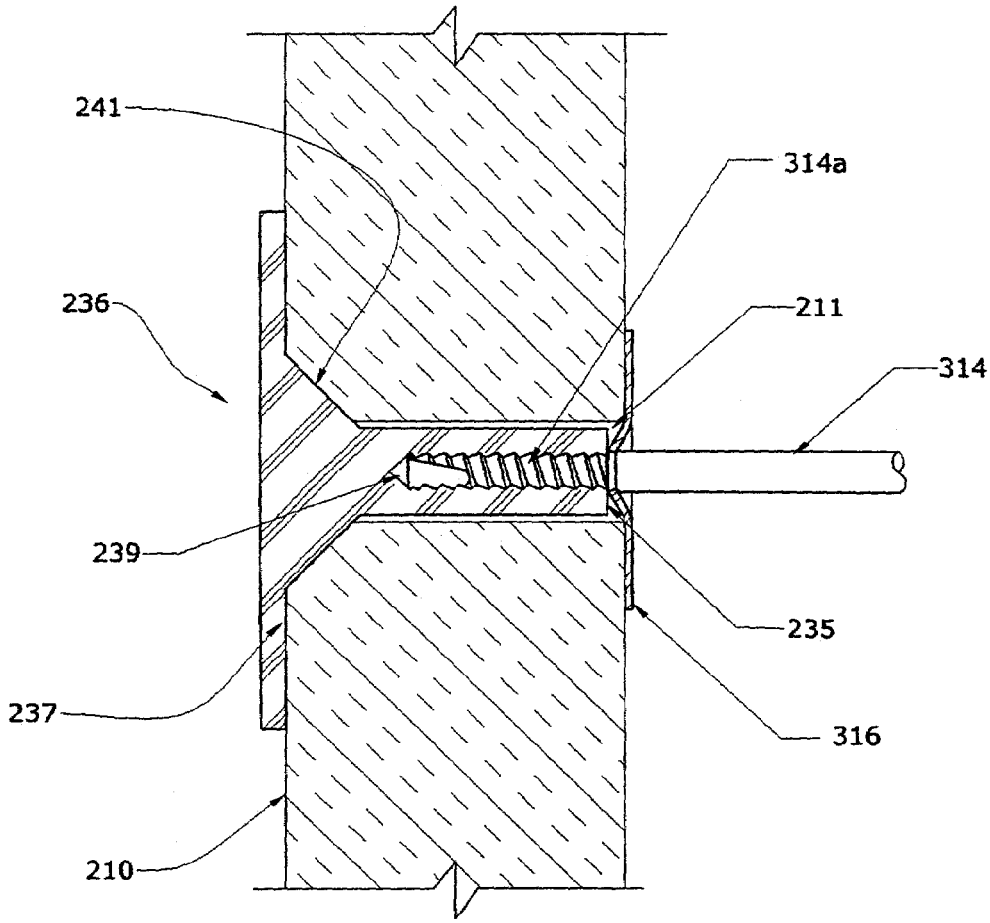
FIG. 3 is a cross section view of a connection between a transverse rod of a 3D prefabricated construction module in and a connector installed into an opening of a perforated panel of FIGS. 2A–2E, in accordance with an embodiment of the invention.

With reference now to FIG. 3, a generally mushroom-shaped connector 236 is illustrated joined with the end portion 314*a* of the transverse rod of the transverse element. Connector 236 is another component that can be used for fabrication of 3D prefabricated module. The end surface of the leg 235 of the connector 236 abuts with a stopper 316 that is joined with transverse rod 314.

Figure 5:
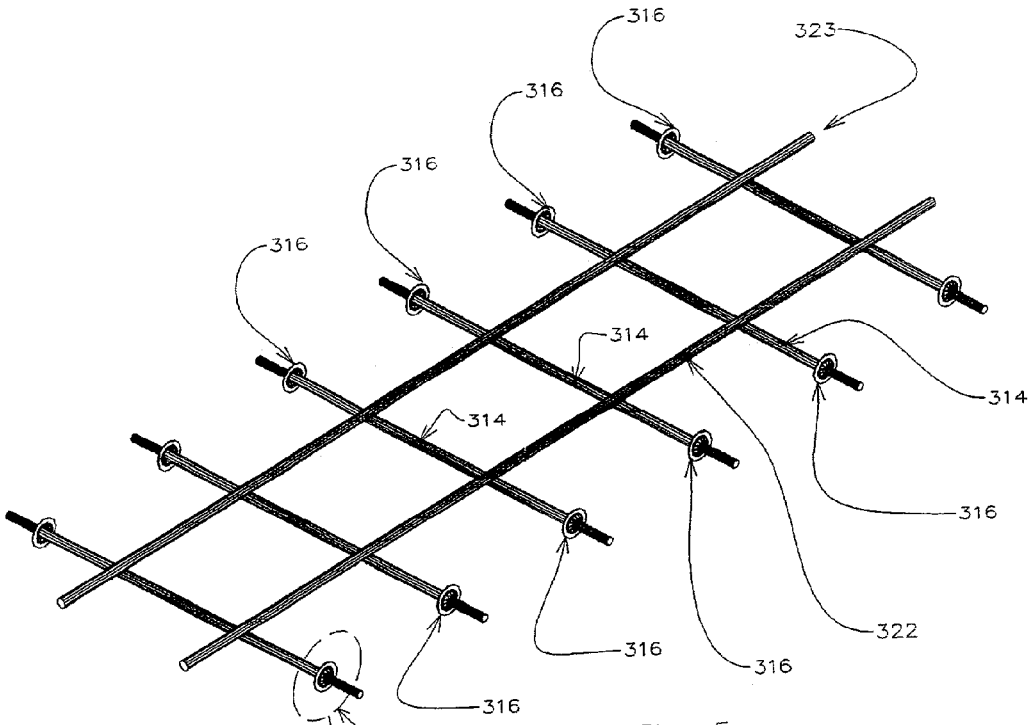
FIG. 5 is a perspective view of a transverse and longitudinal elements of the 3D prefabricated construction module in an embodiment of a mesh layer that can be used in a 3D prefabricated construction module in accordance with the invention.
Figure 5A:
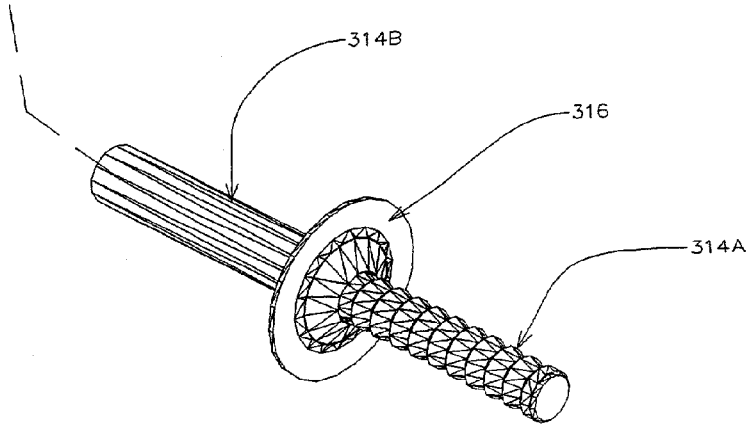
FIG. 5A is an enlarged view of the part of the mesh of FIG. 5, as illustrated at 5A in FIG. 5.
Figure 5B:
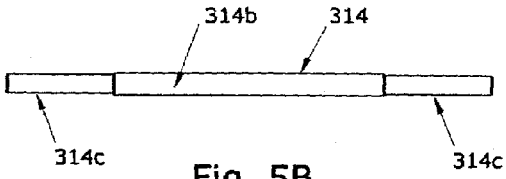
FIG. 5B is a plan view of a detail to produce a transverse component used to make the mesh of FIG. 5.

With reference to FIG. 5B, a rod 314 is shown with extruded ends 314*c* that are preformed on transverse rod 314. A plane connecting ends 314*c* with the middle portion of ends 314*b* serves as a stopper during installation of a stopper like stopper 316 or other similar washer in the shape of a flat push-on washer, flat nut etc. Afterwards, extruded ends 314*c* are formed with the shape of a tap or self-threading tool for thread cutting in plastic nuts (see FIG. 5*c*, 314*a*)— in this case the inner cavity of connector 236. Also, it should be noted, that the plane for abutment of the stopper 316 may be arranged without extruding the end portion 314*c*— in this case the end of rod 314*a* may be preformed in the shape of tap or thread cutting tool for plastic nuts with thread cutting.

Returning to FIG. 3, cap portion 237 of connector 236 preferably presses against the outer surface of the panel 210 providing pressure transfer between the panels and transverse rods 314. This pressure is exerted on the each panel by the hydrostatic forces from poured concrete to provide a connection mechanism between each connector 236 and transverse rod 314. In general, connector 236 is a "blind" cavity self-threaded nut and is aggregated with a washer of a larger diameter than leg 235.

Figure 3A:
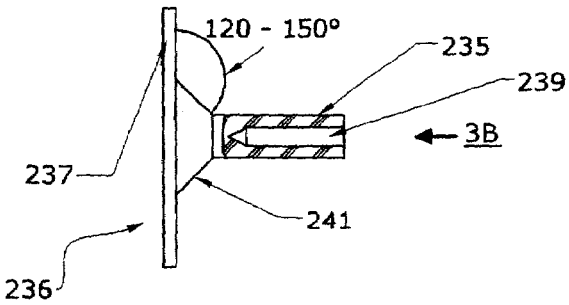
FIG. 3A is a side view of a connector, partially cut away in section to show a blind cavity in accordance with an embodiment of the invention.

With reference now to FIG. 3A, a mushroom-shaped connector 236, is illustrated partly cut-away. Connector 236 is also preferably used in the 3D prefabricated construction module of the present invention. The connector 236 is preferably made from any plastics or suitable composite material, and which can provide for a strong threaded connection with the transverse rod of the construction module that can withstand a tensile load of 120–250 kg.

Connector 236 is made most preferably from glass fiber reinforced polypropylene. Cap portion 237 of the mushroom-shaped connector preferably has a diameter of 45–70 mm and thickness 2–4 mm. Connector 236 will have rotational features (typically on the face of the cap portion 237) that permit the connector to be rotated co-axially with its leg 235 about a longitudinal axis of the leg. Such features can for example permit a mechanical tool such as a socket driver or a drill with a nozzle to be used to rotate the connector 236.

A cylinder portion of the leg 235 preferably has a diameter 8–12 mm and length 30–40 mm. As well there is a "blind" cavity or opening 239 in the form of cylinder in the leg preferably with a depth in the order of 30–40 mm. The inner diameter of the "blind" cavity is preferably from 2.8 to 8 mm, which is 70–85% of the diameter of the end shape of the tap or self-threading tool for plastic nuts, of the connecting transverse rod (not shown in FIG. 3A or 3B). The "blind" cavity 239 acts as a nut for joining the end of the transverse rod 114 of the mesh layer 123.

Part of the leg 235 of connector 236 is in the form of a truncated cone 241 has an angle of the line of deflection forming the cone to the base of the cone of preferably about 30–60°. Preferably the height is in the range of 10–20 mm.

The cone portion 241 is intended for deformation of the walls in the openings 211 of the perforated polystyrene panel and for the plugging of those openings during fabrication of the construction module. The cone portions 241 of connectors 236 on two adjacent panels can also be employed to connect two panels with bracers by providing a "wedge" effect that draws the two adjacent panels together. This latter feature is explained further hereafter The connection of two panels 210 by rotation of mushroom-shaped connectors 236 linked by a bracer 480 (see FIG. 8), is assisted by the formation of an indentation on the outer surface of the leg 235 in the shape of a helical spiral. The spiral indentation on the outer surface matches the helical indentation step on the inner wall of the "blind" cavity 239 of the connector, which is formed by the tapping action of the end of the transverse rod in the blind cavity while connecting the connector and transverse rod.

Figure 3B:
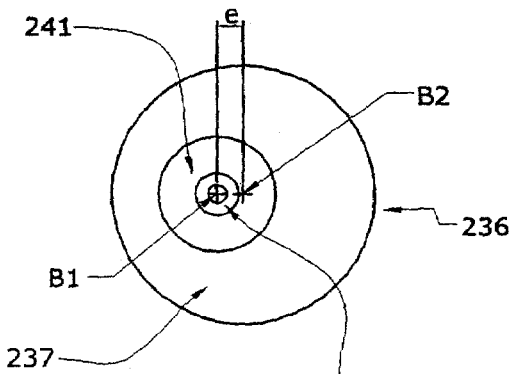
FIG. 3B is an end view of the connector of FIG. 3A.

With particular reference to FIG. 3B, mushroom-shaped connector 236 has its cap portion 237 in the shape of a cylinder with a longitudinal axis B2, formed with eccentricity relative to axis B1 of the shaft portion 241, and leg portion 235. It should be noted that the shape of shaft portion 241, and leg portion 235, are made by the consecutive connection of two figures of rotation: a hollow cylinder and a truncated cone.

The effect provided with such a connection and arrangement, is that when connector 236 is used for connecting with the horizontal meshes of the 3D prefabricated construction module, and which resists the hydrostatic pressure exerted on the panels caused by unhardened concrete, it enhances the strength of the connection between the connector 236 and the transverse rod 114.

The axis of the cap B2 is displaced from the leg's axis B1 by the small value "e". In the preferred embodiment for cap portion 237 having outer diameter approximately 54 mm, distance "e" would be approximately one millimeter.

To elaborate further, the effect of providing the center-lined axial displacement is the following. Loading received by the cap 237 from unhardened concrete hydraulic pressure is not aligned or centered with axis of the central line B1, but is mainly aligned with axis B2. This created a moment or torsion between the cap portion 237 and the leg portion 235. This torsion is passed from the leg 235 to the end of the transverse rod 114. It results in more tightening between the leg 235 and the end of the transverse rod 114. Accordingly, the advantages are in the fact, that compared with the physical specifications required of a connector where there is no eccentric displacement, in a connector having axis displacement, the thread size can be lessened and the thickness of the leg portion 235 can be lessened, while providing the same bearing capacity.

As mentioned above, it is quite typical for panels used in the 3D prefabricated construction modules to be made of foamed polystyrene or similar foamed plastic materials or other non-flammable materials. In fact, such materials are non-flammable themselves, but some of the raw materials comprising such panels are flammable, although relatively difficult to ignite unless brought into direct contact with a source of fire or flame. Thus it is desirable to keep such material away from contact with the fire source. Foamed polystyrene panels consist of 95–98% air and 2–5% polystyrene. During a fire, when the air temperature in the vicinity of a structural element such as a wall reaches 250° C., polystyrene associated with the wall often becomes a melt. This liquid polystyrene melt leaks down the concrete wall surface, and upon reaching the fire source, ignites and increases the heat load on the concrete surfaces such as the surface of a reinforced concrete wall. This will of course decrease the fire resistance of the wall and be detrimental to its structural integrity.

Figure 4A:
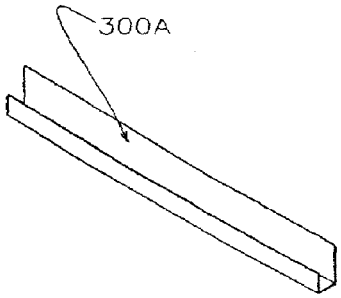
FIGS. 4A–4C are perspective views of three trough members that can be utilized in embodiments of the invention.
Figure 4B:
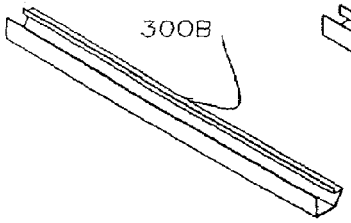
Figure 4C:
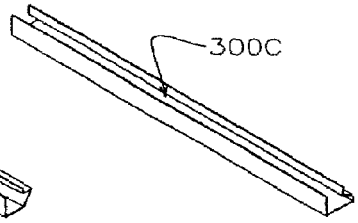

With reference to FIGS. 4A–4C, three examples of trough elements 300A, 300B and 300C that can be used with the panels (like panels 210 in FIG. 2A) of the 3D prefabricated constructions modules of the invention, are illustrated. Each trough element 300A–C can be employed with panels, such as for example panels 210 illustrated in FIG. 2A, so that when the panel is subjected to melting, the melted polystyrene or other plastic material can be captured in the reservoir of the trough. Troughs 300A–300C would be made from a suitable fire resistant material like tin, galvanized steel or hydrophobic cardboard (only for use in the building with concrete floors) and in use would have their ends blocked so as to trap the melt therein. The ends of the reservoir would typically be blocked by the same material as used for trough.

The size of the trough and its reservoir is chosen to be able to hold the necessary volume of melt. By way of example, for a trough holding a polystyrene panel, a trough reservoir with a volume of polystyrene equal to 2–5% of the total volume of the panel would be suitable. Typically, the height of trough wall facing the fire source is from 2 to 5% of the total height of floor concrete wall.

As a result of the use of troughs 300A–300C, melted polystyrene will not reach the fire source, which would increase the heat temperature and impact duration on the reinforced concrete wall.

Figure 4D:
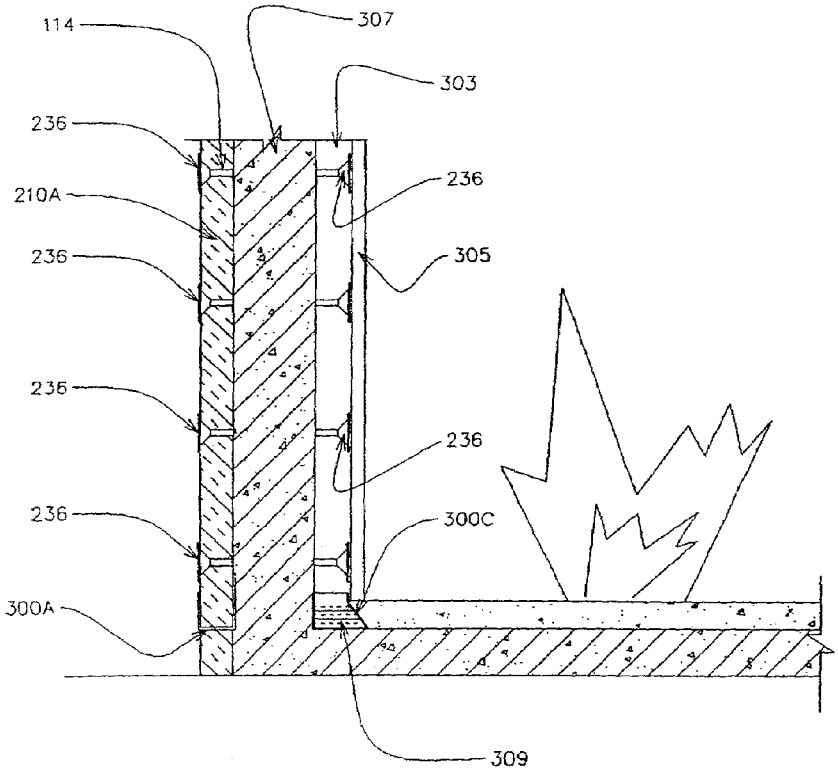
FIG. 4D is a side cross sectional view of a part of a wall and floor system utilizing the trough member of FIG. 4C.

The use of a trough 300C is shown in FIG. 4D. When air temperature reaches up to 150°, foamed polystyrene of the construction module panels begins to reduce its volume (shrinking). As shown, an air gap 303 is provided between the drywall panel or cement sheet 305 and reinforced concrete wall 307, which would prevent the reinforced concrete wall 307 from heating from the fire to the same extent as would otherwise be the case if the fire moved directly to the wall. As shown, melt 309 is captured in the reservoir of trough element 300C.

Trough elements 300A–C can be mounted on a perforated polystyrene panel like panel 210, during prefabrication of the construction module in the manufacturing plant environment. However, they can also be delivered on the construction site and for example, fixed to the footing of underlying flooring; and then the panel can placed into the trough element thereby framing the lower end of the panel, when making the 3D prefabricated construction module used in construction of a wall.

With reference now to FIGS. 5, 5A–5F, a transverse element of the 3D prefabricated construction module in a form of horizontal mesh layer 323 is illustrated. Transverse rods 314 of the mesh are preferably made from smooth round rod (sometimes from stainless steel, but preferably from galvanized black steel or zinc-coated black steel) and are connected to longitudinal bars 322 made from steel wire by conventional methods including preferably spot welding. Preferably meshes are galvanized or zinc-coated after spot welding. FIG. 5B illustrates a blank used for making a member 314, and has an extruded end portion 314*c* at each end. The ends are extruded prior to forming the end portions in the shape of a tap or a self-threaded tool for plastic nut (as shown as 314*a* in FIG. 5C). It is intended that the outer diameter of the tap end portion will preferably be 85–115% of the outer diameter of the medial portion of the rod 314*b*; furthermore preferably the rod 314*b* diameter is in the range of 4.0–7.0 mm and the extruded end portion 314*a* has a diameter in the range of 3.4–6.0 mm.

As shown in detail in FIG. 5A, a stopper element 316 is provided on the end portion 314*a* and the stopper 316 abuts against the outward facing edge of medial portion 314*b*. Thus stopper element 416 can act as a stopper for the mushroom-shaped connector during fabrication of the 3D prefabricated construction module. Thus, when a connector 236 is tightened on a transverse rod like rod 314, it can be tightened until it abuts into the stopper 316. A portion of a panel like panel 210 is then held between stopper 316 and a connector 326. The leg of connector 236 abuts into stopper 316.

Figure 5D:
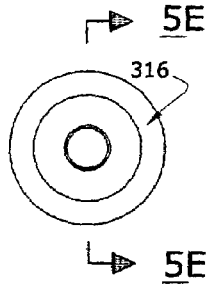
FIG. 5D is a plan view of a stopper component, part of the mesh of FIG. 5.
Figure 5E:
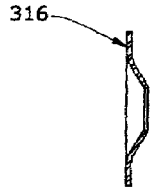
FIG. 5E is a cross sectional view at 5E—5E in FIG. 5D.
Figure 5C:
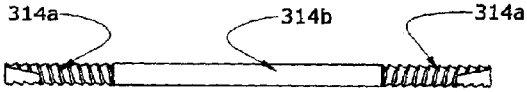
FIG. 5C is a plan view of the component made from the detail of FIG. 5B, having been modified for use in the mesh of FIG. 5.

Stoppers 316 are preferably constructed in the form of push-nuts as illustrated in FIGS. 5A, 5D, 5E and are mounted on the end portions of the transverse rods. Also, other similar devices such as push-lock washers, flat washers and so on, can be used as stoppers. Once mounted on end portion 314*a* and put into abutment with medial portion 314*b*, the movement of stopper 316 in both transverse directions is resisted (i.e. stopper 316 is transversely fixed on rod 314).

Figure 5F:
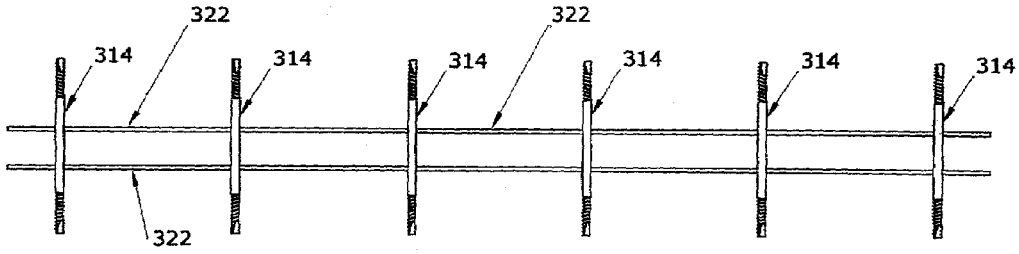
FIG. 5F is a plan view of the mesh of FIG. 5, shown without stopper components.
Figure 5G:
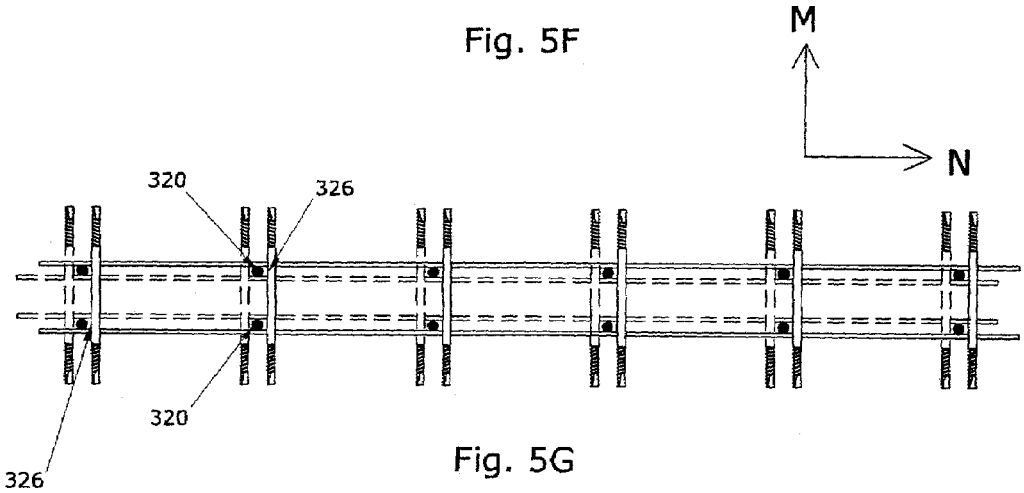
FIG. 5G is a plan view showing a first mesh as depicted in FIG. 5F and a second mesh, similar to the mesh of FIG. 5F (shown in broken lines in FIG. 5G) that can be utilized together in a 3D prefabricated construction module in accordance with an embodiment of the invention. Also, cells formed by these meshes are shown with installed vertical rebar.
Figure 5H:
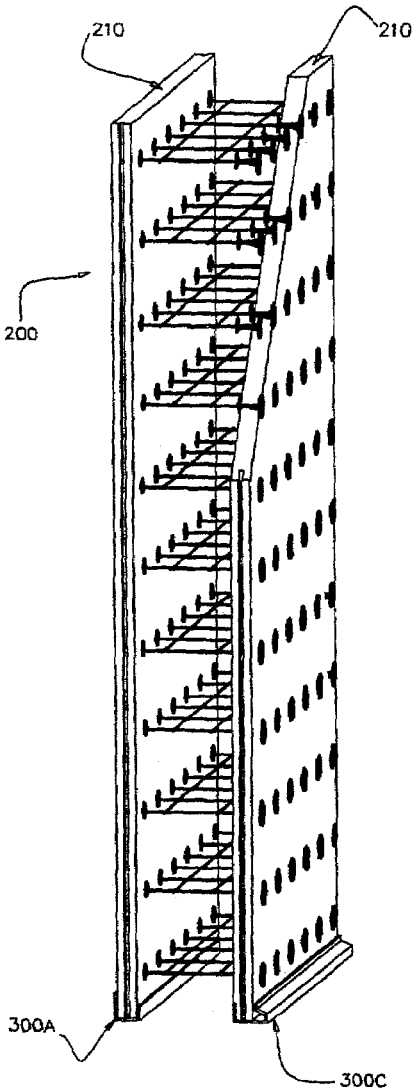
FIG. 5H is a perspective view, partially broken away, of a 3D prefabricated construction module with transverse and longitudinal elements in a form of mesh shown in FIGS. 5, 5F, 5G in accordance with an embodiment of the invention. Also this module employs components shown in FIGS. 2A, 3A, 3B, 4A, 4B, 4C, 5D, 5E.

The stoppers are used during the fabrication of the 3D prefabricated construction module shown on FIG. 5H. The stoppers are required for controlling the installation accuracy of the horizontal meshes and the position of the perforated panels relative to each other, and consequently the accuracy of the compliance with the specified design of the reinforced concrete wall or other structural element.

As shown in detail in FIGS. 5D and 5E, stoppers 316 are formed in the shape of round type push nut fasteners preferably with outer diameter 15–30 mm and inner diameter equal to diameter of the extruded end of the transverse rod. Preferably the thickness is about 0.5 mm. The stopper is pushed or screwed on the extruded end portion 314*a* of the transverse rod with rolled profile in the form of a tap or self-thread tool for plastic nut until abutment with non-extruded portion 314*b* of the transverse rod in accordance with FIG. 5A.

FIGS. 5F and 5G show in plan view how meshes of two similar configurations and different intervals between longitudinal rods 322 can be used in two adjacent mesh layers (as in layers x, y or y, z in FIG. 1) to co-operate to provide retention cells 326 for holding vertical reinforcement members 320. By providing three such mesh layers, the vertical reinforcement members can be held from both translation movement in M and N directions as well as against rotational movement around M or N axes.

Figure 5I:
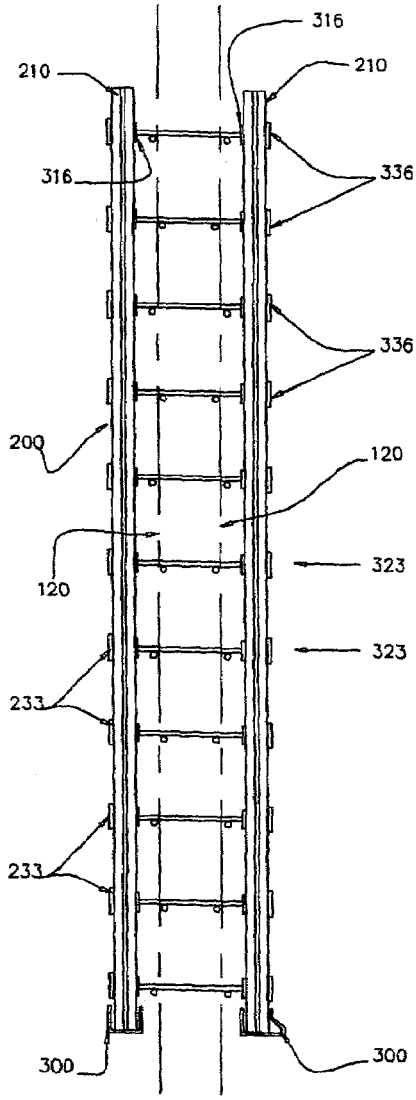
FIG. 5I is a side elevation view of the 3D prefabricated construction module of FIG. 5H. In broken lines, an axis of cells formed by transverse and longitudinal elements in the form of a mesh layer for installation of the vertical rebar is shown.
Figure 5J:
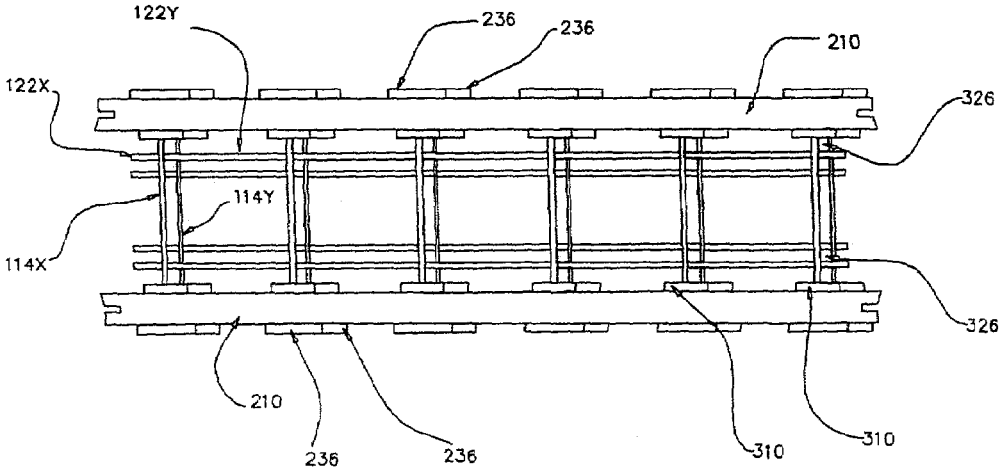
FIG. 5J is a top plan view of the 3D prefabricated construction module of FIG. 5H.

With reference to FIGS. 5H, 5I and 5J, a 3D prefabricated construction module 200 is illustrated with the components described above. These components include panels 210, transverse and longitudinal elements in the form of mesh layers 323, each pair of adjacent 323 layers having transverse and longitudinal members arranged for co-operatively holding and positioning vertical reinforcement members (shown in broken lines 120) as shown in FIG. 5G. The components also include trough elements 300A and 300C, and stoppers 316 for the ends of the transverse rods in each of the mesh layers 323. It should be noted that connectors 326 and stoppers 316 are enlarged in FIG. 5J for clarity.

Figure 6A:
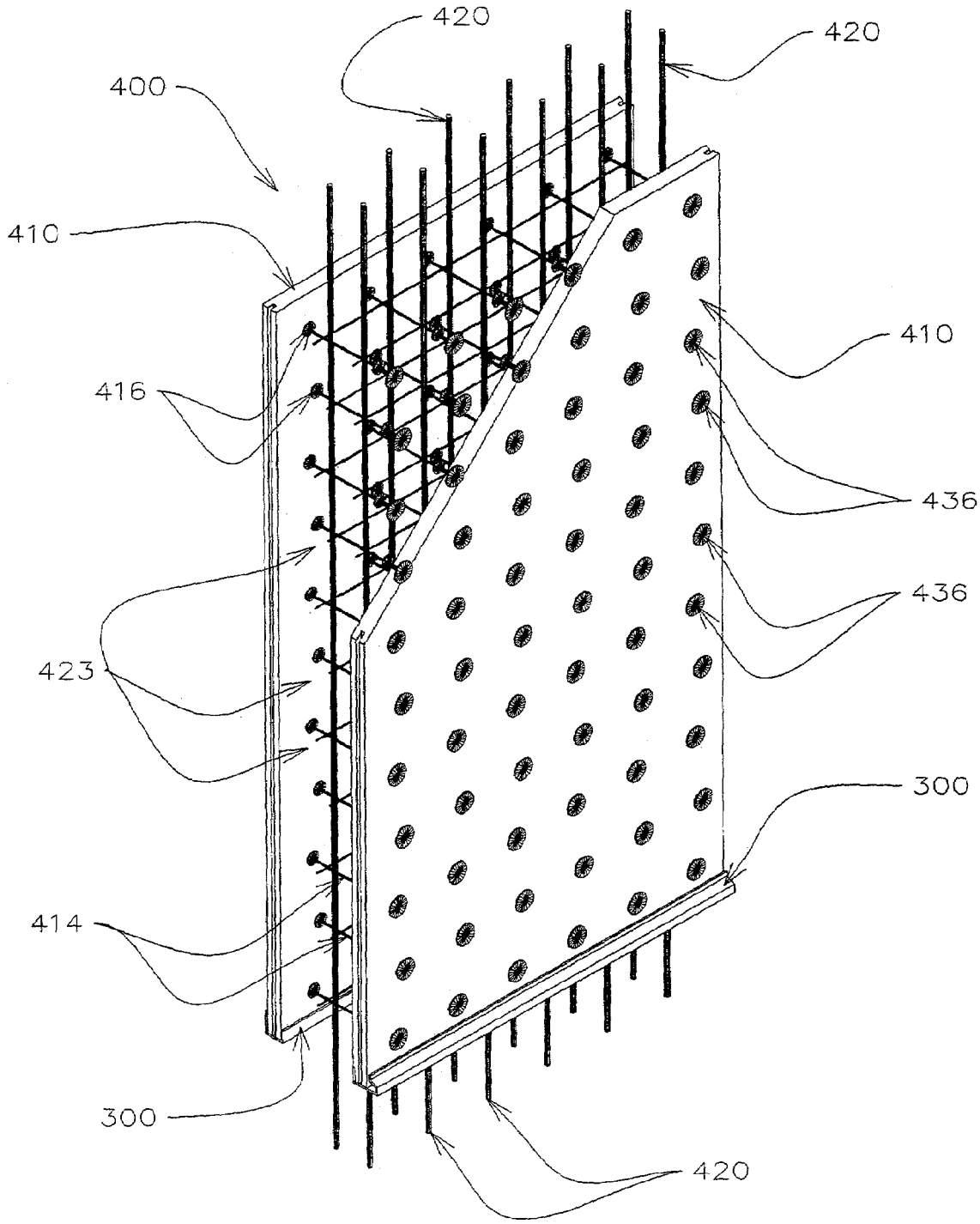
FIG. 6A is a perspective view of the 3D prefabricated construction module of FIG. 5H, with vertical reinforcement bars shown installed in cells formed by transverse and longitudinal elements.
Figures 6B, 6C, 6D, 6E:
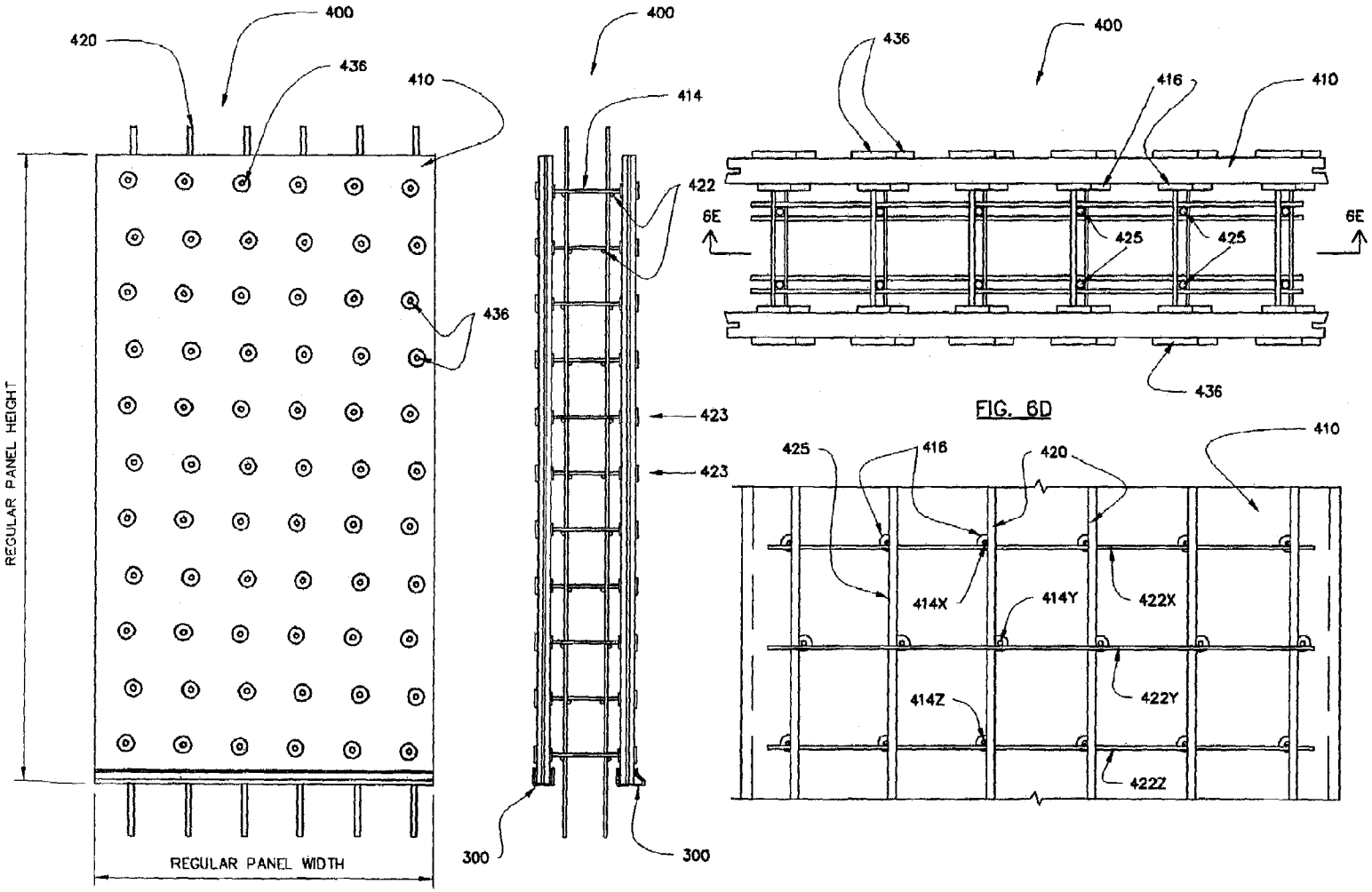
FIG. 6B is a front elevation view of the 3D prefabricated construction module of FIG. 6A.
FIG. 6C is a side elevation view of the 3D prefabricated construction module of FIG. 6A.
FIG. 6D is top plan view of the 3D prefabricated construction module of FIG. 6A.
FIG. 6E is a cross section view of a fragment of the module of FIG. 6A.

With reference to FIGS. 6A–6E the 3D prefabricated construction module 200 of FIGS. 5H–5J is shown modified with vertical reinforcement members 120 installed. In FIGS. 6A–6E, a module 400 has panel members 410 separated by mesh layers 423. Mesh layers 423 comprise transverse rods 414 fixedly secured to panels with stoppers 416 and connectors 436. Longitudinal rods 422 combine with rods 414 to create retention cells 425 for supporting vertical reinforcement members 420. Mushroom-shaped connectors 436 in accordance with FIG. 3B have been installed in panel openings in accordance with FIG. 2A. FIG. 6E illustrates how retention cells 425 formed with rods 414*x*, 414*y* and 422*x*, 422*y*, between layers 423*x*, 423*y* and with rods 414*y*, 414*z* and 422*y*, 422*z*, between layers 423*y*, 423*z* co-operate to hold rods 420, generally as described above. The mushroom-shaped connectors 436 are installed with row displacement. In the center of each mushroom-shaped connector 436, an opening is shown in FIG. 6B which provides a feature to permit rotation of the mushroom-shaped connector by means of electrical screw driver, electrical drill or the like.

With reference to FIGS. 7A–7E, other modifications of the 3D prefabricated construction module 400 of FIGS. 6A, 6B, 6C, 6D, 6E are illustrated. Module 500 is constructed much the same as module 400, using rods 514 and 522 to provide mesh layers that are connected with stoppers 516 and connectors 536 to panels 510. In these embodiments, module 400 is modified to provide a module 500 which is the same as 3D prefabricated construction module 400 but which additionally employs horizontal reinforcement meshes 560 or 562. In FIG. 7A, a mesh 560 is shown consisting of two rods 564 of horizontal reinforcement material. Preferably the reinforcement rods are made of steel and have a diameter of about 5–12 mm, with a length of usually about 1500–1800 mm or 2700–3000 mm.

In order to modify 3D prefabricated construction module 400 to module 500, the vertical reinforcement rods 120 are installed as shown in FIGS. 6A, 6B, 6C, 6D, 6E.

Afterwards, each layer is provided with meshes 560 or 562 shown in FIGS. 7A and 7B. The meshes 560 or 562 should be placed transversely into the space between closest vertical rods 120 of the construction module 500. The meshes are preferably installed at an angle to the longitudinal and transverse plane or mesh layers 523.

It is to be noted that once installed in the right position, gravity acting of mesh 560 or 562 will tend to push rods 564 outwardly against the sides of vertical members 120, which are themselves retained by the mesh layers 523 comprising longitudinal rods 122 and transverse rods 114. The pressure resulting from gravity acting on rods 564 and 566 of reinforcement meshes of the horizontal reinforcement results in forces being applied onto vertical reinforcement rods 120 (as shown with arrows in FIG. 7E). As a result, the vertical rods 120 occupy the most possible extreme outward position vertically which ensures the maximum bearing capacity of the erected reinforced concrete wall with 3D prefabricated construction module 500. With this, the required interval from surface of vertical rods 120 to the nearest surface of the erected reinforced concrete wall is provided.

Each mesh 560 is used for horizontal reinforcing of said 3D prefabricated construction modules 500, where the horizontal mesh layers (rods 114 and 122) are preferably inclined to the horizon (ie. from the horizontal plane parallel to the top and bottom faces of panels 510) in the range of 0.6–1.0°. This is required for providing the "continuous" reinforcement of the reinforced concrete wall with horizontal longitudinal rods overlapping of meshes 560. While utilizing these meshes 560, the reinforcement rods 564 will overlap as the end portions 565 have rod ends placed one above the other. The rods of these meshes preferably should extend longer than the front face of the panels 510 by an amount of 30–60 rods diameters when meshes 560 are installed.

Because of the longitudinal sloping of mesh layers 523 of in the range of 0.6 to 1.0°, the end portions 565 can extend from the both side of the panels of the 3D prefabricated construction module, when they are installed. The mesh can also be implemented in whole or part without extended ends.

In FIG. 7B, an alternate reinforcement mesh 562 is shown which is intended for reinforcing of a 3D prefabricated construction module 500, where the horizontal mesh layers 523 are arranged horizontally or deflected from horizon for not more than 0.6°. While horizontal reinforcing of said 3D prefabricated construction modules, the ends with length preferably in the range of 30–60 diameters of the reinforcement rod of such reinforcement mesh will be arranged between the straight ends of the preceding reinforcement mesh. Thus the angled portion 563 permits the overlap of a reinforcement mesh 562 of one module, with the adjacent mesh 562 of a second abutting module. This mesh can extend from one side and from the both mesh sides.

Figure 8B:
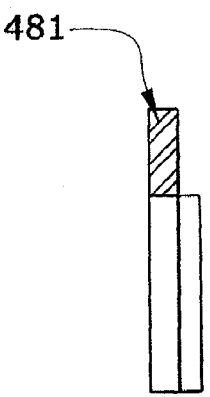
FIG. 8B is a cross section view at 8B—8B in FIG. 8A.
Figure 8A:
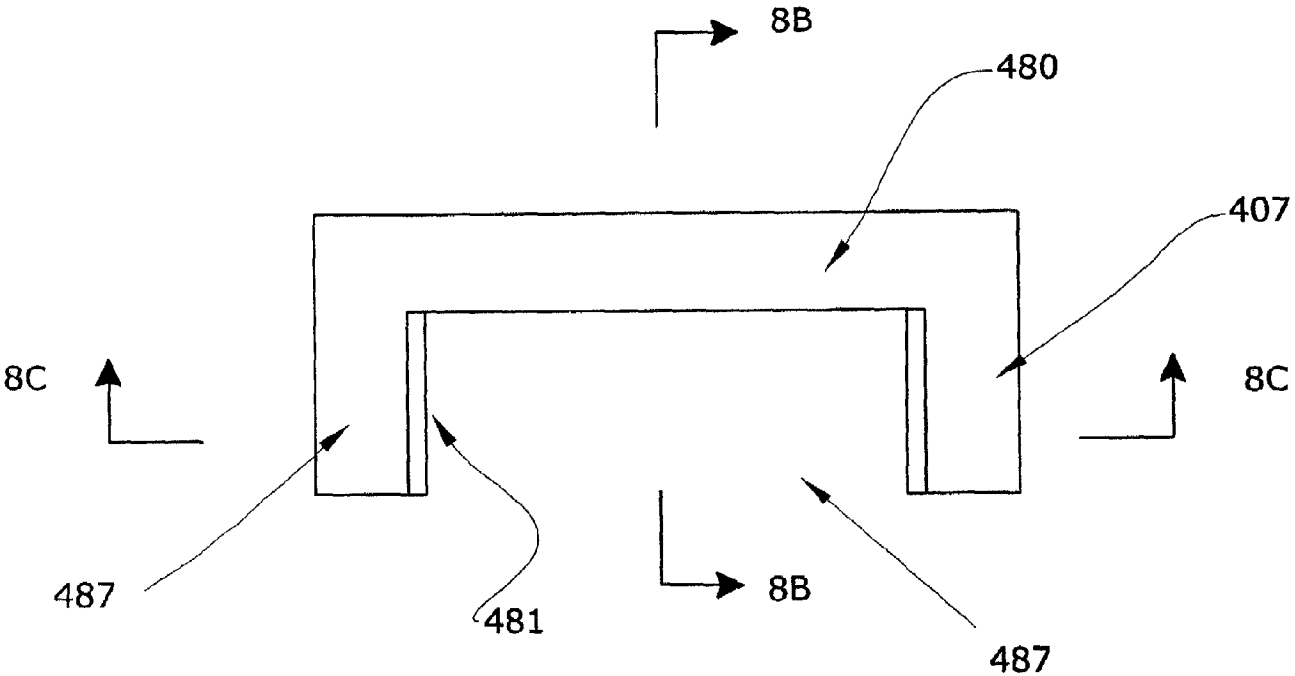
FIG. 8A is a front view of a bracer used in joining 3D prefabricated construction modules.
Figure 8C:
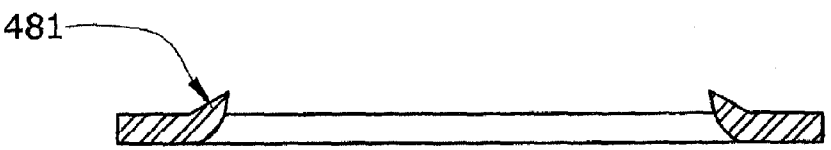
FIG. 8C is a cross section view at 8C—8C in FIG. 8A.

With reference to FIGS. 8A–8C a plate-type panel bracer is shown for use in joining two adjacent mushroom-shaped connectors 326 of two adjacent 3D prefabricated construction modules such as for example 3D prefabricated modules 200 in FIGS. 5H–5J. Connectors 236 are connected with each other during erection of, for example, a reinforced concrete wall.

Generally C-shaped bracer 480 has a cavity 483 formed by a body 485 with two legs 487. On the inner side of legs 487 is a blade element 481, which provides tapping tool to form the helical indentation on the cone-shaped surfaces of the mushroom-shaped connector as described above. Thus, with clockwise rotation of connector 236, the blade 481 will circumscribe the helical indentation on the cone portion 241 (See FIGS. 3A and 3B), which prevents sliding of the plate-type metal panel bracer 480 during the joining two 3D prefabricated construction modules, as well as preventing polystyrene deformation caused by mushroom-shaped connector. If another type steel bracers is used, there is a risk that without having a cutting edge, upon reaching cone effect, the steel bracer permits sliding due to low sliding coefficient on the cone part of the connector (which is made from plastic, preferably from polypropylene reinforced by fiberglass). The result can be that the sliding of the connector on the bracer will cause deformation of the polystyrene body of the panel.

Figure 9:
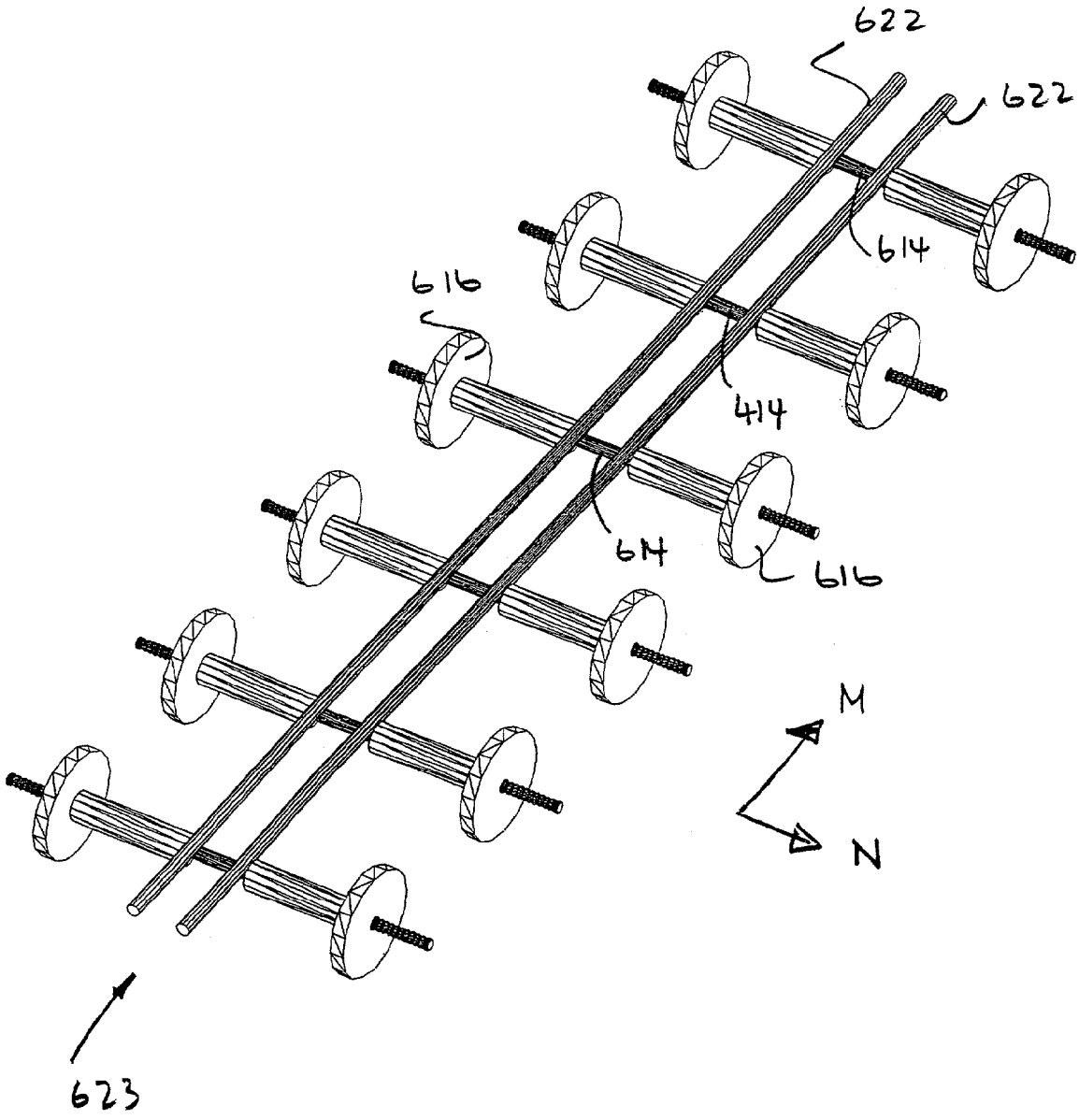
FIG. 9 is a perspective view of an alternate transverse and longitudinal elements of the 3D prefabricated construction module, attached to the part of a perforated panel, of an embodiment of another mesh that can be used in a 3D prefabricated construction module.
Figure 9A:
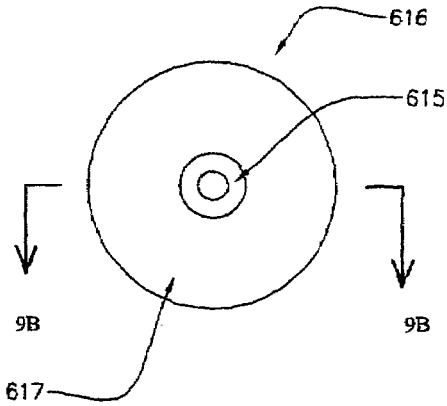
FIG. 9A is a plan view of part of the module of FIG. 9.
Figure 9B:
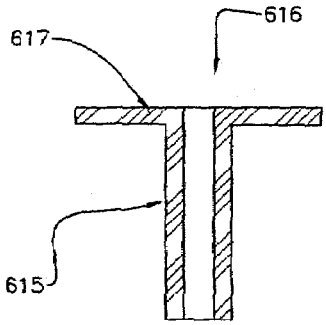
FIG. 9B is a cross section view at 9B—9B in FIG. 9A.
Figure 9C:
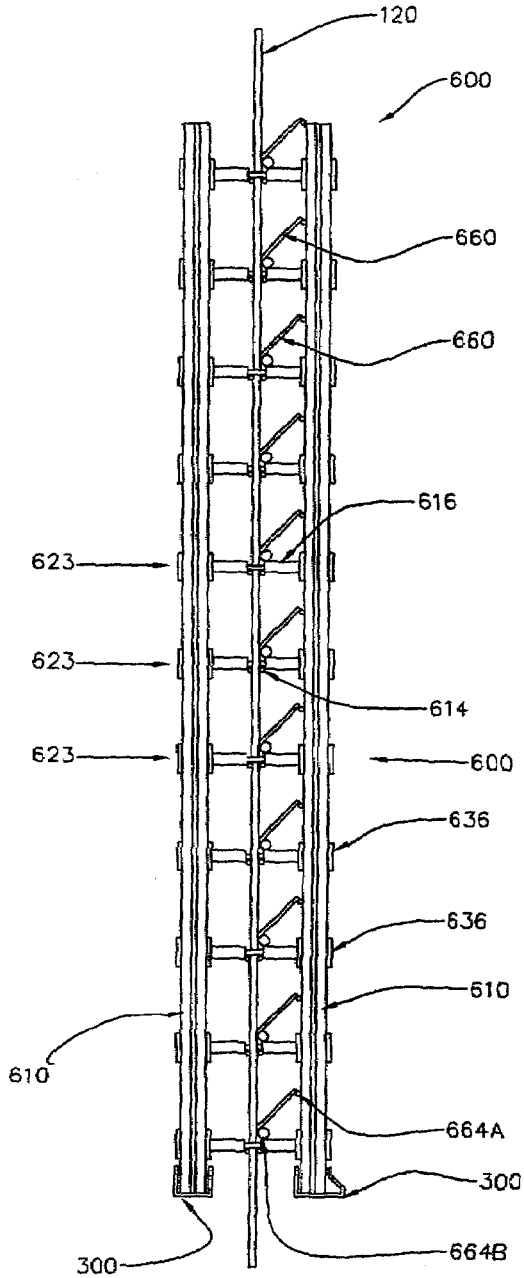
FIG. 9C is a side elevation view of a 3D prefabricated construction module employing the component of FIGS. 2A, 3A, 3B, 4A, 4B, 4C, 7A, 7B, 9, 9A and 9B, and vertical reinforcement installed into the cells formed by transverse and longitudinal elements.
Figure 9D:
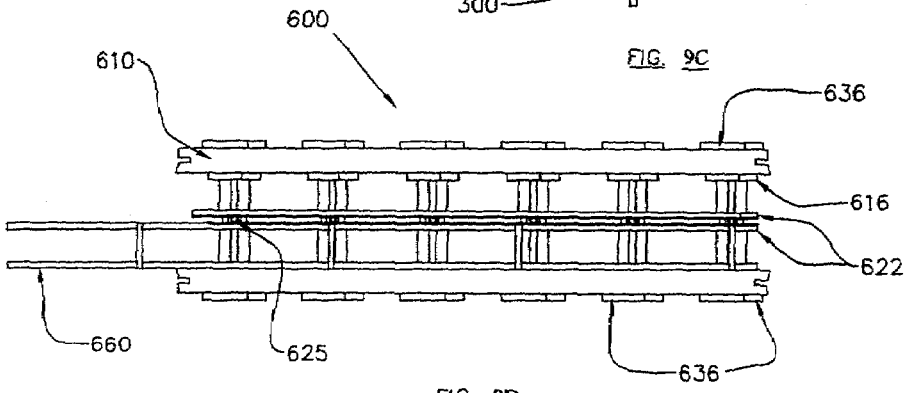
FIG. 9D is a plan view of the 3D prefabricated construction module of FIG. 9C.

With reference to FIGS. 9–9D another embodiment of the 3D prefabricated construction module is illustrated. 3D prefabricated module 600 is like the previous modules including having panels 610, trough elements 300, connectors 636, a plurality of longitudinally spaced vertical reinforcement members 120 retained by horizontal mesh layers 623, similar to the mesh layers in FIG. 5. However mesh layers 623 are formed from transverse rods 614 and a pair of spaced longitudinal rods 622 to form retention cells 625 (See FIG. 9D). It will be observed from FIG. 9C, that each mesh layer 623 is adapted to restrict on its own, the movement of vertical rod 120 in the N direction. Only movement of the rod 120 in the M direction is restrained by the interaction of successive adjacent mesh layers and the positioning of rods 614 on alternating, opposite sides of rod 120.

Also in FIGS. 9–9D an alternate stopper 616 is disclosed that can be used with the transverse rod 614, although other suitable stoppers can also be used. Stoppers 616 are in the form of two, co-axially connected hollow cylinders. Stopper 616 is preferably made from any suitable material and preferably of any type of suitable plastic. Preferably stopper 616 has a cap portion 617 with a diameter 20–40 mm, a leg 615 of length in the range of about 15–70 mm, a cap 617 with a thickness of about 2 mm. Preferably, the inner cavity diameter is about equal to the diameter of the horizontal mesh transverse rod 614. It should be noted, that stopper 616 could be used in for example the embodiment in FIG. 18B, forming the inner cavity similar to or like the said stopper illustrated in FIG. 18B.

It should also be noted that in the 3D prefabricated construction module of FIGS. 9C and 9D, horizontal reinforcement meshes 660 constructed like the meshes 560 and 562, are employed, being installed in each horizontal layer. Preferably these meshes are made from longitudinal ribbed wire 664*b* with diameter 4–12 mm and longitudinal smooth wire 664*a* with diameter 2.5–4.0 mm. Usually the smooth wire surface abuts to the inner surface of the panel 610 of the 3D prefabricated construction module.

Figure 10:
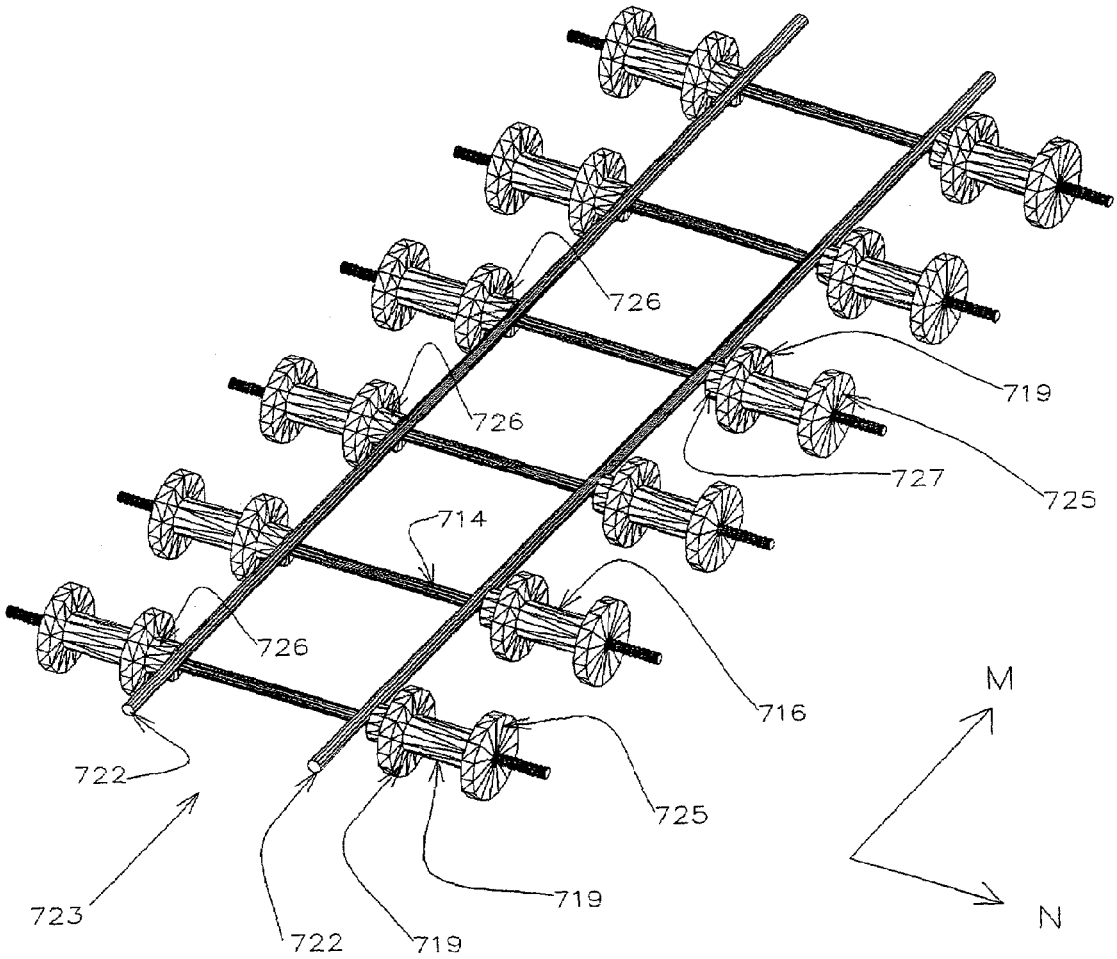
FIG. 10 is a perspective view of transverse and longitudinal elements in an embodiment of another mesh layer that can be used in a 3D prefabricated construction module in accordance with another embodiment of the invention.
Figure 10A:
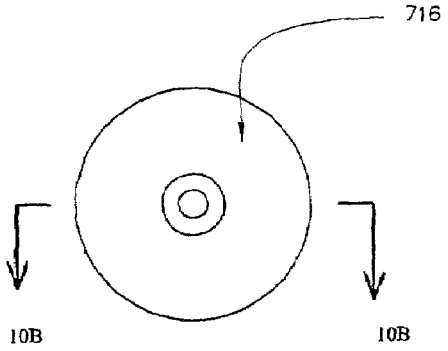
FIG. 10A is a plan view of part of the component of FIG. 10.
Figure 10B:
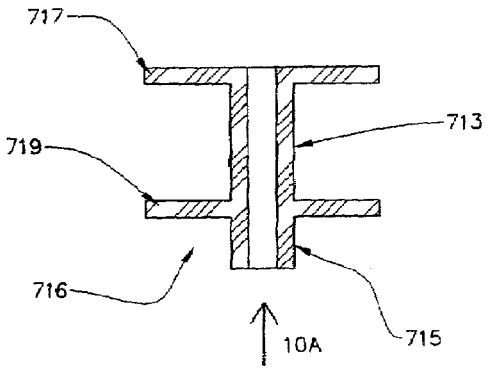
FIG. 10B is a cross section view at 10B—10B in FIG. 1A.
Figure 10C:
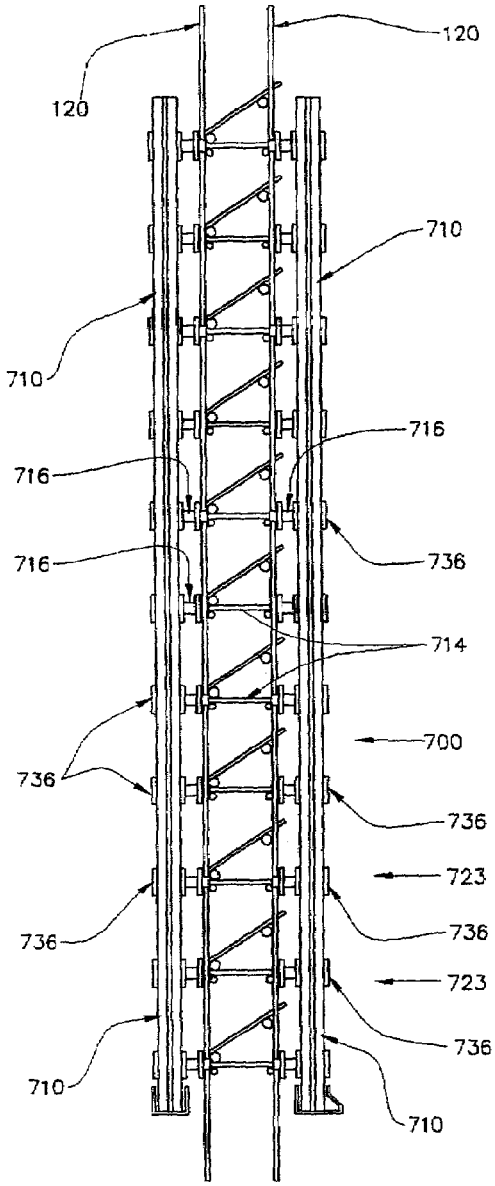
FIG. 10C is a side elevation view of a 3D prefabricated construction module with vertical reinforcement installed into cells formed by transverse and longitudinal elements, in a 3D prefabricated construction module that employs the component of FIGS. 2A, 3A, 3B, 4A, 4B, 4C, 7A, 7B, 10, 10A and 10B.
Figure 10D:
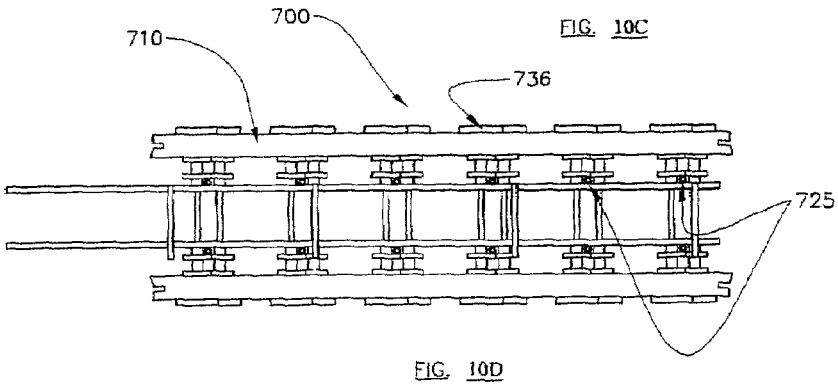
FIG. 10D is a plan view of the 3D prefabricated construction module of FIG. 10C.

In FIGS. 10–10D, another combination of longitudinal and transverse rods of a mesh layer 723 for a 3D prefabricated construction module is shown. In mesh 723, a hollow cylindrical stopper 716 comprises consequently connected hollow figures in a shape of flange 717, cylinder 713, flange 719 and a cylinder 715. A stopper 716 is put on each end of the transverse rods 714 of the horizontal mesh 723, through its cylinder opening, and stopper 716 moves into abutment with the longitudinal rods 722. It should be noted, that for the mesh 723, other types of stoppers can be used.

The transverse position of stopper 716 is maintained by rods 722 in one direction, and by the leg portion to a connector 736 which will also be in abutment with stopper 716. Connectors 736 are preferably attached to rods 714 as described above in relation to connectors 736.

Stopper 716 is also made from a suitable material including any suitable type of plastic and preferably the flanges have a diameter of about 20–40 mm, a leg length of about 15–40 mm, and flange thickness of about 2 mm. Again, the inner cavity diameter preferably is about equal to the diameter of the transverse rod, and can permit movement on the rod 714. It should be noted, that stopper 716 could be used in, for example, the embodiment in FIG. 18B, forming the inner cavity similar to or like the said stopper illustrated in FIG. 18B.

FIG. 10C illustrates a 3D prefabricated construction module in accordance with another embodiment of the present invention, in which only one type of horizontal mesh 723 as illustrated in FIG. 10 is used, and with installed vertical rods of FIG. 6 and reinforcing meshes of the horizontal reinforcement in accordance with FIG. 7A or 7B is shown. A cell 725 for installation of vertical reinforcement rod 120 is provided by alternating transverse rods 714 between adjacent layers in the M direction. In the N direction, in each layer, longitudinal rods 722 co-operate with the flange 719 of a stopper to restrict movement, there being sufficient spacing as a result of end portion 727 to allow a vertical rod 120 to fit between the rod 722 and flange 719.

Figure 11A:
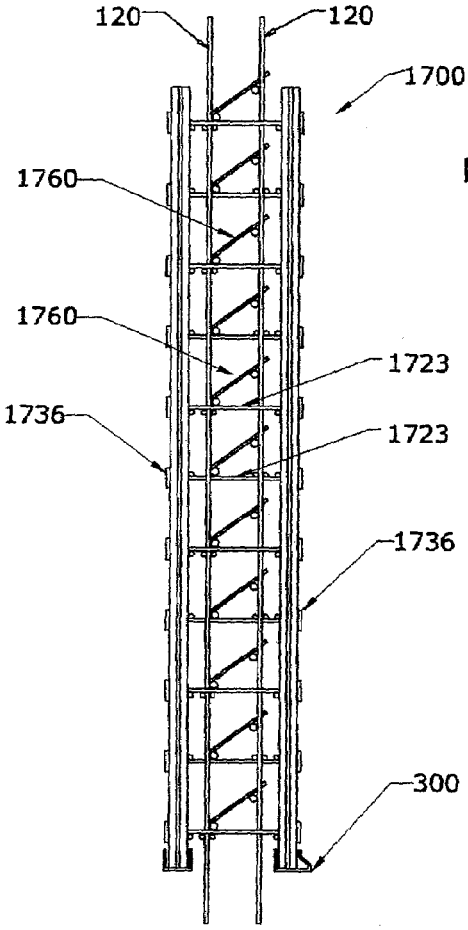
FIG. 11A is a side elevation view of a 3D prefabricated construction module with vertical reinforcement installed into cells formed by transverse and longitudinal elements, the 3D prefabricated construction module employing the component of FIGS. 2A, 3A, 3B, 4A, 4B, 4C, 7A, 7B, 11.
Figure 11:
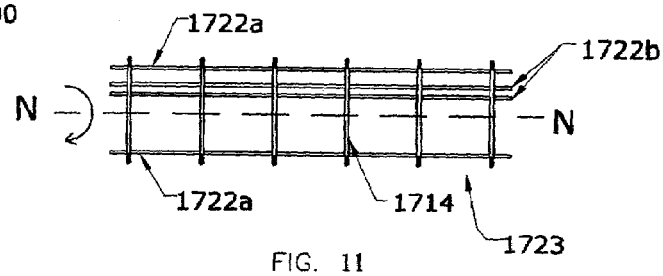
FIG. 11 is a plan view of transverse and longitudinal elements in an alternate mesh to the mesh illustrated in FIGS. 5, 5G, 5F, 10 for use in the 3D prefabricated construction module.

FIGS. 11, 11A; 11B, 12, 12A; 12B, 13, 13A, 13B; 14, 14A, 14B; and 15, 15A and 15B illustrate further embodiments of 3D prefabricated construction modules with transverse and longitudinal elements in the form of mesh layers used for holding and positioning vertical reinforcement members and horizontal reinforcement meshes.

Figure 11B:
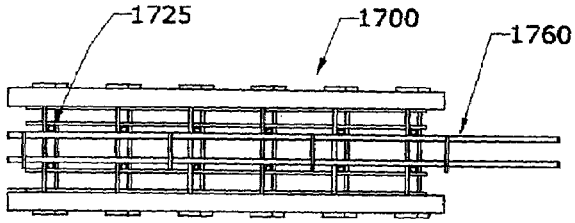
FIG. 11B is a plan view of the 3D prefabricated construction module of FIG. 11A.

In FIGS. 11, 11A, 11B, a 3D prefabricated module 1700 is shown using a horizontal mesh 1723. Adjacent layers of rods 1722*a* act as stoppers and rods 1722*b* co-operate with transverse rods 1714 to form retention cells, similar to the cells 126 in FIG. 1A. Meshes 1723 are installed by having each mesh layer positioned in a position that is rotated 180° around its longitudinal axis N relative to each adjacent mesh layer. The vertical reinforcement rods 120 are installed with horizontal reinforcement meshes, in accordance with FIG. 6, and with reinforcement meshes of FIGS. 7A and 7B.

Figure 12A:
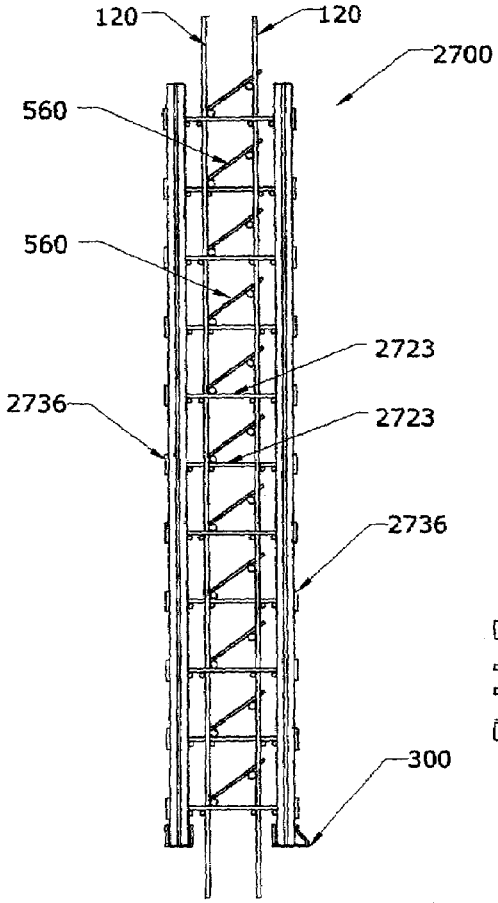
FIG. 12A is a side elevation view of a 3D prefabricated construction module with vertical reinforcement installed into cells formed by transverse and longitudinal elements, the 3D prefabricated construction module employing components of FIGS. 2A, 3A, 3B, 4A, 4B, 4C, 7A, 7B, 12.
Figure 12:
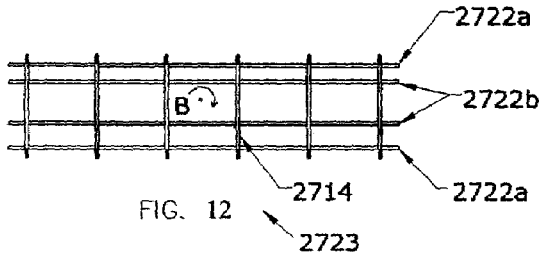
FIG. 12 is a plan view of transverse and longitudinal elements in a form of mesh alternate to the mesh illustrated in FIGS. 5, 5G, 5F, 10, 11.
Figure 12B:
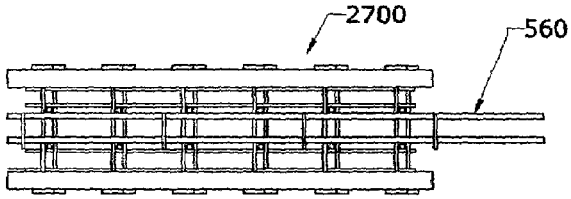
FIG. 12B is a plan view of the 3D prefabricated construction module of FIG. 12A.

In FIGS. 12, 12A, 12B a 3D prefabricated module 2700 is shown using transverse and longitudinal elements in the form of horizontal mesh 2723. Adjacent layers of rods 2722*a* act as stoppers and rods 2722*b* co-operate with transverse rods 2714 to form retention cells, similar to cells 126 in FIG. 1A. Meshes 2723 are installed by having each mesh layer positioned in a position that is rotated 180° around a vertical axis B, relative to each adjacent mesh layer. The vertical reinforcement rods 120 are installed with horizontal reinforcement meshes, in accordance with FIG. 6, and with reinforcement meshes of FIGS. 7A and 7B.

Figure 13A:
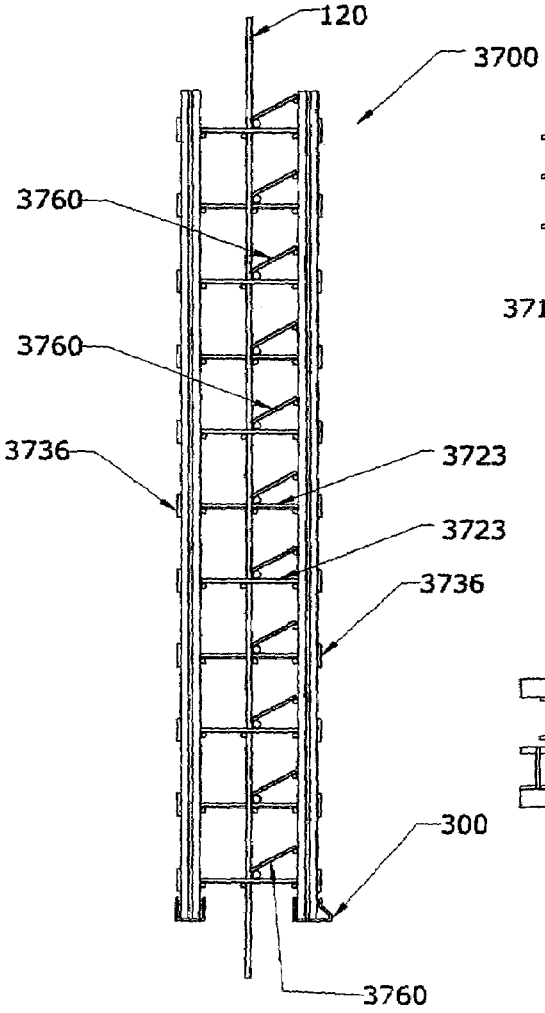
FIG. 13A is a side elevation view of a 3D prefabricated construction module with vertical reinforcement installed into cells formed by transverse and longitudinal elements, the 3D prefabricated construction module employing components of FIGS. 2A, 3A, 3B, 4A, 4B, 4C, 7A, 7B, 13.
Figure 13:
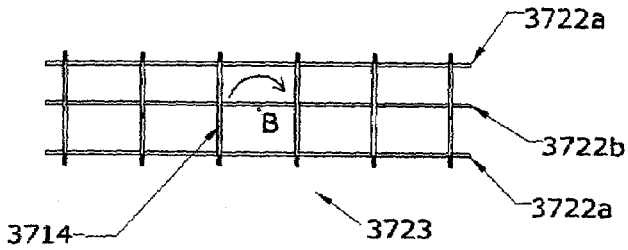
FIG. 13 is a plan view of transverse element in a form of an alternate mesh illustrated in FIGS. 9 and 11 for use in the 3D prefabricated construction module.
Figure 13B:
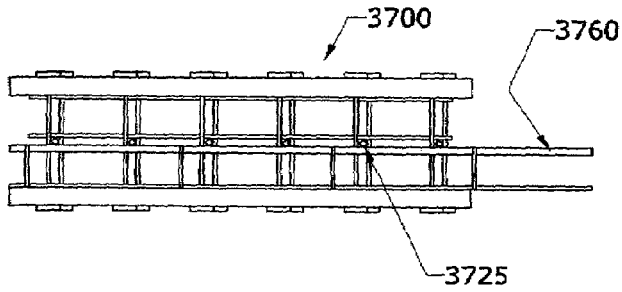
FIG. 13B is of a plan view of the 3D prefabricated construction module of FIG. 13A.

In FIGS. 13, 13A, 13B a 3D prefabricated construction module 3700 is shown using transverse and longitudinal elements in the form of a horizontal mesh 3723. Adjacent layers of rods 3722*a* act as stoppers and rods 3722*b* co-operate with transverse rods 3714 to form retention cells 3725 (FIG. 13B), similar to cells 126 in FIG. 1A. Meshes 3723 are installed by having each mesh layer positioned in a position that is rotated 180° around a vertical axis B, relative to each adjacent mesh layer. The vertical reinforcement rods 120 are installed with horizontal reinforcement meshes, in accordance with FIG. 6, and with reinforcement meshes of FIGS. 7A and 7B.

Figure 14A:
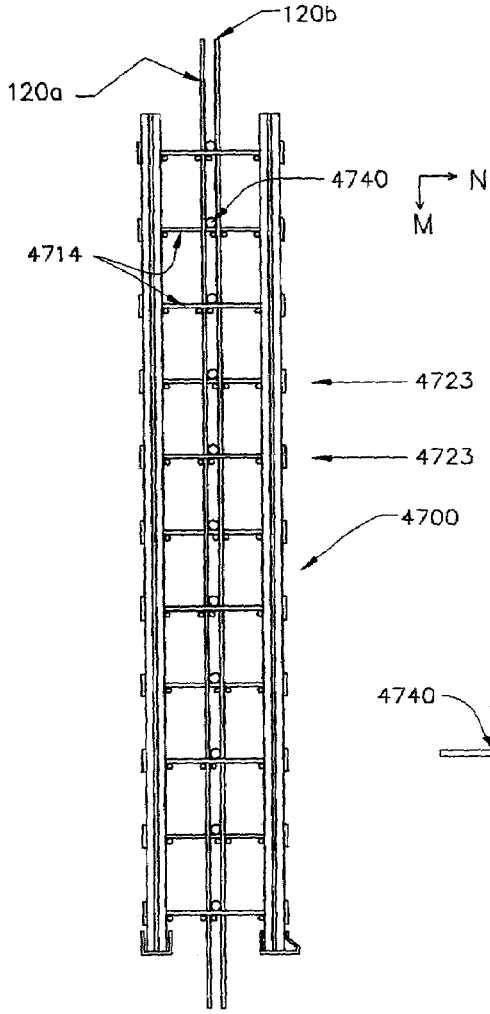
FIG. 14A is a side elevation view of a 3D prefabricated construction module with vertical reinforcement installed into cells formed by transverse and longitudinal elements and horizontal reinforcement installed into space between vertical rebar, the 3D prefabricated construction module employing components of FIGS. 2A, 3A, 3B, 4A, 4B, 4C, 14.
Figure 14:
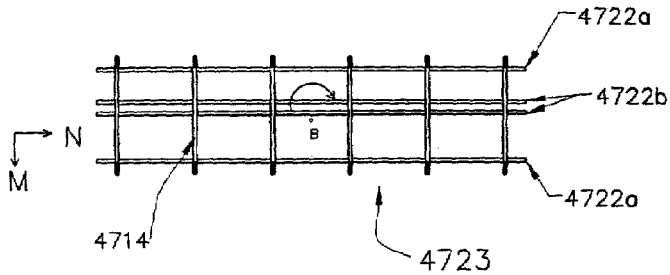
FIG. 14 is a plan view of transverse and longitudinal elements of an alternate mesh to the mesh illustrated in FIGS. 5, 5G, 5F, 10, 11, 12.
Figure 14B:
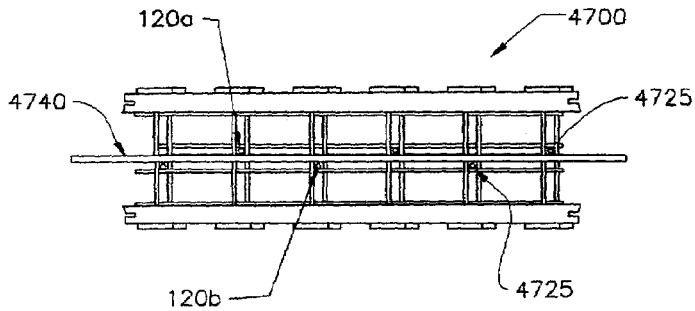
FIG. 14B is a top plan view of the 3D prefabricated construction module of FIG. 14A.

In FIGS. 14, 14A and 14B, a 3D prefabricated module 4700 is shown using a transverse and longitudinal elements in the form of a horizontal mesh 4723. Adjacent layers of rods 4722*a* act as stoppers. Rods 4722*b* co-operate with transverse rods 4714 to form retention cells 4725 (See FIG. 14B). It will be noted from FIG. 14B that longitudinally spaced two retention cells, have locations that alternate on opposite transverse sides of horizontal reinforcement members 4740. Meshes 4723 are installed by having each mesh layer 4723 positioned in a position that is rotated 180° around a vertical axis B, relative to each adjacent mesh layer. There are two sets of vertical reinforcement rods 120*a* and 120*b* each set being held on one side or the other of horizontal reinforcement rod 4740.

Figure 15A:
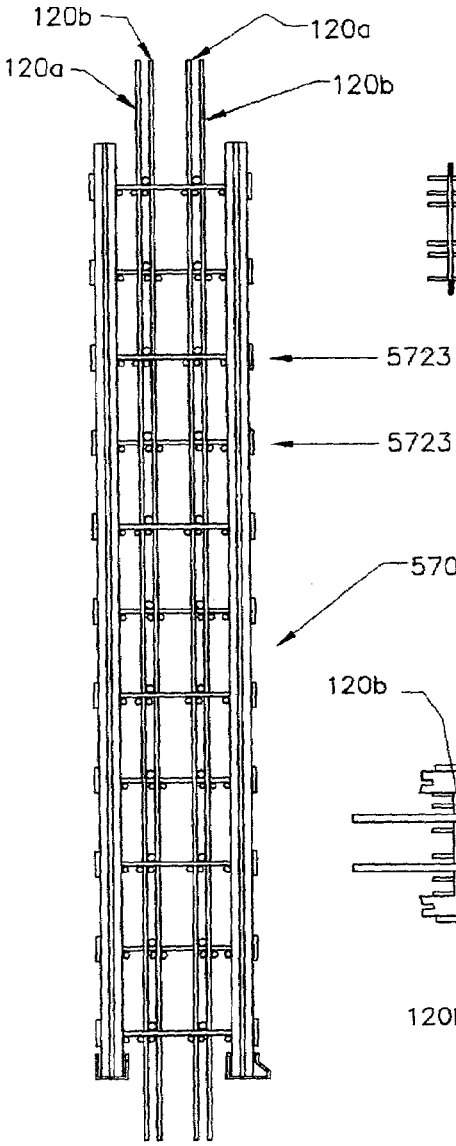
FIG. 15A is a side elevation view of a 3D prefabricated construction module with vertical reinforcement installed into cells formed by transverse and longitudinal elements and horizontal reinforcement installed into space between vertical rebar, the 3D prefabricated construction module employing components of FIGS. 2A, 3A, 3B, 4A, 4B, 4C, 15.
Figure 15:
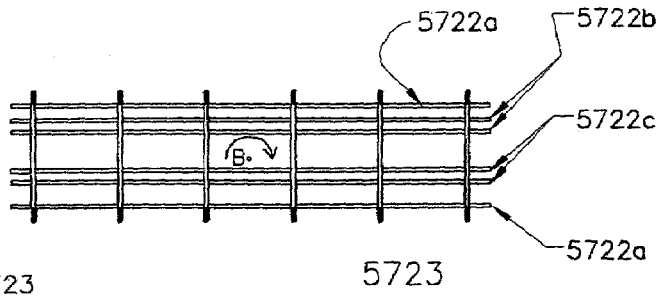
FIG. 15 is a plan view of transverse and longitudinal elements in a form of mesh that is an alternate to the mesh illustrated in FIG. 14.
Figure 15B:
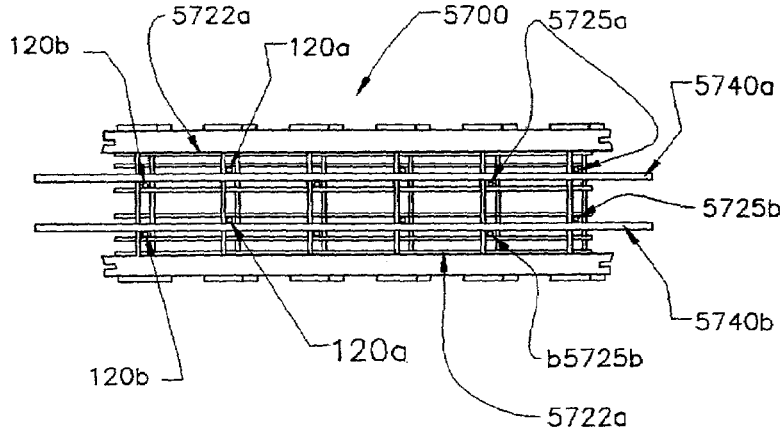
FIG. 15B is a top plan view of the 3D prefabricated construction module of FIG. 15A.

In FIGS. 15, 15A and 15B, a 3D prefabricated construction module 5700 is shown using a transverse element in the form of a horizontal mesh 5723. Module 5700 is similar to module 4700, and adjacent layers of rods 5722*a* act as stoppers. Rods 5722*b* co-operate with transverse rods 5714 to form a first series of retention cells. Rods 5722*c* co-operate with transverse rods 5714 to form a second series of retention cells. It will be noted from FIG. 15B that a first set of longitudinally spaced two retention cells 5725*a*, have locations that alternate on opposite transverse sides of horizontal reinforcement member 5740*a*. A second set of longitudinally spaced two retention cells 5725*b*, have locations that alternate on opposite transverse sides of horizontal reinforcement members 5740*b*. Meshes 5723 are installed by having each mesh layer 5723 positioned in a position that is rotated 180° around a vertical axis B, relative to each adjacent mesh layer. There are two sets of vertical reinforcement rods 120*a* and 120*b* each set being held on one side or the other of horizontal reinforcement rod 4740.

With reference to FIGS. 16A, 16B, 17, 17A, 17B, 17C, 17D, 17E, 17F, other embodiments of the invention are shown provided for a 3D prefabricated construction module that can be used for erection reinforced concrete structures with extended details, such as a parapet, a cornice or one or more short ledges.

Figure 16A:
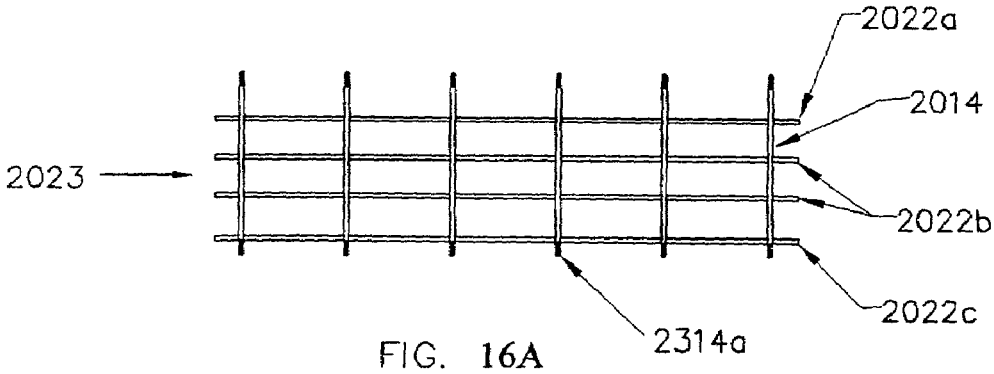
FIG. 16A is a plan view of transverse and longitudinal elements in a mesh of a form alternate to the mesh illustrated in FIGS. 12, 13, 14, 15.

With reference to FIG. 16A, transverse and longitudinal elements in the form of a mesh 2023 are shown and which comprises longitudinal bars 2022*a* and 2022*c* which act as stoppers and bars 2022*b* which co-operate with bars 2314 to form retention cells, in a manner as described above. It will be noted that stopper bar 2022*a* is positioned away from end portion 2314*a*, whereas bar 2022*c* abuts the end of portion 2314*a* on the opposite side of the mesh. These meshes are used in the 3D prefabricated construction modules for erection of walls with one side ledge (see FIGS. 17A, 17B, 17C).

Figure 16B:
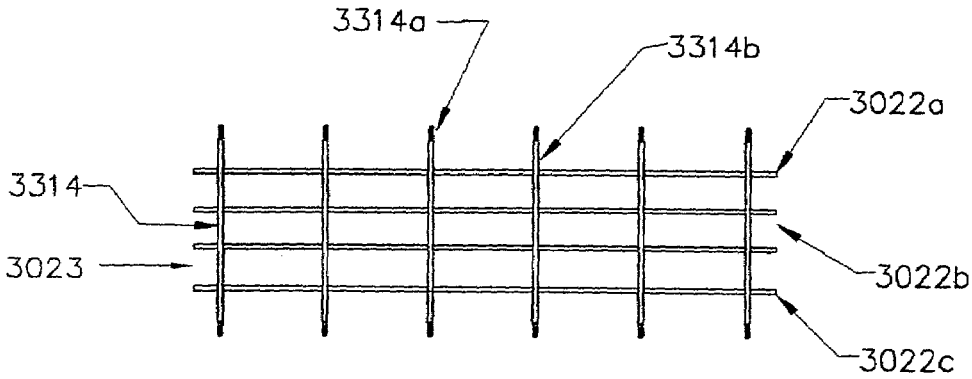
FIG. 16B is a plan view of transverse and longitudinal elements in a mesh of a form alternate to the mesh illustrated in FIGS. 11, 16A.

With reference to FIG. 16B, transverse and longitudinal elements of a 3D prefabricated construction module in the form of a mesh 3023 is shown which is similar to mesh 2023 and comprises longitudinal bars 3022*a* and 3022*c* which act as stoppers and bars 3022*b* which co-operate with bars 3314 by off-setting two meshes 3023 longitudinally to form retention cells. It will be noted that both stopper bars 3022*a* and 3022*c* are positioned away from end portion 3314*a*. These meshes are used in the construction modules for erection of walls with two-side ledge (see FIGS. 17D, 17E, 17F).

Figure 17:
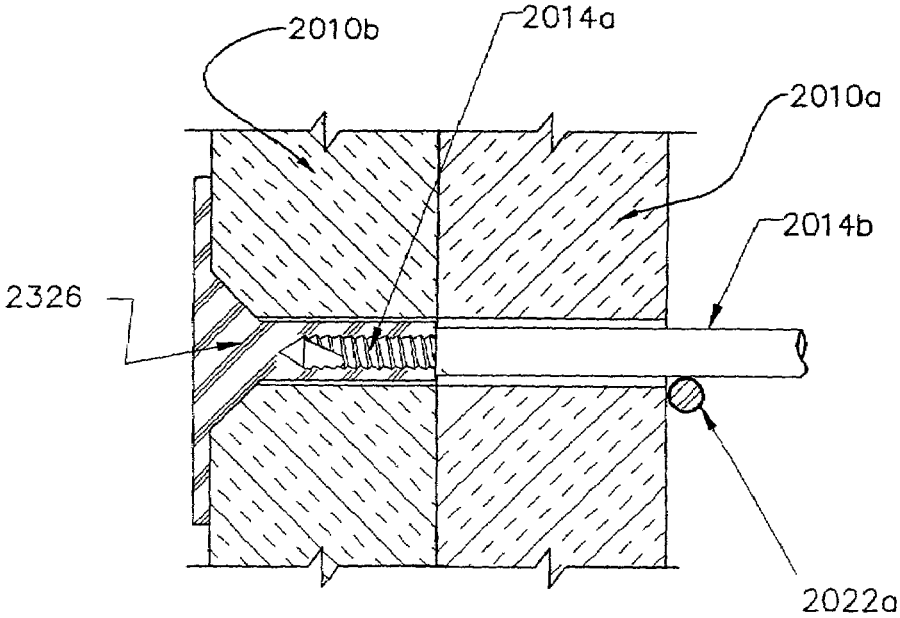
FIG. 17 is an enlarged cross section view of a fragment of a construction module illustrating the connection of the construction module panels in FIGS. 2D, 2E and one of the ends of the transverse rod of FIG. 5C of a mesh of FIG. 16A or 16B used with a connector as shown in FIG. 3A in accordance with an embodiment of the invention.

FIG. 17 illustrates the cross section of a fragment of a 3D prefabricated construction module, where connectors 2326 can be used to connect a panel to the end of transverse rod 2014 with abutment in the body of the transverse rod 2014*b* medial portion, where element 2022*a* is remote from end portion 2014*a* and act only as a support for the perforated panel 2010*a*, 2010*b*. This is useful for prefabrication of the construction module for erection of reinforced concrete structures with extended details, such as parapet, cornice or short ledge; for example the panel material may comprise an additional thickness of panel wall 2010*b*, as illustrated in FIG. 17. It should be noted that the rod 2014 has a relatively large diameter in its medial portion relative to its end, tapered portion. The plane at the end of medial portion, abutting the end portion of rod 2014 may serve as a stopper for connector 2326.

Figure 17C:
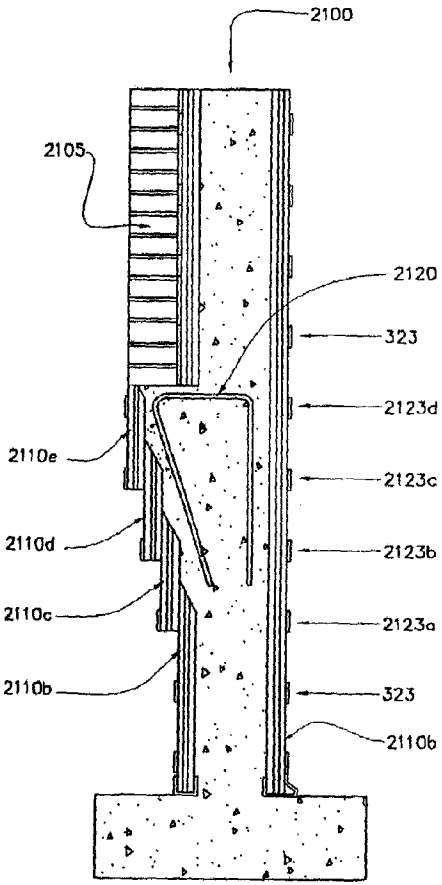
FIGS. 17A, 17B, 17C illustrate 3D prefabricated construction modules with one side adapted for use in erecting one short ledge on reinforced concrete walls.
Figure 17B:
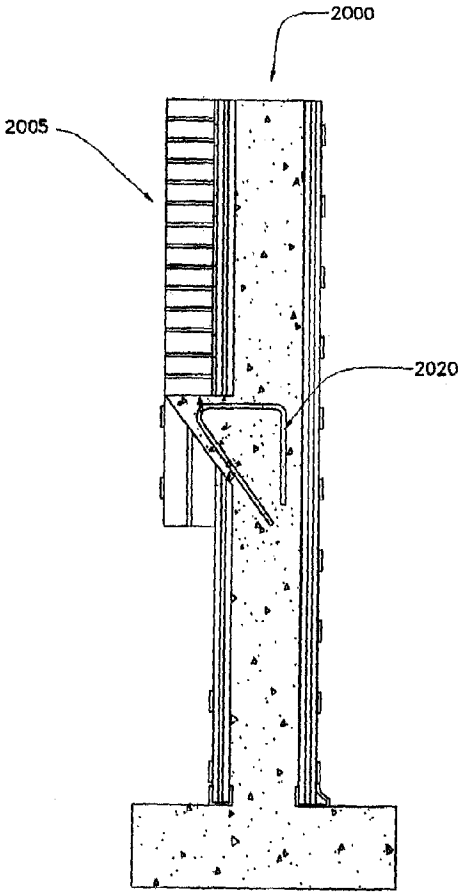
Figure 17A:
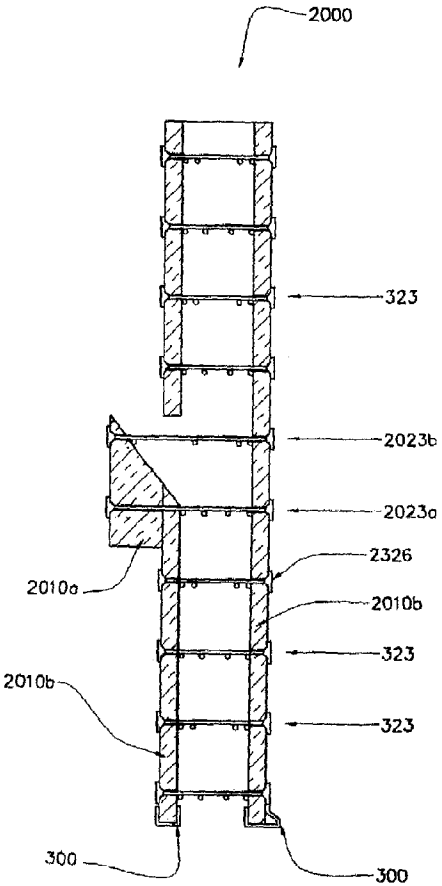

FIG. 17A illustrates a cross-section of a 3D prefabricated construction module 2000 similar to module 200 modified with meshes 2023*a* and 2023*b* similar to meshes 2023 in FIG. 16A. Module 2000 is used for erection of walls with one side short ledge. Perforated panel 2010*a* of non-standard thickness is used for forming the ledge.

FIG. 17B is a side elevation view of a reinforced concrete wall fragment with one side short ledge erected on a foundation with a 3D prefabricated construction module

2000. The ledge is reinforced with reinforcement bar detail 2020 and its exterior is finished with brickwork 2005.

FIG. 17C is a side elevation view of a reinforced concrete wall fragment with one side short stepped ledge erected on a foundation with a 3D prefabricated construction module 2100 similar to module 2000 in FIG. 17A and modified from module 200. The stepped ledge is formed with small panel sections 2010*c*, 2010*d*, 2010*e* with standard thickness. The ledge is reinforced with reinforced detail 2120 and formed with horizontal meshes 2123*a*, 2123*b*, 2123*c*, 2123*d* which are like meshes 2023.

Figure 17F:
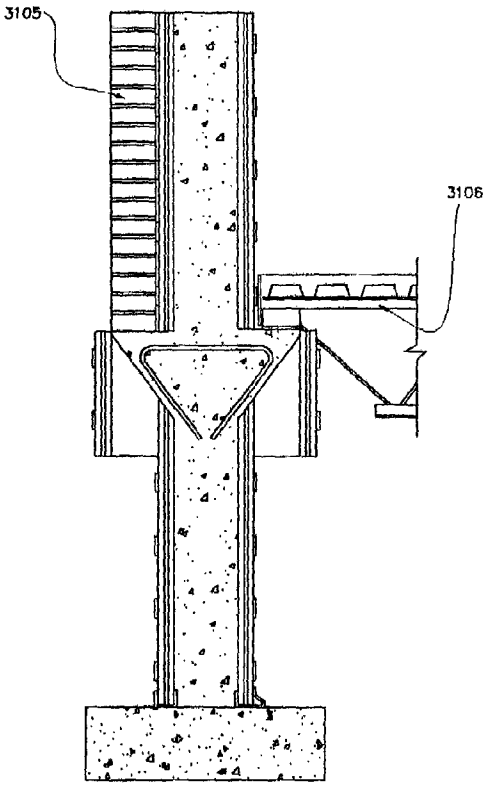
FIGS. 17D, 17E, 17F illustrate 3D prefabricated construction modules with two sides adapted for use in erecting two short side ledges on reinforced concrete walls.
Figure 17E:
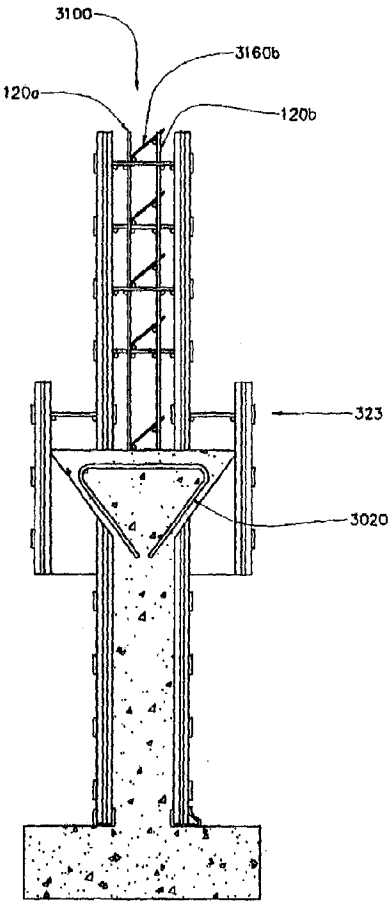
Figure 17D:
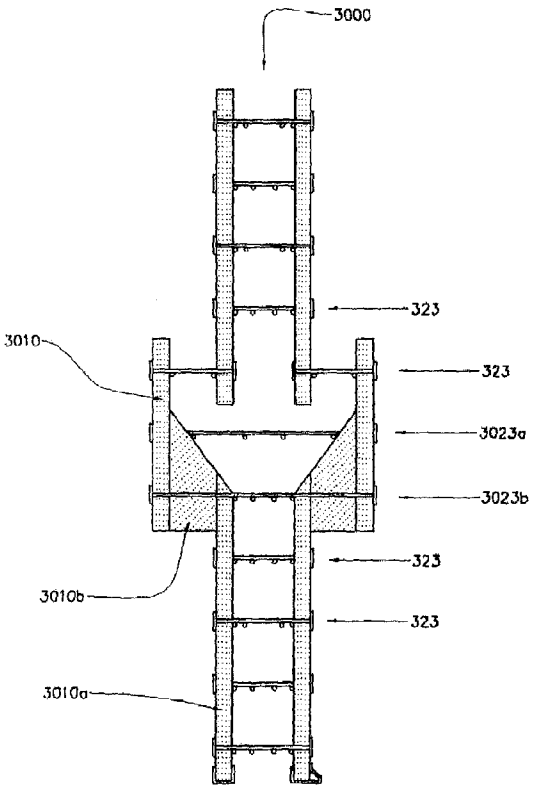

FIG. 17D is a cross section of a 3D prefabricated construction module 3000 similar to modules 200 and 2000 modified with meshes 3023*a* and 3023*b* similar to meshes 3023 in FIG. 16B. Module 3000 is used for erection of walls with two side short ledge on opposite sides of the wall. Perforated panels 3010*b* of non-standard thickness and shape, and perforated panels 3010 of standard thickness are used in conjunction with panels 3010*a* for forming the ledges.

FIG. 17E is a side view of a reinforced concrete wall fragment with two side short ledge erected on foundation with 3D prefabricated construction module 3100 modified with vertical reinforced rods 120*a* and 120*b* installed and horizontal reinforcement meshes 316. Ledge is reinforced with reinforced detail 3020. This Figure shows the first step of wall concreting when concrete is poured in the module cavity up to the top edge of the ledge.

FIG. 17F is a fragment of a reinforced concrete wall erected with two side short ledges. After concrete hardening in FIG. 17E, a portion of a panel 3010 with meshes 323 is removed. Concrete is placed to the entire height of the wall. Afterwards, the ledges can be used according to the design requirement, for example, brickwork 3105 or truss 3106 or pre-cast slab support.

Figure 18:
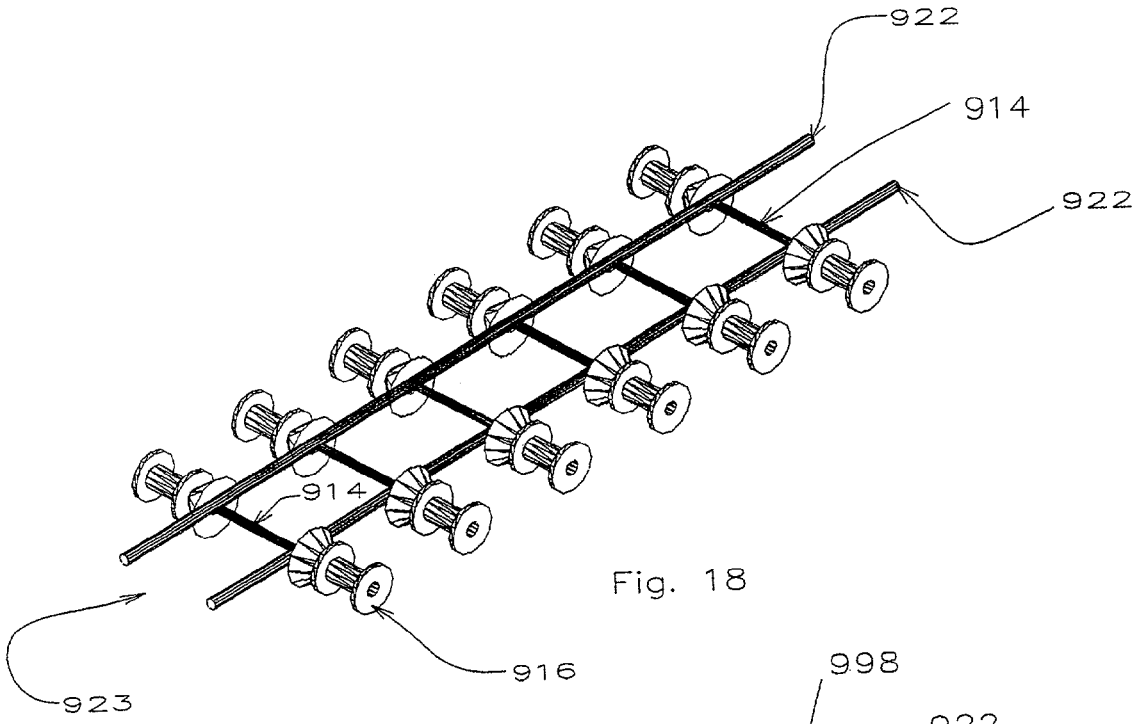
FIG. 18 is a perspective view of an alternate arrangement of transverse and longitudinal elements forming a mesh for a construction module in accordance with another embodiment of the invention.
Figure 18A:
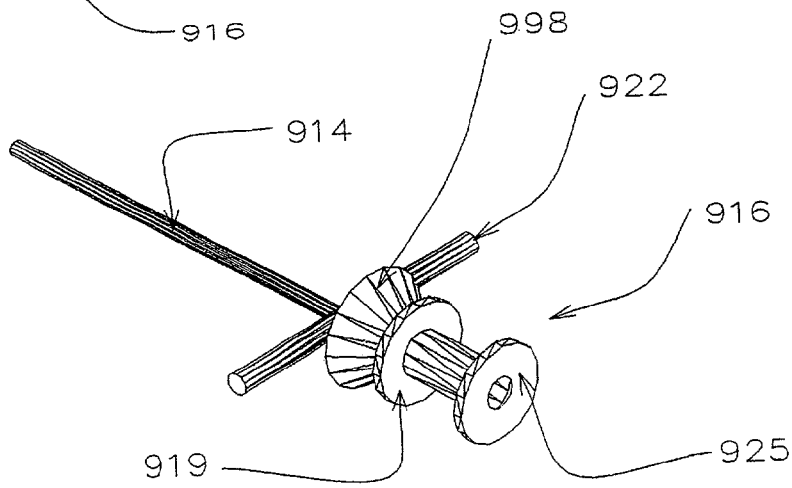
FIG. 18A is an enlarged perspective view of part of the mesh of FIG. 18.
Figure 18B:
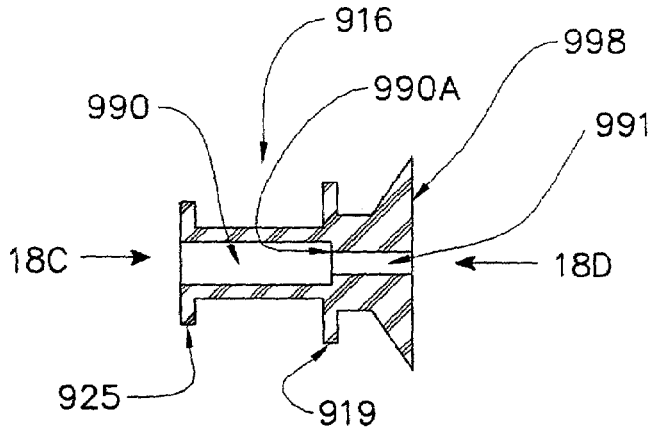
FIG. 18B is a cross section view of a component of the mesh of FIG. 18.
Figure 18C:
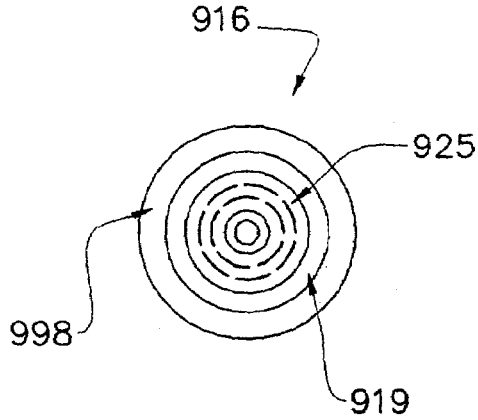
FIG. 18C is an end view of the component of FIG. 18B taken in the direction 18C in FIG. 18B.
Figure 18D:
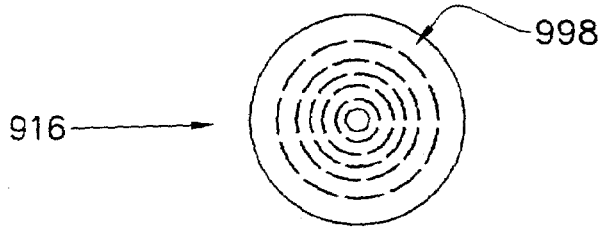
FIG. 18D is an end view of the component of FIG. 18B taken in the direction 18D in FIG. 18B.
Figure 18E:
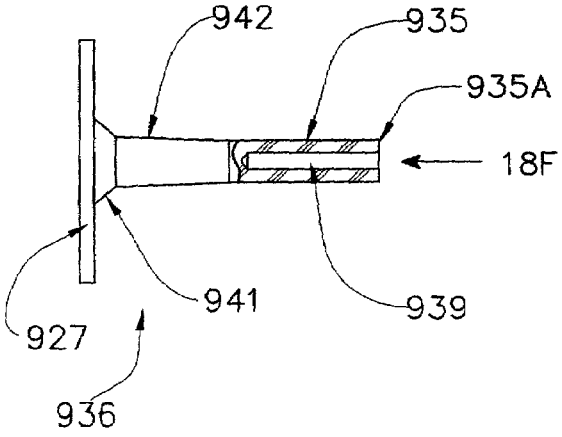
FIG. 18E is a side view of a connector, partially cut away in section in the vicinity of a blind cavity, the connector being for use as a component of the construction module used with the mesh of FIG. 18A in accordance with an embodiment of the invention.
Figure 18F:
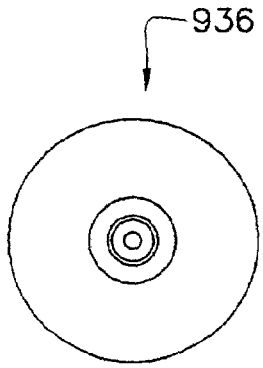
FIG. 18F is an end view of the connector of FIG. 18E.

With reference now to FIGS. 18–18F, another combination of transverse and longitudinal elements of a 3D prefabricated construction module are shown. The horizontal mesh layer 923 comprising rods 914 and 922 is used with stoppers 916 and connectors 936 (FIGS. 18E, 18F). Horizontal mesh 923 is made from transverse bars 914 are connected to longitudinal reinforcement bars 922 by conventional methods including preferably spot welding. During prefabrication of the construction module, the stopper 916 is placed onto the ends of the transverse rods 914*a* until abutment with the longitudinal rod 922 as shown in FIGS. 18A and 18H.

As shown in detail in FIG. 18A a stopper element 916 is provided and abuts against rod 922. Stopper 916 is constructed to co-operate with connector 936 to be mounted on the outer extended leg portion 935.

It will be observed that stopper 916 if formed with a large outer cylindrical cavity 990, which is adapted to receive the leg portion 935 of connector 936. The end 935*a* of leg 935 of connector 936 usually abuts into the end wall 990*a* of the cylinder cavity 990. Second, inner cylindrical cavity 991 permits the portions 914*b* and 914*a* of rod 914 to pass there through and into cavity 939 of connector 936, which is tapped in the same manner as connector 336 as described above.

The geometrical parameters of stopper 916, as well as material, can be similar to the stoppers disclosed in FIGS. 9 and 10. It should be noted that the cylindrical cavity 991 with the smaller diameter permits positioning connector 936 relative to the end of the transverse rod 914*a* and 914*b*. The end wall 990*a* of cylinder cavity 990 acts as a stopper for rotation of connector 936 when connecting with the end of the transverse rod 914*a*. Usually the length of the leg 935 of the connector 936, the thickness of the perforated panel and the geometrical sizes of the stopper 916 are chosen in a way, that the cylinder flange of the stopper 916 abuts to the perforated board, and another flange in the shape of truncated cone 998 abuts the longitudinal rod 922 of the 3D prefabricated construction module. Also, it is to be noted that the stopper 916 serves to assist in forming a cell for vertical reinforcement rods 920 installation, and after their installation, serves also as a positioner for installation of the horizontal reinforcement rods 940. Due to the conical shape of the flange 998 of stopper 916, the horizontal rods 940 slip inside and press the vertical rod 920 providing the best position for strengthening the reinforced concrete wall.

Also, said stopper detail permits easy unscrewing of the mushroom-shaped connector and removal of the 3D prefabricated construction module perforated panel from an erected wall after wall concreting and concrete hardening.

With reference to FIG. 18E, mushroom-shaped connector 936 is shown in details and is preferably made from any composite material, which provides connection with the horizontal mesh transverse rod 914 with a tensile strength of 120–250 kg. It is made most preferably from glass fiber reinforced polypropylene. Cap portion of the mushroom-shaped connector preferably has a diameter of 45–70 mm and a width 2–4 mm and typically is designed so that there are features that permit for rotation of the leg with utilization of a mechanical tool.

Preferably the first portion of the mushroom-shaped connector leg has a cylinder shape and diameter 8–12 mm and length 30–40 mm, as well as "blind" cavity in the form of cylinder with depth 30–40 mm and diameter as 70–85% from diameter of the end of the transverse rod of the connecting mesh. The "blind" cavity acts as a nut after joining the end of the mesh transverse rod. The cylinder portion of the connector is provided for connection with cavity 990. The second portion of the leg preferably has the form of a truncated cone 942 with the angle of the line of deflection forming the cone to the base of the cone being an angle 5–10° and a height 30–40 mm. The cone portion is intended for blocking the openings in the walls of the perforated polystyrene panel during prefabrication of the construction module.

The third leg portion 941 also preferably has a shape of the truncated cone, which has the angle of the line deflection forming the cone to the basis of the cone to 30–60° and height 10–20 mm, and intended for deformation of the openings walls of the polystyrene perforated panel and blocking the openings walls of the perforated polystyrene panel during prefabrication of the 3D prefabricated construction module and tightening two consequently installed 3D prefabricated construction modules by means of utilization of the panels bracers.

Connection of two panels (rotation of said mushroom-shaped connector) is accompanied by formation of indentation on the side surface of the said leg in the shape of helical spiral by means of threading tool of the panel flat connector; wherein preferably the spiral step matches the helical indentation step in the "blind" cavity of the connector, which is formed while connecting the connector and horizontal mesh transverse rod.

FIG. 18F shows mushroom-shaped connector 936 in end view, wherein the cap portion 927 of the cylinder is provided without eccentricity with respect to the shaft portion.

FIGS. 18E and 18F show connector 936 provided in the shape of torsion figure with the surfaces formed with polygonal line rotating around longitudinal, central axis of the connector 936. Connector 936 can be considered as a result of co-axial and consequent connection between the cylinder (cap portion), first truncated cone (front part of the leg portion), second truncated cone (medial part of the leg portion) and cylinder with a cylinder "blind" cavity in it (back part of the leg portion).

The effect of using connector 936 is that during its joint action with the stopper component 916, the perforated panels of the 3D prefabricated construction module can be easily removed after erection of the reinforced concrete wall for the next utilization. Also, this has a good effect for building concrete walls with prefabricated 3D construction module requiring an architectural surface. For this purpose, at least one perforated panel of the said construction module should have a negative 3D pattern on the surface facing another panel of the module. After concrete hardening, said panel is removed and wall surface has a 3D positive pattern.

Figure 18G:
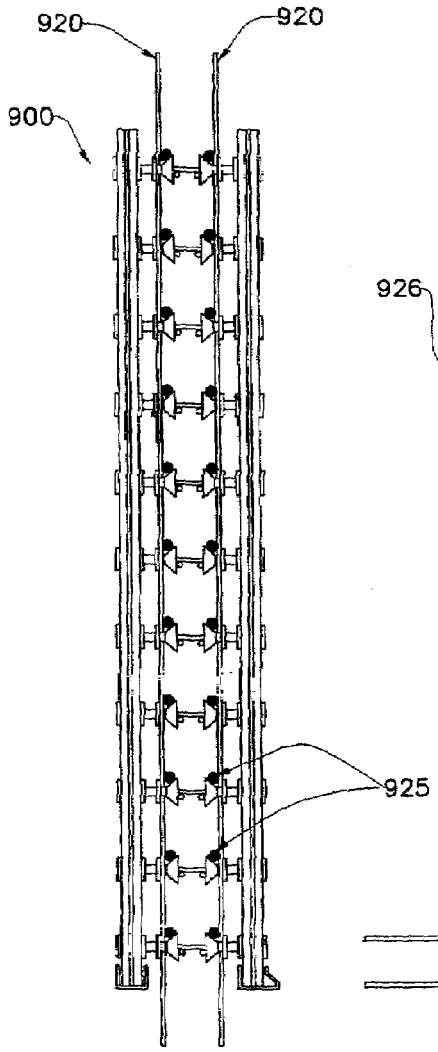
FIG. 18G is a side elevation view of a construction module using the connectors illustrated in FIG. 18E and the mesh with components of FIGS. 18, 18A, 18B.
Figure 18H:
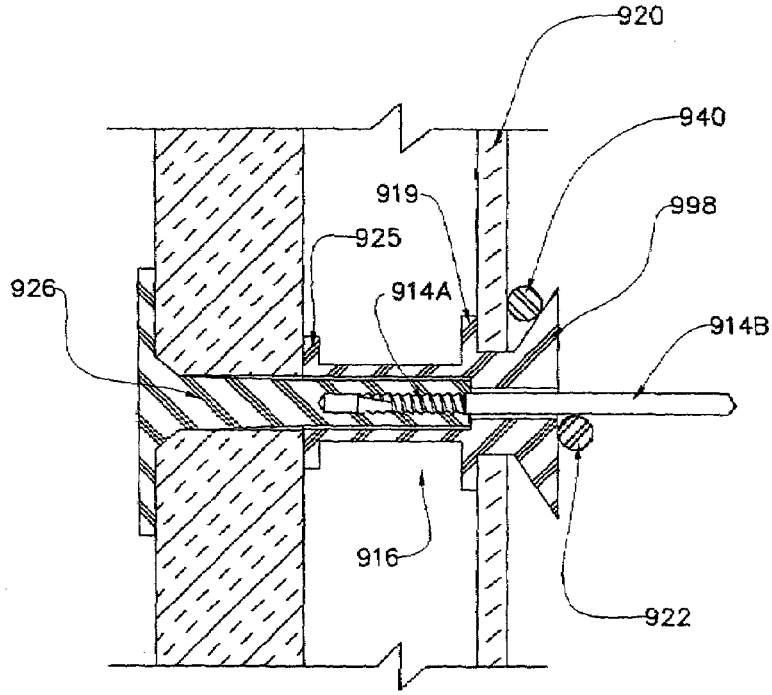
FIG. 18H is a cross section view of a fragment of a construction module illustrating a connection of the construction module panel in FIGS. 2D, 2E and one of the ends of the transverse rod of FIG. 5C comprising part of a mesh as illustrated in FIG. 18 with connector in FIG. 18E.
Figure 18I:
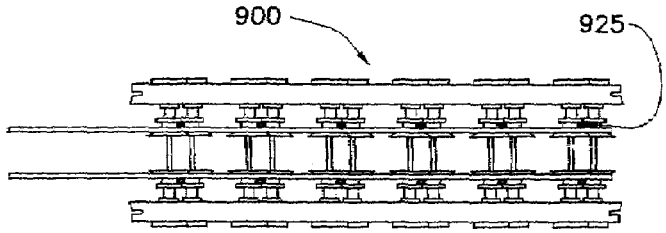
FIG. 18I is a top view of a construction module with installed vertical and horizontal reinforcement rods.

FIGS. 18G and 18I illustrate a 3D prefabricated construction module 900 using connectors 936 and stoppers 916 and in which only one type of combination of longitudinal and transverse elements in the form of horizontal meshes as per FIG. 18 is used. Module 900 also utilizes installed vertical rods of FIG. 6 and reinforcement rods similar to horizontal reinforcement rods in accordance with FIGS. 14A, 14B, 15A, 15B. A cell 925 for installation of vertical reinforcement rod 920 is provided by the side surface of the truncated cone 998 of the stopper element 916 and the side surface of flange 919.

In FIG. 18H, the joining of the mushroom-shaped connector 926 with the horizontal mesh transverse rod end 914*a* in the stopper cylinder cavity 990 is shown in detail. This joining provides the possibility to remove the polystyrene perforated panels after the erected reinforced concrete wall concreting. Additionally, utilization of stopper provides the sufficient reinforcement of the erected reinforced concrete wall. It is advised to note, that embodiment of the present invention is possible also with the stopper details in accordance with FIGS. 9 and 10.

Figure 19:
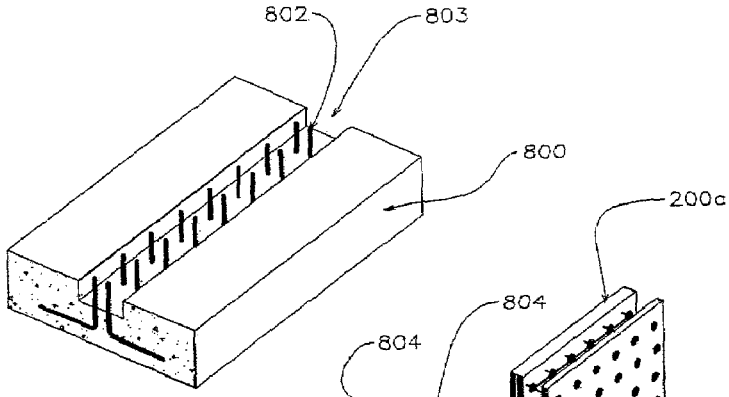
FIG. 19 is a perspective view of a foundation with reinforcement installed in a cavity to receive vertical reinforcement from the construction module formed in accordance with the invention.
Figure 20A:
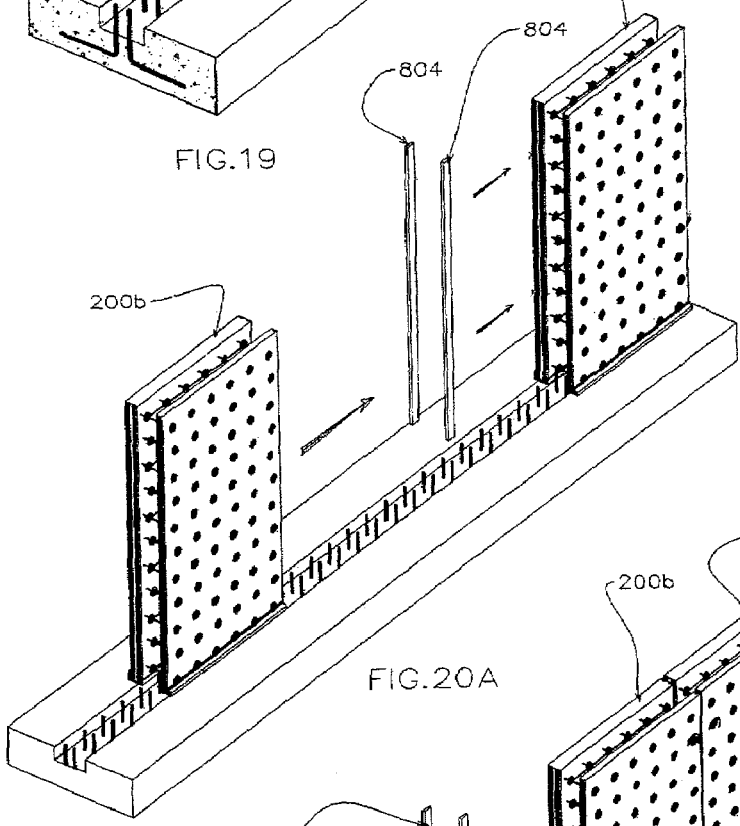
FIGS. 20A and 20B are perspective views illustrating part of the fabrication process for erecting a reinforced concrete wall with construction modules.
Figure 20B:
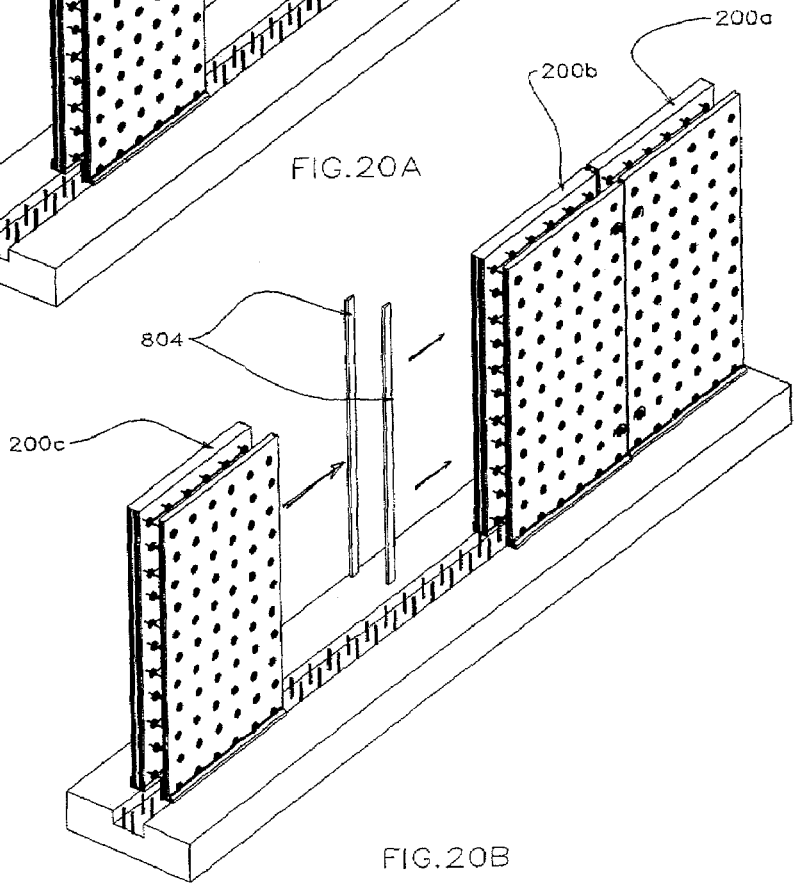
Figures 20C, 20D, 20E, 20F:
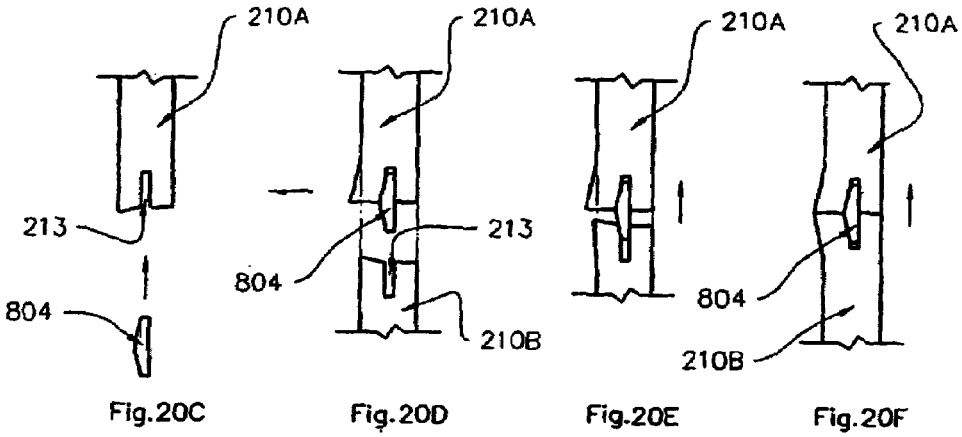
FIGS. 20C to 20F are enlarged top plan views showing the connection of one panel of a module to a second panel of another module.
Figure 20G:
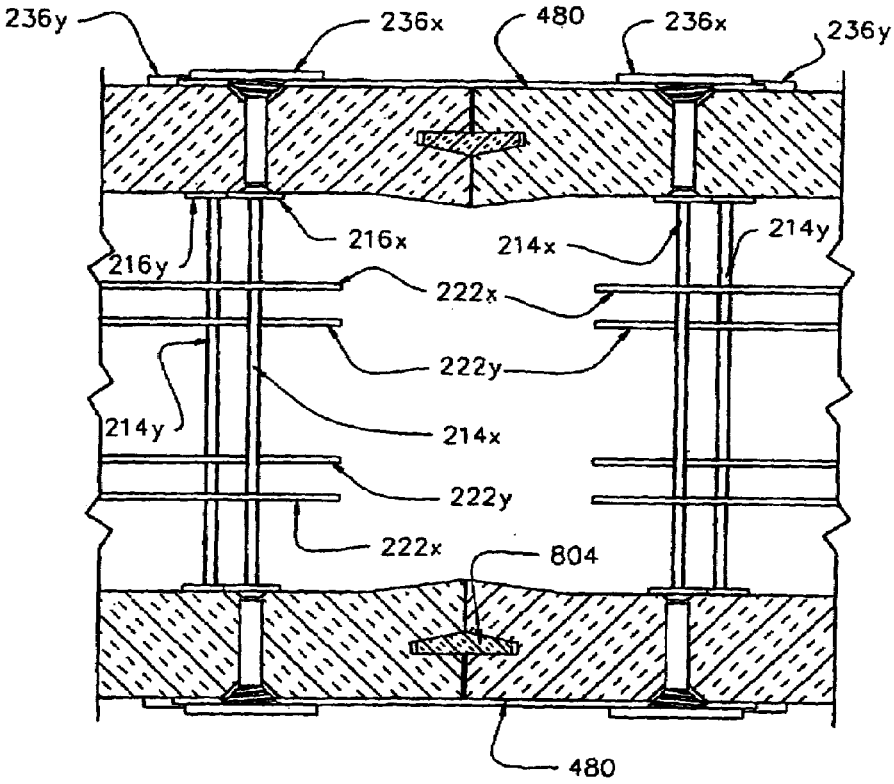
FIG. 20G is an enlarged bottom view showing the panel connections of one module to another module.
Figure 20H:
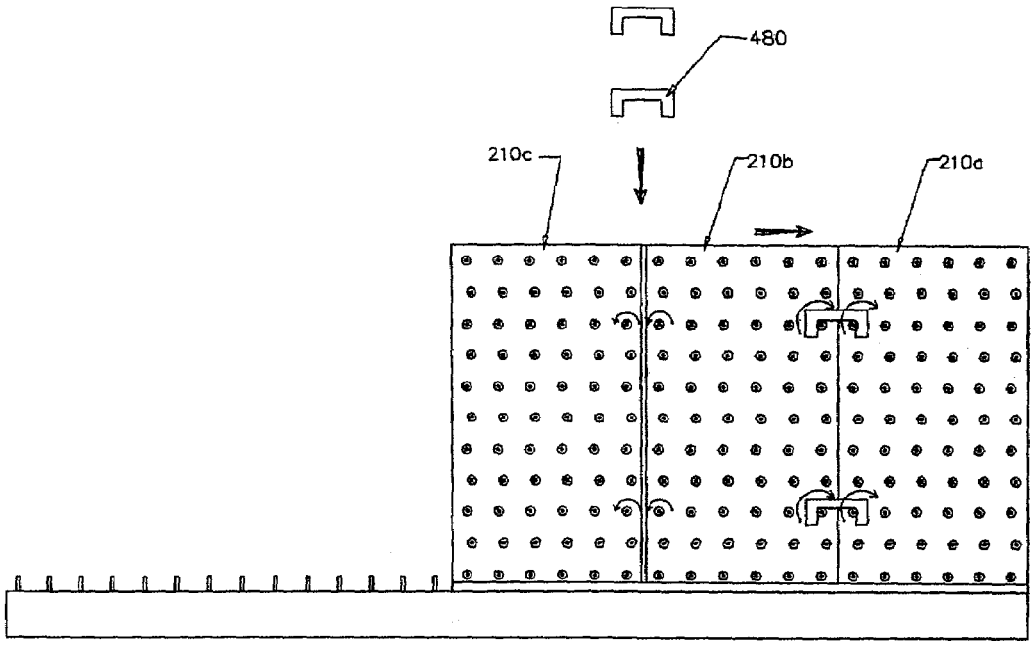
FIG. 20H is a front view showing the continuation of the process of reinforced concrete wall erection including installation of bracer members to connect panels.
Figure 20I:
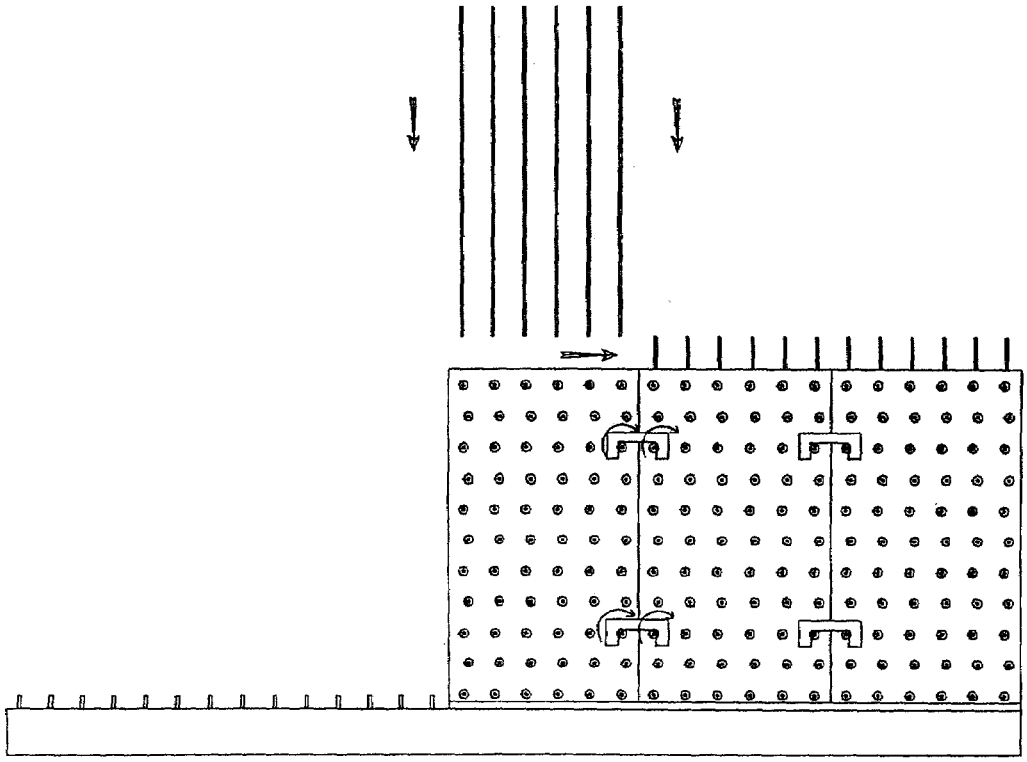
FIG. 20I is a front view showing the continuation of the process of reinforced concrete wall erection including installation of vertical reinforcement into construction modules.
Figure 20J:
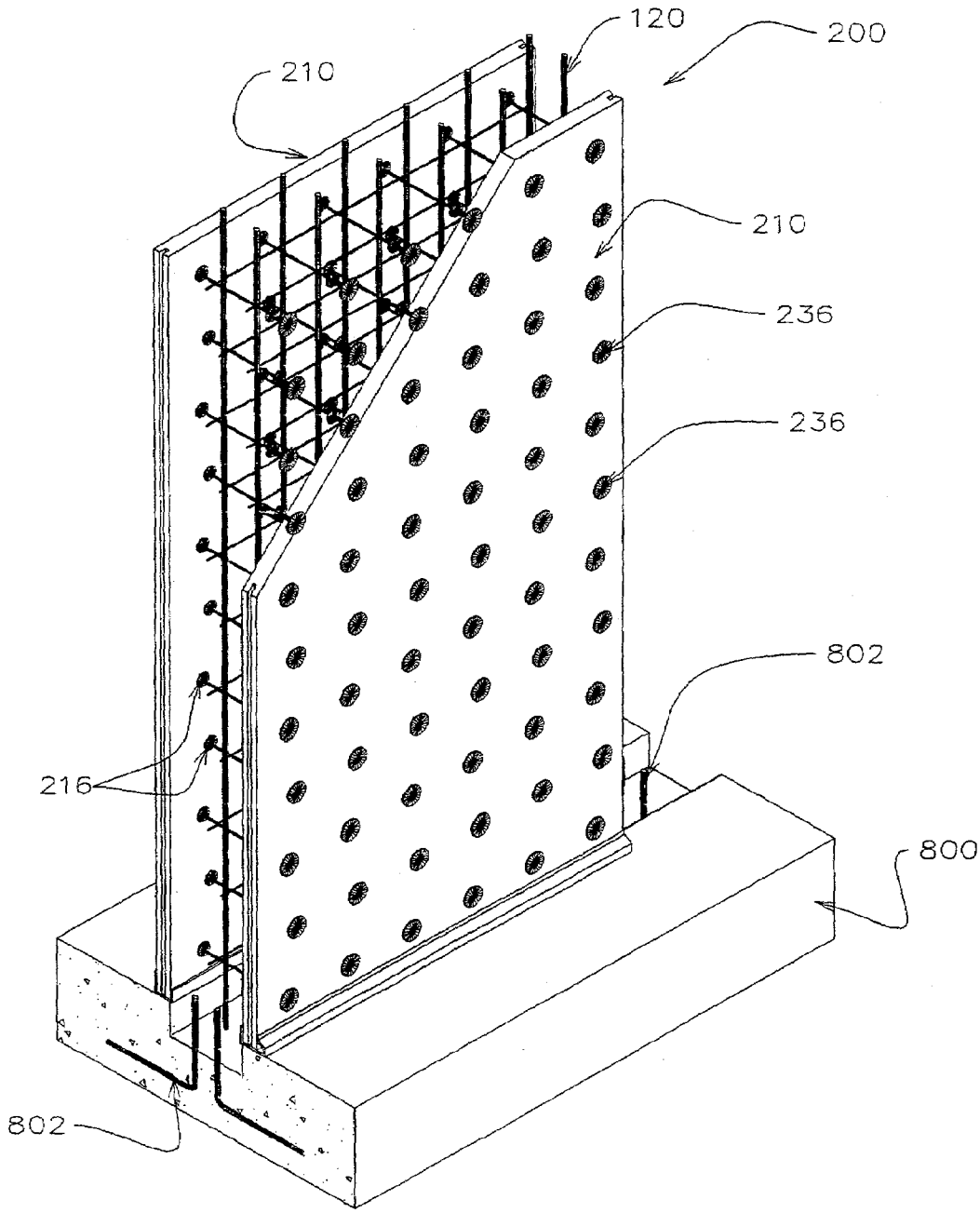
FIG. 20J is a perspective view of a single construction module similar to FIG. 6A, partially broken away, and mounted on a footing and having vertical reinforcement bars with ends installed into the groove of the foundation cavity to provide overlapping with rebar extensions of foundation for the integrity of the reinforced concrete wall and foundation.
Figure 20K:
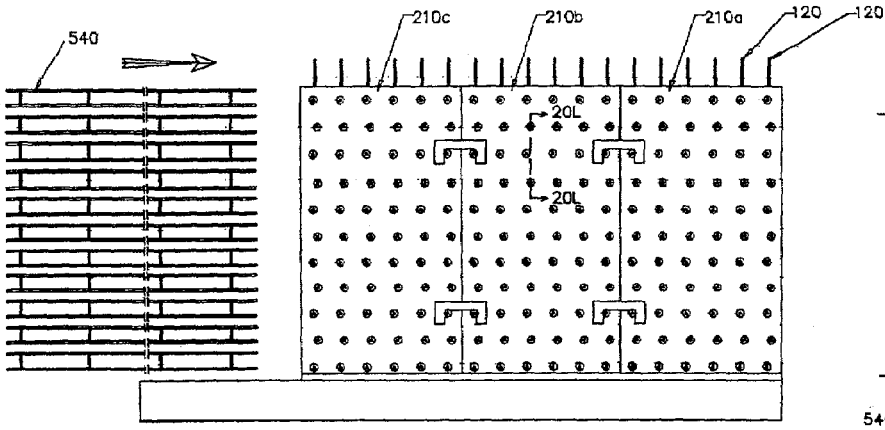
FIG. 20K is a front view illustrating the continuous of the process of the reinforced concrete wall erection in FIG. 20I illustrating installation of horizontal reinforcement into joined construction modules.
Figure 20L:
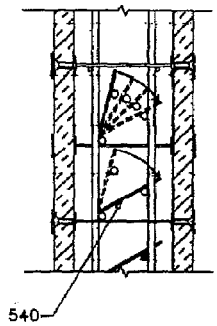
FIG. 20L is an enlarged cross section view at 20L—20L in FIG. 20K illustrating the completion of the installation process of detail 7A or 7B as horizontal reinforcement of the erected reinforced concrete wall.
Figure 20M:
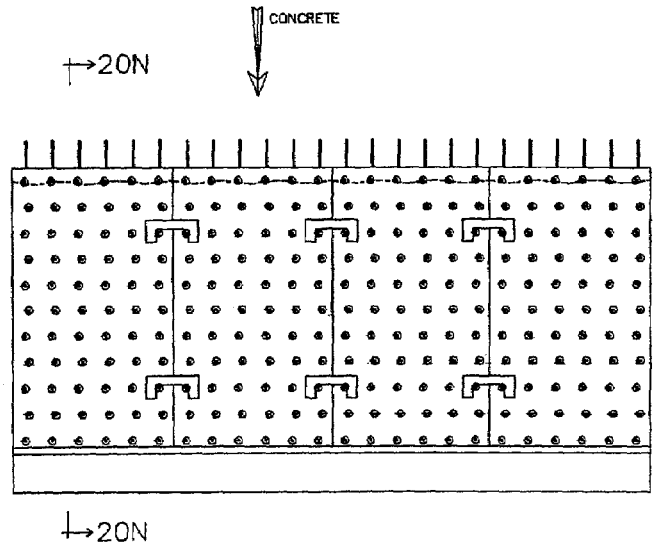
FIG. 20M is a front view showing the continuation of the process of the reinforced concrete wall erection in FIG. 20K illustrating the installation of concrete in a wall form made from construction modules, the top edge of concrete placement is shown in waved broken line.
Figure 20N:
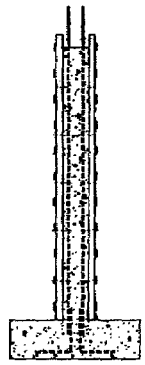
FIG. 20N is a cross section view at 20N—20N in FIG. 20M, showing the reinforced concrete wall made from the construction modules shown in FIG. 20M erected on the foundation.
Figure 20O:
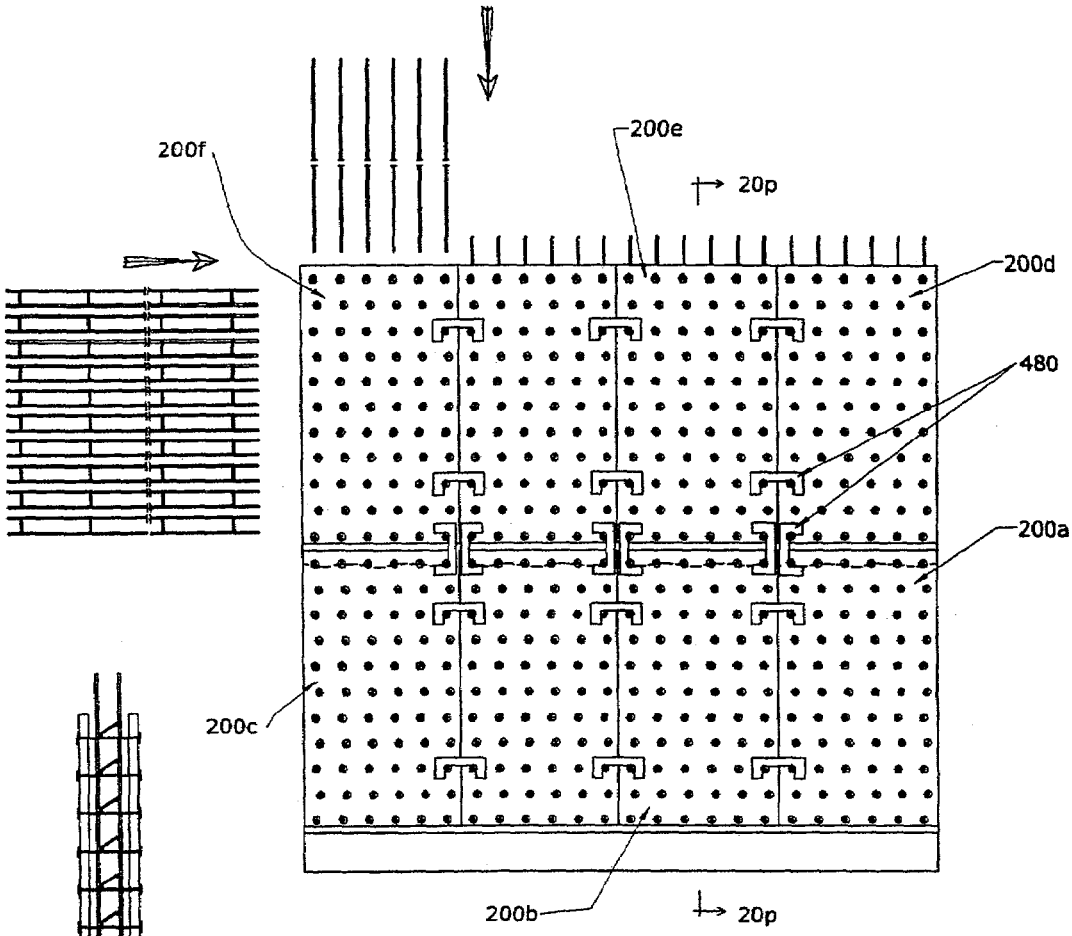
FIG. 20P is a cross section view of the reinforced concrete wall at 20P—20P in FIG. 200.
FIG. 20Q is an enlarged view of detail 20Q in FIG. 20P.
Figure 20P:
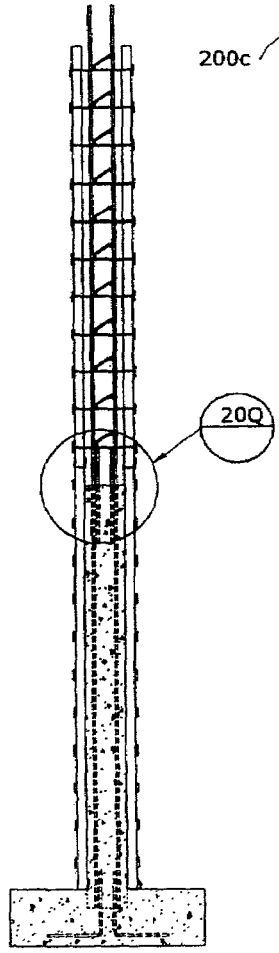
Figure 20Q:
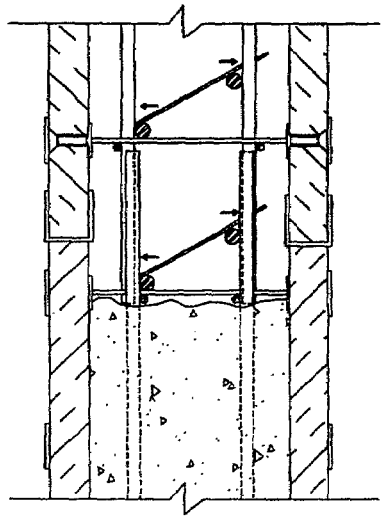

With reference to FIGS. 19, 20A to 20Q, the basic process is shown of forming a reinforced concrete wall, which is erected on concrete footing 800 with 3D prefabricated construction modules 200. With reference to FIG. 19, the concrete footing with installed vertical extensions of reinforced rods is shown. The interval between rods in the longitudinal rows equals the distance between the center of the cells of the 3D prefabricated construction module. The concrete footing has a cavity required for the connection of the reinforced concrete wall and concrete foundation. Vertical reinforced rods 120 are installed in said cavity abutting the reinforcement extensions from footing providing overlapping of reinforcement and a strong connection between the wall and foundation. Overlapping usually has a length of 30–60 diameters of overlapping rods and preferably 40 diameters of the said rods. In order to make 3D prefabricated construction module installation easier, the vertical extensions should be higher than the vertical horizontal plane of the footing but less than the distance between top surface of footing and lower horizontal combination transverse and horizontal elements of the 3D prefabricated construction module. Preferably, the reinforcement bar used for reinforcement of the reinforced concrete walls has a diameter of about 10 mm. Accordingly, the overlapping equals about 400 mm. Considering that the lower mesh layer of the 3D prefabricated construction module is preferably placed not higher than 100 mm, extensions from footing should have length not less than 400 mm and their upper end should not be higher than 100 mm above top surface of footing. The cavity depth should be not less than 300 mm.

The cavity width of the concrete footing is preferably equal or less than the thickness of the reinforced concrete wall erected with 3D prefabricated construction modules 200. The distance between longitudinal rows of the reinforcement extensions should be in accordance with the distance between centers of longitudinal rows of the cells of meshes for installation of the vertical rods.

With reference to FIG. 20A, a first panel 200*a* is attached to footing 800. It should be noted that extensions of reinforced rods 802 are installed for overlapping with the vertical reinforcement rods 120 (see FIG. 20J). The extension lengths of bars 802 must provide the required overlapping with the vertical rods installed in the 3D prefabricated construction module, and the extensions top is located lower than the bottom of the lower horizontal mesh of the 3D prefabricated construction module.

As shown in FIG. 20A connector plates 804 are then inserted in grooves 213 of the panels in 3D prefabricated construction module 200*a* and then, as shown in FIG. 20B, a second 3D prefabricated construction module 200*b* is brought into connection with module 200*a*, by horizontal thrust of the 3D prefabricated construction module 200*b* towards the earlier installed 3D prefabricated construction module 200*a*, and lowering the 3D prefabricated construction module onto the footing reinforcement extensions 802. Thereafter, a third 3D prefabricated construction module 200C can be added to the combination of 3D prefabricated modules 200*a* and 200*b* in the same manner.

To provide the overlapping with vertical reinforcement rods and footing extensions, vertical reinforcement bars are installed in the groove or cavity 803 in parallel to the extension rods. Groove 803 is intended also for receiving the ends of reinforcement vertical rods. The groove width is typically not more than the thickness of the erected reinforced concrete construction.

FIGS. 20C, 20D, 20E and 20F provide a detailed illustration of the sequence of steps for joining two panels 210*a* and 210*b*, which belong to two connecting 3D prefabricated construction modules. The arrangement of the joint between the panels when a strip or plate 804 having wedge-type surface on one side of the plate is introduced into a groove 213 in a pair of opposed panels can be observed.

The plate 804 is preferably made from rigid material, for instance: plastic, metal, composite material or waterproof cardboard. After its installation, the plate is held in the vertical groove of the panel. The plate can be held just because of friction forces with groove walls, or it can be held with adhesives, pins or similar. The strip has wedge front or end portions only from one side of the strip.

As illustrated in FIGS. 20D–20F, when the plate is thrust into the grooves 214 of the panels, it the wedge portion contacts the inner edges of the vertical groove. The effect is that the panel edges are deflected in the direction of the arrows on FIG. 20F. This continues until the end faces of the approaching panel meet the ends of the other panel.

In FIG. 20F it will be observed that joined panels 210*a*, 210*b* have air gaps in the grooves 213, when the plate 804 is installed. This is optional for better connection.

In FIG. 20G, an end fragment of two 3D prefabricated construction modules connected during erection of the reinforced concrete wall is illustrated. Connectors 236 are shown with cut helical groove on the connectors cone surface, the groove having been cut by panel bracer 480 shown on FIG. 8A. Also, the cells for vertical reinforcement rods installation are shown. Also, the mushroom-shaped connector abutment into the panel plate-type strainer is shown.

With reference to FIG. 20H, the installation of bracers 480 to firmly connect panels 210*a*, 210*b* and 210*c* is shown. Connectors 236 of panels 210*c* and 210*b* are partly unscrewed anti-clockwise to permit the bracers 480 to be placed over the cone portions of the connectors 480, with this, ends of panels are not in abutment between themselves (see FIG. 20E). After placing bracers on the connectors of the panels 210*b* and 210*a*, the connectors 236 are screwed back clockwise, causing the helical indentation in the cone portion to be established and abutment of the ends of the panels 210*b* and 210*a* as shown on FIG. 20F. The effect is to draw the adjacent panels towards each other. Horizontal movement of the 3D prefabricated construction module is shown by a horizontal arrow. Also, a gap between the third and the second connecting panels is shown; this gap disappears after installation of plate-type strainers on the mushroom-type connectors and following screwing of those, as shown in the joining of the first and the second 3D prefabricated construction modules.

After installation of all plate-type bracers, temporary scaffolding is provided (scaffolding is not shown) to verify the verticality of the modules and this permits the final preparation of the 3D prefabricated construction module for the period of concreting.

FIG. 20I illustrates the installation of the vertical rod members 120 into the retention cells and into cavity of footing. FIG. 20J provides a perspective view of a 3D prefabricated construction module placed on the concrete footing with installed vertical rods shown on FIG. 6A, which are overlapped with reinforcement extensions from footing on FIG. 19. A portion of the perforated panel is cut away for clarity.

In FIGS. 20K and 20L, the installation of horizontal reinforcement members 540 is illustrated. In FIGS. 20M and 20N, the pouring into the cavity formed between the panels is shown. The broken line shows the top level of concrete pouring to provide the overlapping of the vertical reinforcement rods of the reinforced concrete wall top layer.

FIGS. 20O to 20Q illustrate how the wall of FIGS. 20M and 20N can be enlarged by assembling and connecting additional 3D prefabricated construction modules 200*d*, 200*e* and 200*f* above 3D prefabricated construction modules 200*a*, 200*b*, and 200*c* and securing them with additional bracers 480, in the same manner described above.

Both horizontal reinforcement meshes and vertical rods are added to the combined wall form, which can thereafter be filled with unhardened concrete.

There is another feature of some of the foregoing construction modules which has advantages over known module. Known types of prefabricated 3D construction modules when used as a form, have mechanisms of connecting panels and transverse elements, which do not allow the creation of a pattern on the surface of a concrete wall. After removal of known panels following concrete hardening, connection mechanism elements will extend from the surface of the concrete wall. This is also true of some embodiments referenced above. For example in the module of FIG. 3: it is easy to remove connector 236, but the rod end 314*a* will extend from the wall. Or in FIG. 17, see connector 2336 and rod end 2014*a*. Other known designs do not allow possibility to remove panel without destroying it. Even after such panel removal, connection element will extend from concrete surface. However, as illustrated in FIG. 18*h*, the connection mechanism allows easily unscrewing connector 926, and the removal of the panel after concrete hardening. Additionally there will be no extensions, only small openings on the wall surface, which can be easily sealed at the finishing step. With this, a panel can make a negative pattern on the outside face of the wall and at the same time be used repeatedly.

I claim:

1. A 3D construction module comprising:

a) A vertically upstanding panel oriented generally longitudinally;

b) First and second mesh layers oriented generally transversely and longitudinally; each of said first and second mesh layers comprising at least one rod member extending generally transversely and being mounted to said panel, said first and second mesh layers being vertically spaced from each other;

said at least one rod member of said first mesh layer configured to co-operate with said at least one rod member of said second mesh layer to form a first horizontally projected retention cell to restrict translation of a bar held in said retention cell between said first and second mesh layers;

whereby said first retention cell forms a generally vertically oriented opening for receiving a vertical reinforcement member and said retention cell restricts translation movement longitudinally of a vertical reinforcement member held in said retention cell.

2. A 3D construction module as claimed in claim 1, further comprising a third mesh layer oriented generally transversely and longitudinally, said third mesh layer comprising at least one rod member mounted to said panel and extending generally transversely;

said first, second and third mesh layers being vertically spaced from each other;

said at least one rod member of said second mesh layer configured to co-operate with said at least one rod member of said third mesh layer to form a second horizontally projected retention cell to restrict translation of said vertical reinforcement member held in said second retention cell between said second and third mesh layers;

whereby said first and second retention cells form a generally vertically oriented opening for receiving said vertical reinforcement member therein, and said first and second retention cells restrict translation movement longitudinally of a vertical reinforcement member held in said first and second retention cells, and restrict rotation of said vertical reinforcement member about a transverse axis of the said 3D construction module.

3. A 3D construction module as claimed in claim 2 wherein each of said first, second and third mesh layers comprises a generally transversely oriented rod member and a generally longitudinally oriented rod member fixedly attached to said transverse rod member;

and wherein said transverse rod member and said longitudinal rod member of said first mesh layer are configured to co-operate with said transverse rod member and said longitudinal rod member of said second mesh layer to form a first horizontally projected retention cell that is generally rectangular in shape, so as to restrict translation both longitudinally and transversely and rotation about both a longitudinal and transverse axis of said vertical reinforcement member held in said first retention cell between said first and second mesh layers; and said transverse rod member and said longitudinal rod member of said second mesh layer are configured to co-operate with said transverse rod member and said longitudinal rod member of said third mesh layer to form a second horizontally projected retention cell that is generally rectangular in shape, so as to restrict translation both longitudinally and transversely and rotation about both a longitudinal and transverse axis of said vertical reinforcement member held in said second retention cell between said second and third mesh layers.

4. A 3D construction module as claimed in claim 1 further comprising a vertical reinforcement member held in said retention cell.

5. A 3D construction module as claimed in claim 2 further comprising at least one connector associated with said panel and each of said first, second and third mesh layers, each said at least one connector for engaging said at least said one rod member of each said first, second and third mesh layer to mount said first, second and third mesh layers to said panel in vertically spaced relation to each other.

6. A 3D construction module as claimed in claim 5 wherein said panel has a body and said at least one transverse rod member of at least one mesh layer has an end made as a machine tap that is received into said body of the panel and into an inner cavity in said connector, whereby rotation of said connector around a longitudinal axis of said transverse rod taps a helical groove in the inner cavity of said connector and draws said end of said at least one rod into said body of the panel.

7. A 3D construction module as claimed in claim 1, further comprising at least one connector associated with said panel and with each of said first and second mesh layers for engaging said at least said one rod member of each said first and second mesh layers, each said at least one connector for engaging said at least said one rod member of each said first, and second mesh layers, to mount said first and second mesh layers to said panel in vertically spaced relation to each other.

8. A 3D construction module as claimed in claim 7 further comprising a stopper member mounted to each of said transverse rod members of said first, second and third mesh layers, said connector having a cap portion and a leg portion, the leg of said connector abutting the stopper member and said panel being substantially positioned between said cap portion of said connector and said stopper member.

9. A 3D construction module as claimed in claim 8 wherein each of said stopper members are transversely fixed in relation to their respective said transverse rod members, such that said stopper members co-operate with said connectors to position said mesh layers relative to an inner surface of said panel.

10. A 3D construction module as claimed in claim 9 wherein said stopper member comprises a flange member having a flange and an axial passageway for receiving said transverse member there through, said flange member having its inward axial position relative to said transverse members limited by a position limiting mechanism, said flange member being in abutment with an end of said leg portion of said connector and an inner surface of said panel, whereby said flange member will co-operate with said connector to properly connect with said transverse rod members of the mesh layers and with said panel to properly position said inner surface of said panel relative to said transverse rod members.

11. A 3D construction module as claimed in claim 10 wherein said connector is also adapted to engage said panel whereby said connector will resist transversely outward forces and moments exerted against said inner surface of said panel.

12. A 3D construction module as claimed in claim 11 wherein said connector has a blind cylindrical opening accessible from an inner surface of said panel, the shape of said connector being a figure of rotation of a line around a central transverse axis along said cylindrical opening, said shape of said connector comprising three consequently connected figures of rotation, comprising a first figure having a shape of a cylinder, a second figure having a shape of a truncated cone and a third figure having a shape of a cylinder; said first figure inhibiting displacement of said connector towards said inner surface of said panel.

13. A 3D construction module as claimed in claim 12 wherein said first figure of rotation is formed about a first axis, and said second and third figures of rotation are formed about a second axis, oriented parallel to said first axis, said first axis being spaced from said second axis.

14. A 3D construction module as claimed in claim 1 wherein said panel is made from a nonflammable material.

15. A 3D construction module as claimed in claim 1 wherein said panel is made from a meltable material.

16. A 3D construction module as claimed in claim 15 wherein said panel is made from extruded or expanded polystyrene.

17. A 3D construction module as claimed in claim 16 wherein said panel has a base and wherein said module further comprises a trough element affixed to said base of said panel, said trough having a reservoir of sufficient size to bold the material of said panel when said panel is subjected to sufficient heat from a heat source, to melt said panel material, said panel material flowing into said reservoir when melted by said heat source.

18. A 3D construction module as claimed in claim 15 wherein said panel has a base and wherein said module further comprises a trough element affixed to said base of said panel, said trough having a reservoir of sufficient size to hold the material of said panel when said panel is subjected to sufficient heat from a heat source, to melt said panel material, said panel material flowing into said reservoir when melted by said heat source.

19. A 3D construction module as claimed in claim 3 further comprising a vertically upstanding second panel oriented generally longitudinally, said at least one transverse rod members of each said first, second and third mesh layers being mounted to said second panel, wherein said first and second retention cells are positioned between said first and second panels.

20. A 3D construction module as claimed in claim 19 wherein said first and second mesh layers comprise a plurality of rod members mounted to said first and second panels, to provide for a plurality of longitudinally and transversely spaced retention cells in each of said first and second mesh layers.

21. A 3D construction module as claimed in claim 1 wherein in each of said first and second mesh layers, said at least one rod member comprises a generally transversely oriented rod member and each of said first and second mesh layers comprises a generally longitudinally oriented rod member, and wherein said transverse rod member and said longitudinal rod member of said first mesh layer are configured and positioned to co-operate with said transverse rod member and said longitudinal rod member of said second mesh layer to form said first horizontally projected retention cell so as to restrict said translation movement longitudinally and transversely of said vertical reinforcement member.

22. A 3D construction module as claimed in claim 1 wherein in at least one of said first and second mesh layers said at least one rod member comprises a generally transversely oriented rod member having a portion that extends at least partially, longitudinally so that said horizontally projected retention cell generally surrounds said vertical reinforcement member to restrict the translational movement both longitudinally and horizontally of said vertical reinforcement member.

23. A panel for use in a 3D construction module, said panel comprising:

a body with a thickness;

a plurality of spaced openings passing generally transversely through said body, said openings arranged in a first row of openings, said first row of generally longitudinally spaced openings and a second row of generally longitudinally spaced openings passing generally transversely through said body, said second row of openings being vertically spaced on said body from said first set of openings and wherein first and second adjacent openings in said first row and third and fourth adjacent openings of second row provide apexes for a parallelogram having adjacent sides which have angles between them which are not equal to 90 degrees, said arrangement permitting the use of said panel in said construction module so as to provide longitudinal spacing between a rod mounted in each of said openings to allow a vertical rod to be received between said rods in vertically adjacent openings.

24. A panel as claimed in claim 23 wherein first and second adjacent sides have an angle between them which is less than 90 degrees but greater than or equal to about 80 degrees.

25. A panel for use in a 3D construction module, said panel comprising:

a body with a thickness, said body having a pair of opposed, generally parallel and flat, longitudinal surfaces and a plurality of spaced openings passing generally transversely through said body, said openings arranged in a first row of openings and a second row of longitudinally spaced openings, said second row of openings being vertically spaced on said body from said first set of openings, said first and second rows of openings being oriented at a substantially common angle to said longitudinal surfaces of said body said angle being greater than zero but less than 1 degree.

26. A panel for use in a 3D construction module, said panel comprising:

a body with a thickness and said body having opposite generally vertically oriented side edge faces;

a plurality of pre-formed spaced transverse openings passing through said body, said openings arranged in a first row of spaced transverse openings and a second row of spaced transverse openings, said second row of openings being vertically spaced on said body from said first set of openings and generally parallel to said first row of openings, and being longitudinally off-set from said first row of openings, such that generally said plurality of openings of said first row are not vertically aligned with any of said plurality of openings of said second row, said first and second rows of openings positioned in a plurality of corner locations defining a plurality of adjacent parallelograms, said arrangement permitting the use of said panel in said construction module so as to provide longitudinal spacing between a rod mounted generally transversely in each of said openings of said first and second rows to allow at least one vertical rod to be received between said transverse rods in vertically adjacent openings in said first and second rows.

27. A panel as claimed in claim 26 wherein said first and second rows of openings are substantially evenly spaced at a constant spacing.

28. A connector to connect a panel to a rod member, said connector having a cap portion with a first central longitudinal axis and a body portion with a second central longitudinal axis which is displaced transversely from said first central longitudinal axis, said body portion having a cavity adapted to engage a rod member.

29. A connector as claimed in claim 28 wherein said connector is made substantially from a suitable plastic.

30. A connector as claimed in claim 29 wherein the plastic is glass fiber reinforced polypropylene.

31. A bracer for securing two connectors together, said bracer comprising a generally C-shaped body having a metal portion and first and second spaced leg portions, each of first and second leg portions having an inner face, the inner face of said first leg portion being positioned opposite to the inner face of said second leg portion, each said inner face having a blade forming a tapping tool, wherein when a blade is in contact with a connector, and said connector is rotated, said blade forms a helical indentation in an outer surface of said connector to secure said blade on said connector.

32. A bracer as claimed in claim 31 in combination with a 3D construction module comprising a panel, a pair of transverse rods and two connectors, each said connector being mushroom shaped; said connectors are connected with transverse rods of the 3D construction modules; said body of said bracer being between an outer surface of the panel and the surface of the cap portion of each connector inward of the panel.

33. A bracer as claimed in claim 31 wherein said bracer is made substantially from a suitable metal.

34. A 3D construction module comprising:

a) First and second vertically upstanding, spaced apart panels oriented generally longitudinally;

b) First and second mesh layers oriented generally transversely and longitudinally, each of said first and second mesh layer comprising at least one rod member mounted to each of said first and second panels, said first and second mesh layers being vertically spaced from each other;

said at least one rod member of said first mesh layer configured to co-operate with said at least one rod member of said second mesh layer to form a first horizontally projected retention cell to restrict translation of a vertical reinforcement bar held in said retention cell between said first and second mesh layers;

c) a vertical reinforcement bar held in said retention cell;

whereby said retention cell forms a generally vertically oriented opening for receiving said vertical reinforcement member, said retention cell restricts translation movement longitudinally of a vertical reinforcement member held in said retention cell.

35. A 3D construction module comprising:

a) First and second vertically upstanding, spaced apart panels oriented generally longitudinally;

b) First and second mesh layers oriented generally transversely and longitudinally, each of said first and second mesh layer comprising at least one rod member oriented generally transversely and mounted to each of said first and second panels, said first and second mesh layers being vertically spaced from each other;

said at least one rod member of said first mesh layer configured to co-operate with said at least one rod member of said second mesh layer to form a first horizontally projected retention cell to restrict translation of vertical reinforcement bars held in said retention cell between said first and second mesh layers;

c) a first vertical reinforcement bar held in said first retention cell;

whereby said first cell forms a first generally vertically oriented opening for receiving respectively, said first vertical reinforcement member, said first retention cell restricting translation movement longitudinally and transversely of said first vertical reinforcement member held in said retention cell;

d) a horizontal reinforcement mesh comprising first and second reinforcement bars oriented generally longitudinally, said first and second horizontal reinforcement bars being interconnected by at least one transverse connecting rod member, said horizontal reinforcement mesh being received between said first and second panels with said first and second horizontal reinforcement bars being oriented generally longitudinally and said first horizontal reinforcement bar being in abutment with said first vertical reinforcement bar so as to tend to push said first vertical reinforcement bar transversely outward toward said first panel.

36. A 3D construction module as claimed in claim 35 wherein said at least one rod member of said first mesh layer is configured to co-operate with said at least one rod member of said second mesh layer to form a second horizontally projected retention cell transversely spaced from said first cell to restrict translation of vertical reinforcement bars held in said retention cell between said first and second mesh layers each said second horizontal reinforcement bar is in abutment a second vertical reinforcement bar so as to tend to push said second vertical reinforcement bar transversely outward toward said second panel.

37. A combination of a panel and a trough element for use in a 3D construction module, said panel made of a meltable panel material and comprising a body with a thickness, said body having a pair of opposed, generally parallel and flat, longitudinal surfaces and a base;

a trough element affixed to said base of said panel, said trough having a reservoir of sufficient size to hold the material of said panel when said panel is subjected to sufficient heat from a heat source, to melt said panel material, said panel material flowing into said reservoir when melted by said heat source.

38. A combination as claimed in claim 37 wherein said trough element is made from a metal.

39. A combination as claimed in claim 38 wherein said panel material is expanded or extruded polystyrene.

40. A construction combination comprising:

a) a mesh comprising a first longitudinal rod member and a plurality of transverse rod members connected to said longitudinal rod member;

b) a stopper member for each of said plurality of transverse rod members, each stopper member having a leg portion and a first flange portion, and an axial passageway through said leg portion and said first flange portion, said passageway for freely receiving a rod member there through, said first flange portion adapted to be positioned in abutment with an inner surface of a panel, said leg portion adapted to be positioned in abutment with said longitudinal member, whereby said flange member can co-operate with connector connecting said panel with a transverse rod to properly position said connector and can co-operate with said panel to properly position said inner surface of said panel relative to said longitudinal member.

41. A combination as claimed in claim 40 wherein said leg portion abuts an end face of said stopper member to properly position said connector.

42. A combination as claimed in claim 40 wherein said leg portion has an end for abutting said longitudinal member and wherein said stopper member has a second flange portion mounted on said leg portion and being spaced from said end of said leg portion, said combination providing an opening between said second flange portion and said longitudinal member for receiving a reinforcement member therebetween, said second flange portion and said longitudinal member adapted to restrict transverse movement of said reinforcement member and position said reinforcement member relative to said panel.

43. A connector to connect a panel to a rod member, said connector having a cap portion and a first body portion connected thereto at a first end, said first body portion having an outer surface that is generally transversely oriented and is shaped as a truncated cone portion positioned adjacent said cap portion and configured to engage an inner, generally transversely oriented surface of an opening in a panel, said first body portion having its outer surface narrow front said first end towards a second end opposite said first end, and connected at a connection with a second body portion, said second body portion having an outer surface that is generally cylindrical, said second body portion having a inner cavity adapted to engage a rod member.

44. A connector as claimed in claim 43 wherein said connector is made substantially from a suitable plastic, and wherein said cap portion is a generally flat member and said first end of said first body portion is joined directly to said cap portion.

45. A connector as claimed in claim 43 wherein the plastic is glass fiber reinforced polypropylene.

46. A connector as claimed in claim 43 wherein said cap portion has a first central longitudinal axis and said first and second body portions have a second central longitudinal axis transversely offset front said first longitudinal axis.

47. A 3D construction module comprising:

First and second mesh layers oriented generally transversely and longitudinally, each of said first and second mesh layers comprising a plurality of transversely oriented, and spaced transverse rod members, each of said transverse rod members having an end adapted for mounting to a panel, said plurality of transverse rod members being interconnected to first and second longitudinally oriented and spaced longitudinal rod members, said first and second mesh layers being vertically spaced from each other;

At least one of said transverse rod members and one of said first and second longitudinal rod members of said first mesh layer configured to co-operate with at least one of said transverse rod members and one of said first and second longitudinal rod members of said second mesh layer to form a first horizontally projected retention cell to restrict translation of a bar held in said retention cell between said first and second mesh layers;

whereby said first retention cell forms a generally vertically oriented opening for receiving a vertical reinforcement member and said retention cells restrict translation movement longitudinally and transversely of a vertical reinforcement member held in said retention cell.

48. A 3D construction module as claimed in claim 47, further comprising a third mesh layer oriented generally transversely and longitudinally, said third mesh layer comprising a plurality of transversely oriented, and spaced transverse rod members, each of said transverse rod members of said third mesh layer having an end adapted for mounting to a panel, said plurality of transverse rod members being interconnected to first and second longitudinally oriented and spaced longitudinal rod members:

said first, second and third mesh layers being vertically spaced from each other;

At least one of said transverse rod members and one of said first and second longitudinal rod members of said second mesh layer configured to co-operate with at least one of said transverse rod members and one of said first and second longitudinal rod members of said third mesh layer to form a second horizontally projected retention cell to restrict translation of a bar held in said retention cell between said second and third mesh layers;

whereby said first and second retention cells form a generally vertically oriented opening for receiving said vertical reinforcement member therein, and said first and second retention cells restrict translation movement longitudinally and transversely of a vertical reinforcement member held in said first and second retention cells, and restrict rotation of said vertical reinforcement member about both a longitudinal axis and a transverse axis.

49. A 3D construction module as claimed in claim 48 wherein said transverse rod member and said longitudinal rod member of said first mesh layer are configured to co-operate with said transverse rod member and said longitudinal rod member of said second mesh layer to form a first horizontally projected retention cell that is generally rectangular in shape, so as to restrict said translation and said rotation of said vertical reinforcement member held in said first retention cell between said first and second mesh layers; and said transverse rod member and said longitudinal rod member of said second mesh layer are configured to co-operate with said transverse rod member and said longitudinal rod member of said third mesh layer to form a second horizontally projected retention cell that is generally rectangular in shape, so as to restrict said translation and said rotation of said vertical reinforcement member held in said second retention cell between said second and third mesh layers.

50. A 3D construction nodule as claimed in claim 49 wherein said longitudinal and transverse rod members of each mesh layer are rigidly interconnected to each other to provide a rigid mesh layer structure.

51. A 3D construction module as claimed in claim 50 further comprising a vertical reinforcement member held in said retention cell.

52. A 3D construction module as claimed in claim 51 further comprising a stopper member mounted to said end of each of said transverse rod members of said first, second and third mesh layers.

53. A 3D construction module as claimed in claim 51 wherein each of said stopper members is transversely fixed in relation to their respective said transverse rod members, such that each of said stopper members is adapted to co-operate with a connector to position said mesh layers relative to an inner surface of a panel.

54. A 3D construction module as claimed in claim 53 wherein said stopper is in the form of a washer having a cylindrical opening, said washer being threaded onto an end portion of said transverse member, said end portion having a helical thread.

55. A 3D construction module as claimed in claim 54 wherein said stopper member comprises a flange member having a flange and an axial passageway for receiving said transverse member there through, said flange member movable axially on said transverse rod member, said flange being in abutment with an inner surface of said panel, whereby said flange member will co-operate with said connector and said panel to properly position said inner surface of said panel relative to said transverse and longitudinal rod members.

56. A stopper member comprising:

a cylindrical body portion having a first end and a second end, and having a first axial passageway open from said first end and said second end;

a first flange member formed on said body at said first end;

a second flange member formed on said body at said second end a second body portion joined to said first body portion at said second end, said second body portion having a second axial passageway that is narrower than said first axial passageway, said second body portion having a first generally cylindrical portion adjoining said second flange member, and a truncated conical flange portion, said truncated conical flange portion and said second flange member providing a cavity therebetween for holding at least one rod member therebetween.

57. A stopper member as claimed in claim 56 in combination with a connector for connecting a panel to a rod member, said connector having a cap portion and an elongated body portion having an outer surface that is generally cylindrical, said elongated body portion having an inner cavity adapted to engage said rod member, said elongated body of said connector being receivable in said first axial passageway of said stopper member, said elongated body portion being movable into abutment with said second body portion of said stopper in said first axial passageway, wherein said transverse rod member is receivable through said second axial passageway of said second body portion, into said inner cavity of said connector, held in said first axial passageway of said stopper member.

58. A stopper member as claimed in claim 56 in combination with a panel member held between said cap portion of said connector and said first flange member.

59. A stopper member as claimed in claim 57 in combination with a reinforcement member held in said cavity between said second flange member and said truncated conical flange portion.

60. A system for creating a concrete form comprising first and second panels arranged such that said first and second panels are in longitudinal, upstanding and abutting alignment, said first panel unit has a leading side face and said second panel having a trailing side face, each of said leading side face and said trailing side face being generally in abutment with each other, each of said leading side face and said trailing side face having an elongated groove, and said system further comprising a separate elongated plate member, and said leading face having on one side of said groove a side flange portion, and said trailing face having an opposed side flange portion opposite to said side flange portion of said leading face, and wherein when said panels are disconnected, the width of said groove is smaller than the width of said plate and said side flange portions are angled toward each other, and wherein when said plate is inserted into said groove portions to put said first and second panel in abutting alignment, said grooves are widened, to permit said plate to be received therein, and said side flanges are displaced outwards to provide face to face mating alignment of said side flanges.

61. A system as claimed in claim 60 wherein said plate member is wedge shaped, so that when said plate member is received into said grooves, said side flanges are levered outward to provide for said mating alignment.

62. A method of fabricating a 3D construction module comprising:

a) providing a vertically upstanding panel oriented generally longitudinally;

b) securing first and second mesh layers to said panel such that they are oriented generally transversely and longitudinally, each of said first and second mesh layers comprising at least one rod member mounted to said panel, and said first and second mesh layers being arranged in vertically spaced relation to each other;

c) arranging said at least one rod member of said first mesh layer and said at least one rod member of said second mesh layer to form a first horizontally projected retention cell to restrict translation of a bar held in said retention cell between said first and second mesh layers;

whereby said first retention cell forms a generally vertically oriented opening for receiving a vertical reinforcement member and said retention cell restricts translation movement longitudinally and transversely of a vertical reinforcement member held in said retention cell.

63. A method as claimed in claim 62, further comprising:

a) seeming a third mesh layer to said panel oriented generally transversely and longitudinally, said third mesh layer comprising at least one rod member mounted to said panel, such that said first, second and third mesh layers are vertically spaced from each other;

b) arranging said at least one rod member of said second mesh layer and said at least one rod member of said third mesh layer to form a second horizontally projected retention cell to restrict translation of said vertical reinforcement member held in said second retention cell between said second and third mesh layers;

whereby said first and second retention cells form a generally vertically oriented opening for receiving said vertical reinforcement member therein, and said first and second retention cells restrict translation movement longitudinally and transversely of a vertical reinforcement member held in said first and second retention cells, and restrict rotation of said vertical reinforcement member about both a longitudinal axis and a transverse axis of the said 3D construction module.

64. A stopper member in combination with a connector:

said connector having a leg portion adapted to connect to a rod member;

said stopper member comprising:

a body portion having a first end and a second end, and having a first axial passageway open from said first end and said second end;

a second body portion having a third end and a fourth end, said second body portion joined at said third end to said first body portion at said second end of said first body portion, said second body portion having a second axial passageway extending between said third end and said fourth end, that is narrower than said first axial passageway, said second axial passageway being in communication with said first axial passageway from said third end to said second end, said leg portion of said connector receivable into said first axial passageway of first body portion of said stopper at said first end to engage an end of a rod member receivable in said second axial passageway and extending from said fourth end, past said third end and said second end into said first axial cavity;

said connector and said stopper member adapted to hold a panel member and thereby connect said rod member to said panel member.

65. A combination of a rod member and a connector for securing said rod member to a panel, said connector having a leg portion made of a cuttable material, said leg portion to be received through said panel to engage said rod member, said leg portion having a blind opening to a cavity for receiving said rod member therein to secure said leg portion to said rod, wherein said rod has an end portion with a spiral thread with a pointed end portion formed as a machine tap that when rotated into said blind opening of said leg portion co-operates with said cuttable material to cut said cuttable material of said leg portion, whereby the connection of said connector to said rod member is achieved by rotation of said connector drawing said rod member into said cavity to tap said inner cavity.

66. A combination as claimed in claim 65 wherein said rod has a medial portion of a first diameter and an end portion of a second diameter that is smaller than said first diameter, such that said leg portion receives said end portion of said rod member.

67. A combination as claimed in claim 66 wherein said medial portion acts as a stopper for said connector if said leg portion is brought into abutment with said medial portion.

68. A method of forming a construction element such as wall comprising:

a) prefabricating first and second construction modules, each of said modules comprising a pair of spaced apart panels oriented longitudinally, said pair of panels being interconnected by at least one mesh layer between said panels;

b) installing said first and second construction modules in longitudinal alignment;

c) installing vertical reinforcement in said first and second construction modules;

d) installing horizontal reinforcement in said first and second construction modules; and e) filling said first and second construction modules with unhardened concrete.

69. A method as claimed in claim 68 further comprising after step (b) connecting said first panels of said first module to the adjacent one of said panels of said second module.

70. A method as claimed in claim 68 further comprising prefabricating a third construction module comprising a pair of spaced apart panels oriented longitudinally, said pair of panels being interconnected by at least one mesh layer between said panels; and after step (d) installing said third construction module above at least one of said first and second modules.

71. A panel for use in a 3D construction module, said panel comprising:

a body with a thickness and said body having opposite generally vertically oriented side edge faces;

a plurality of spaced pre-formed openings passing generally transversely through said body, said openings arranged in an arrangement of first, second, third and fourth generally longitudinally oriented and vertically spaced rows of openings, each of said first row including at least two longitudinally spaced openings, said first row, said second row, said third row and said fourth row being successively vertically spaced and stacked in relation to each other with said second row positioned vertically between said first row and said third row;

wherein consecutive openings of said first row and consecutive openings in said third row are generally aligned respectively along a plurality of first generally vertically oriented lines;

and wherein consecutive openings of said second row and consecutive openings in said fourth row are generally aligned respectively along a plurality of second generally vertically oriented line that is spaced from, but generally parallel to, said first lines;

wherein generally said plurality of openings of said first row are not vertically aligned with any of said plurality of openings of said second row or said fourth row; and wherein generally said plurality of openings of said third row are not vertically aligned with any of said plurality of openings of said second row or said fourth row;

and wherein said first and second rows of openings are positioned in a plurality of corner locations defining a first row of adjacent parallelograms, and wherein said second and third rows of openings are positioned in a plurality of corner locations defining a second row of adjacent parallelograms positioned beneath said first row of adjacent parallelograms, said arrangement permitting the use of said panel in said form system so as to provide longitudinal spacing between said first and second lines so that a vertical rod can be received between generally transverse oriented rods mounted in each of said openings.

72. A method for interconnecting first and second panels in longitudinal, upstanding and abutting alignment, each of said first and second panels comprising a pair of opposed side end surfaces, each of said side end surfaces having an elongated groove formed therein extending along at least a portion of the length of said side end surfaces, said grooves being configured to receive and hold a separate elongated plate member along at least a portion of the length thereof, said plate and said grooves cooperating to provide a friction force between them to hold the first and second panels in place when subjected to a force exerted against the first and second panels by poured concrete, said method comprising:

a) inserting a first longitudinal strip of said plate member longitudinally into said groove of said first panel;

b) moving said second panel and second panel towards each other such that an opposed strip of said plate member is received longitudinally into said groove of said second panel, said grooves and said plate member being configured such that said first panel and said second panel can be brought into abutment with each other at said side surfaces, wherein said first and second panels have outward facing longitudinally extending surfaces and wherein said plate member is configured with a wedge surface portion on at least one side, and wherein adjacent side portions of each of said first panel and said second panel of said adjacent said grooves are deformed outwardly when said plate member is inserted in said grooves, said side portions are displaced outwards by said wedge surface portion to provide face to face mating alignment of said side portions of said first and second panels.

73. A 3D construction module comprising:

a) First and second vertically upstanding, spaced apart panels oriented generally longitudinally;

b) First and second mesh layers oriented generally transversely and longitudinally, each of said first and second mesh layers comprising at least one rod member oriented generally transversely and being mounted to each of said first and second panels, said first and second mesh layers being vertically spaced from each other, said at least one rod member of said first mesh layer being longitudinally offset relative to said at least one rod member of said second mesh layer, said first and second mesh layers further each comprising first and second longitudinal rod members oriented generally longitudinally;

said at least one rod member of said first mesh layer configured to co-operate with said at least one rod member of said second mesh layer to form a first horizontally projected retention cell to restrict longitudinal translation of vertical reinforcement bars held in said retention cell;

c) a first vertical reinforcement bar held, respectively, in said retention cell, translation movement transversely of said vertical reinforcement bar being restricted by said first longitudinal rod member of said first mesh layer.

74. A module as claimed in claim 73 further comprising a reinforcement mesh comprising first and second reinforcement bars oriented generally longitudinally, said first and second reinforcement bars being interconnected by at least one transverse connecting rod member, said reinforcement mesh being vertically positioned between said panels between said first mesh and said second mesh.

* * * * *

UNITED STATES PATENT AND TRADEMARK OFFICE

CERTIFICATE OF CORRECTION

PATENT NO. : 7,124,547 B2
APPLICATION NO. : 10/228169
DATED : October 24, 2006
INVENTOR(S) : Leonid G. Bravinski It is certified that error appears in the above-identified patent and that said Letters Patent is hereby corrected as shown below:

Column 10
Line 36, replace “FIG. 200” with -- FIG. 20O --
Line 45, replace “FIG. 200” with -- FIG. 20O --

Column 26
Claim 1, line 11, replace “longitudinally;” with -- longitudinally, --

Column 28
Claim 17, line 28, replace “bold” with -- hold --
Claim 19, line 42, replace “longitudinally,” with -- longitudinally; --

Column 30
Claim 31, line 15, replace “metal” with -- medial --

Column 32
Claim 43, line 23, replace “front” with -- from --
Claim 46, line 38, replace “front” with -- from --

Column 35
Claim 63, line 31, replace “seeming” with -- securing --
Claim 64, line 67, replace “second end,” with -- second end; --

Signed and Sealed this

Sixth Day of February, 2007

JON W. DUDAS
*Director of the United States Patent and Trademark Office*